US010463214B2

(12) United States Patent
Zhong et al.

(10) Patent No.: US 10,463,214 B2
(45) Date of Patent: Nov. 5, 2019

(54) HANDHELD CLEANER

(71) Applicant: JIANGSU MIDEA CLEANING APPLIANCES CO., LTD., Suzhou (CN)

(72) Inventors: Min Zhong, Suzhou (CN); Bingxian Song, Suzhou (CN); Yonghua Wang, Suzhou (CN); Jiajun Wu, Suzhou (CN)

( * ) Notice: Subject to any disclaimer, the term of this patent is extended or adjusted under 35 U.S.C. 154(b) by 348 days.

(21) Appl. No.: 15/512,805

(22) PCT Filed: Nov. 30, 2016

(86) PCT No.: PCT/CN2016/108093
§ 371 (c)(1),
(2) Date: Mar. 20, 2017

(87) PCT Pub. No.: WO2018/000716
PCT Pub. Date: Jan. 4, 2018

(65) Prior Publication Data

US 2019/0082902 A1 Mar. 21, 2019

(30) Foreign Application Priority Data

Jun. 30, 2016 (CN) ..... 2016 1 0503150
Jun. 30, 2016 (CN) ..... 2016 1 0503729
(Continued)

(51) Int. Cl.
*A47L 9/16* (2006.01)
*A47L 5/24* (2006.01)
(Continued)

(52) U.S. Cl.
CPC ..... *A47L 9/1683* (2013.01); *A47L 5/24* (2013.01); *A47L 9/1641* (2013.01);
(Continued)

(58) Field of Classification Search
CPC ..... A47L 5/24; A47L 9/1683; A47L 9/2868; A47L 9/1691; A47L 9/322; A47L 9/1641
See application file for complete search history.

(56) References Cited

U.S. PATENT DOCUMENTS 7,669,281 B2 * 3/2010 Fukuda ..... A47L 5/24 15/344
10,258,209 B2 * 4/2019 Song ..... A47L 5/24
(Continued)

FOREIGN PATENT DOCUMENTS

CN 201755193 U 3/2011
CN 102551606 A 7/2012
CN 105962848 A 9/2016

OTHER PUBLICATIONS

Chinese Patent Application No. 201610969801.8, Office Action dated Jun. 15, 2018, 6 pages.
(Continued)

*Primary Examiner* — Laura C Guidotti
(74) *Attorney, Agent, or Firm* — Kilpatrick Townsend & Stockton

(57) ABSTRACT

A handheld cleaner is provided and includes a dust cup assembly, including: a casing, a negative pressure device disposed in the casing and configured to suck an airflow from an environment into the casing, and a dedusting device disposed in the casing and configured to remove dust from the sucked airflow; and a handle assembly, including: a handle casing disposed to the casing and having a holding portion for user handholding, and a power supply device disposed at a top of the holding portion, and/or in the holding portion, and/or at a position in the handle casing opposite to the holding portion and electrically connected to the negative pressure device.

4 Claims, 17 Drawing Sheets

(30) Foreign Application Priority Data

| | | |
|---|---|---|
| Jun. 30, 2016 | (CN) | 2016 1 0503910 |
| Jun. 30, 2016 | (CN) | 2016 1 0503971 |
| Jun. 30, 2016 | (CN) | 2016 1 0504525 |
| Jun. 30, 2016 | (CN) | 2016 1 0504599 |
| Jun. 30, 2016 | (CN) | 2016 1 0504616 |
| Jun. 30, 2016 | (CN) | 2016 1 0504892 |
| Jun. 30, 2016 | (CN) | 2016 1 0504893 |
| Jun. 30, 2016 | (CN) | 2016 2 0675696 U |
| Jun. 30, 2016 | (CN) | 2016 2 0675699 U |
| Jun. 30, 2016 | (CN) | 2016 2 0676341 U |
| Jun. 30, 2016 | (CN) | 2016 2 0676342 U |
| Jun. 30, 2016 | (CN) | 2016 2 0676343 U |
| Jun. 30, 2016 | (CN) | 2016 2 0676401 U |
| Jun. 30, 2016 | (CN) | 2016 2 0676789 U |
| Jun. 30, 2016 | (CN) | 2016 2 0677750 U |
| Jun. 30, 2016 | (CN) | 2016 2 0677833 U |
| Jun. 30, 2016 | (CN) | 2016 2 0677834 U |
| Jun. 30, 2016 | (CN) | 2016 2 0677884 U |
| Jun. 30, 2016 | (CN) | 2016 2 0678768 U |
| Jun. 30, 2016 | (CN) | 2016 2 0678770 U |
| Nov. 3, 2016 | (CN) | 2016 1 0957621 |
| Nov. 3, 2016 | (CN) | 2016 1 0957622 |
| Nov. 3, 2016 | (CN) | 2016 1 0969801 |
| Nov. 3, 2016 | (CN) | 2016 2 1182366 U |
| Nov. 3, 2016 | (CN) | 2016 2 1182367 U |
| Nov. 3, 2016 | (CN) | 2016 2 1182368 U |
| Nov. 3, 2016 | (CN) | 2016 2 1182369 U |
| Nov. 3, 2016 | (CN) | 2016 2 1182435 U |

(51) Int. Cl.

| | |
|---|---|
| ***A47L 9/32*** | (2006.01) |
| ***A47L 9/28*** | (2006.01) |
| ***A47L 9/22*** | (2006.01) |

(52) U.S. Cl.

CPC ..... *A47L 9/1691* (2013.01); *A47L 9/2868* (2013.01); *A47L 9/322* (2013.01); *A47L 9/22* (2013.01); *A47L 9/2842* (2013.01)

(56) References Cited

U.S. PATENT DOCUMENTS

| | | | | |
|---|---|---|---|---|
| 2013/0091654 | A1* | 4/2013 | Smith | A47L 5/24 15/344 |
| 2017/0196419 | A1* | 7/2017 | Brown | A47L 5/24 |

OTHER PUBLICATIONS

Chinese Patent Application No. 201610969801.8, English translation of Office Action dated Jun. 15, 2018, 7 pages.

* cited by examiner

HANDHELD CLEANER

FIELD

The present disclosure relates to a field of cleaning equipment, and more particularly to a handheld cleaner.

BACKGROUND

For a handheld cleaner in the related art, a power supply device and a negative pressure device are both provided in a handle, and the power supply device is typically disposed at a bottom of the handle, such that the handle has a large volume and a great weight, and thus it is not only inconvenient for a user to hold the handle, but also troublesome and uncomfortable for handholding.

SUMMARY

Embodiments of the present disclosure seek to solve at least one of the problems existing in the related art. Thus, embodiments of the present disclosure provide a handheld cleaner that is small and lightweight.

The handheld cleaner according to the embodiments of the present disclosure includes a dust cup assembly, including: a casing, a negative pressure device disposed in the casing and configured to suck an airflow from an environment into the casing, and a dedusting device disposed in the casing and configured to remove dust from the sucked airflow; and a handle assembly, including: a handle casing disposed to the casing and having a holding portion for user handholding, and a power supply device disposed at a top of the holding portion, and/or in the holding portion, and/or at a position in the handle casing opposite to the holding portion and electrically connected to the negative pressure device.

For the handheld cleaner according to the embodiments of the present disclosure, by providing the power supply device at the handle casing, and also providing the negative pressure device within the cup casing, distribution of a gravity center of the handheld cleaner may be improved effectively, i.e. a position of the gravity center of the entire handheld cleaner is balanced, thus raising comfort of handholding the handheld cleaner by a user, and enabling the user to use the handheld cleaner more effortlessly and conveniently, so as to improve the user experience.

In some embodiments of the present disclosure, the handle casing has a finger gripping portion and a mounting portion configured to be connected to the dust cup assembly, the holding portion and the mounting portion are located at two sides of the finger gripping portion, and the power supply device is disposed in the mounting portion and/or in the holding portion.

In some embodiments of the present disclosure, a length direction of the power supply device disposed in the holding portion is identical to a length direction of the holding portion.

In some embodiments of the present disclosure, a length direction of the power supply device disposed in the mounting portion is identical to a length direction of the mounting portion.

In some embodiments of the present disclosure, the casing has an upright tube shape, a length direction of the mounting portion is identical to an axial direction of the casing, and the mounting portion is connected to a radial side of the casing.

In some embodiments of the present disclosure, the mounting portion is detachably connected to the dust cup assembly.

In some embodiments of the present disclosure, the finger gripping portion is configured as a gripping hole, the handle casing is configured as an annular casing, and the gripping hole is defined by an inner ring of the handle casing.

In some embodiments of the present disclosure, the handle casing further includes a handle top and a handle bottom connected between the mounting portion and the holding portion and disposed opposite to each other, and an electric control board connected to the power supply device is disposed in the handle top and/or the handle bottom.

In some embodiments of the present disclosure, the handle casing includes: the holding portion spaced apart from the casing; an upper arm portion between an upper end of the holding portion and the casing; and a lower arm portion connected between a lower end of the holding portion and the casing, in which the power supply device is disposed to an inner top of the upper arm portion or an outer top of the upper arm portion.

In some embodiments of the present disclosure, the upper end of the holding portion is connected to a center of a bottom of the upper arm portion, and the lower end of the holding portion extends in a direction running away from the casing.

In some embodiments of the present disclosure, the upper arm portion is a rectangle shell disposed horizontally, and the power supply device is disposed in the upper arm portion.

In some embodiments of the present disclosure, the casing has an electrical connection port, and the power supply device is disposed to the outer top of the upper arm portion and electrically plugged in the electrical connection port.

In some embodiments of the present disclosure, the lower arm portion obliquely extends upwards in a direction from the casing to the holding portion.

In some embodiments of the present disclosure, at least part of the upper arm portion, at least part of the lower arm portion and at least part of the casing are integrally molded.

In some embodiments of the present disclosure, at least part of the holding portion, at least part of the upper arm portion and at least part of the lower arm portion are integrally molded.

In some embodiments of the present disclosure, an outer surface of the casing has an upright tube shape, the upper arm portion is connected to a top end of a circumferential surface of the casing, and the lower arm portion is connected to a bottom end of the circumferential surface of the casing.

In some embodiments of the present disclosure, an outer surface of the casing has the upright tube shape, a center line of the holding portion, a center line of the upper arm portion, a center line of the lower arm portion and an axis of the casing are located in a same plane.

In some embodiments of the present disclosure, a central chamber, a dedusting chamber and a dust collecting chamber are provided in the casing; the central chamber has an upright columnar shape and includes an air exhaust chamber and a mounting chamber in communication with each other in an up-and-down direction; the dedusting chamber has a closed annular cross section and surrounds the air exhaust chamber by one circle; the dust collecting chamber is located below the dedusting chamber, and the dust collecting chamber has a non-closed annular cross section and surrounds the mounting chamber by less than one circle, in which the dedusting device is disposed in the dedusting chamber, and the negative pressure device is disposed in the mounting chamber and is in communication with the air exhaust chamber.

In some embodiments of the present disclosure, the casing includes: a dust cup defining the dust collecting chamber, and a cabinet mounted on the dust cup and defining the central chamber and the dedusting chamber; the dust cup includes a base and a cup casing, and the cup casing has a non-closed annular cross section with an opening so as to define the dust collecting chamber whose cross section has the non-closed annular shape in the cup casing; the cup casing is disposed on a top of the base, and a mounting space located outside the dust collecting chamber is defined between an inner-ring wall face of the cup casing and a top wall of the base, in which a top portion of the mounting space is directly opened, and a side portion of the mounting portion is opened by the opening.

In some embodiments of the present disclosure, the central chamber, the dedusting chamber and the dust collecting chamber are provided in the casing; the central chamber has an upright columnar shape and includes an air exhaust chamber and a mounting chamber in communication with each other in an up-and-down direction; the dedusting chamber has a closed annular cross section and surrounds the air exhaust chamber by one circle; the dust collecting chamber is located below the dedusting chamber, and the dust collecting chamber has a closed annular cross section and surrounds the mounting chamber by one circle, in which the dedusting device is disposed in the dedusting chamber, and the negative pressure device is disposed in the mounting chamber and is in communication with the air exhaust chamber.

In some embodiments of the present disclosure, a device housing having a tube shape is provided in the casing, an outer end surface of the device housing at an axial side thereof abuts against or extends beyond a part of an inner surface of the casing, the dedusting chamber is defined between the inner surface of the casing and an outer circumferential surface of the device housing and surrounds the device housing in a circumferential direction of the device housing, and the central chamber is defined in the device housing.

In some embodiments of the present disclosure, the casing includes: a mounting frame, in which the dedusting device is supported on a top of the mounting frame, and the negative pressure device is mounted to a bottom of the mounting frame; and a dust collecting cup covered outside the negative pressure device and detachably connected to the mounting frame.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
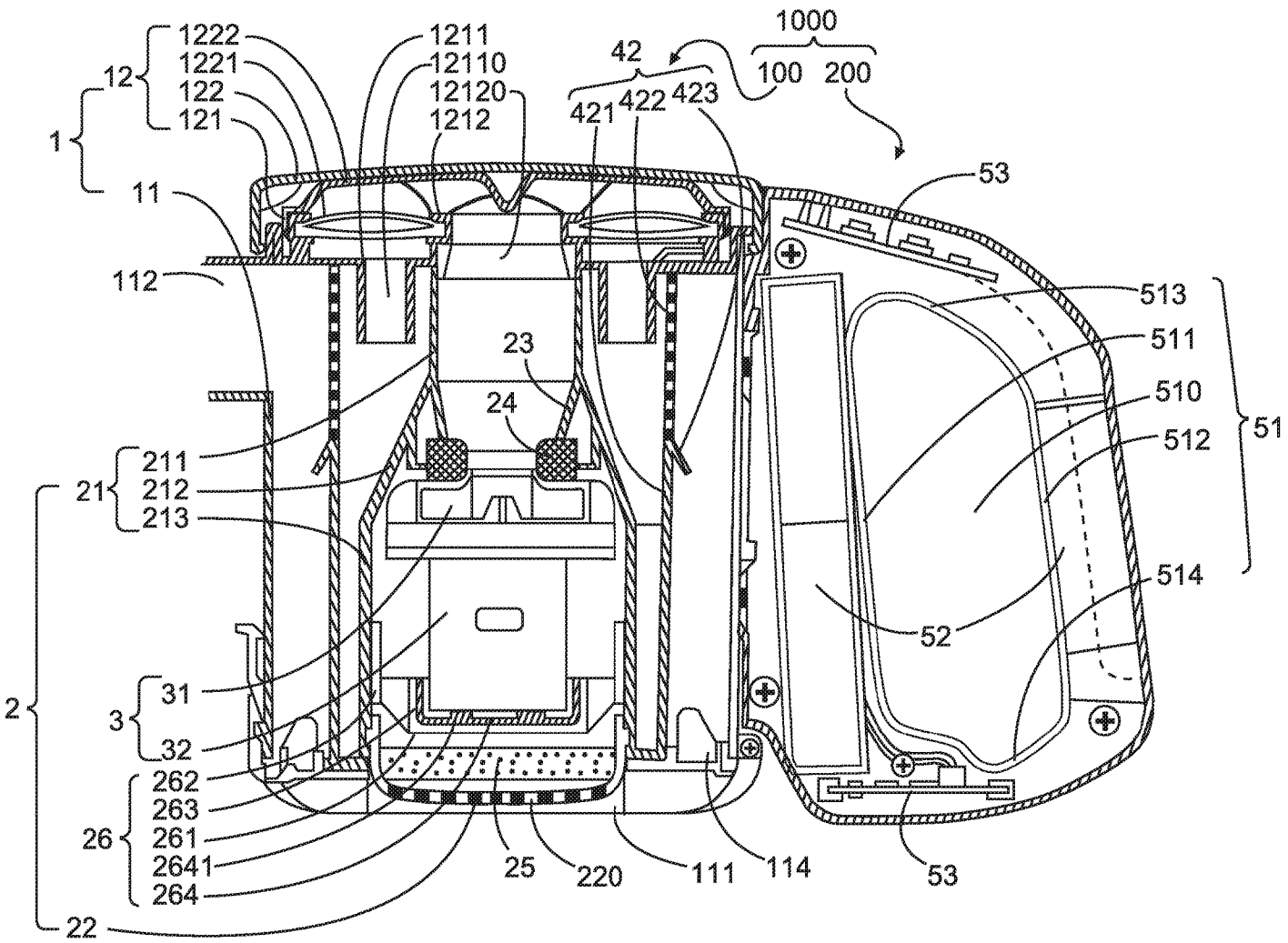
FIG. 1 is a sectional view of a handheld cleaner according to an embodiment of the present disclosure.

Embodiments of the present disclosure will be described in detail and examples of the embodiments will be illustrated in the drawings, where same or similar reference numerals are used to indicate same or similar members or members with same or similar functions. The embodiments described herein with reference to drawings are illustrative, which are used to illustrate the present disclosure, but shall not be construed to limit the present disclosure.

The following disclosure provides many different embodiments or examples to realize different structures of the present disclosure. To simplify the disclosure of the present disclosure, components and configurations in particular examples are elaborated. Of course, they are illustrative, and are not intended to limit the present disclosure. Moreover, reference numbers and/or letters may be repeated in different examples of the present disclosure for the purpose of simplicity and clarity, which shall not be constructed to indicate the relationships among various embodiments and/or configurations. In addition, the present disclosure provides examples of various specific processes and materials, but applicability of other processes and/or utilization of other materials are conceivable for those skilled in the art.

A handheld cleaner according to some specific embodiments of the present disclosure will be described below.

In some embodiments of the present disclosure, the handheld cleaner includes a dust cup assembly, including: a casing, a negative pressure device disposed in the casing and configured to suck an airflow from an environment into the casing, and a dedusting device disposed in the casing and configured to remove dust from the sucked airflow; and a handle assembly, including: a handle casing disposed to the casing and having a holding portion for user handholding, and a power supply device disposed at a top of the holding portion, and/or in the holding portion, and/or at a position in the handle casing opposite to the holding portion and electrically connected to the negative pressure device.

In some embodiments of the present disclosure, the handle casing has a finger gripping portion and a mounting portion configured to be connected to the dust cup assembly, the holding portion and the mounting portion are located at two sides of the finger gripping portion, and the power supply device is disposed in the mounting portion and/or in the holding portion.

In some embodiments of the present disclosure, a length direction of the power supply device disposed in the holding portion is identical to a length direction of the holding portion.

In some embodiments of the present disclosure, a length direction of the power supply device disposed in the mounting portion is identical to a length direction of the mounting portion.

In some embodiments of the present disclosure, the casing has an upright tube shape, a length direction of the mounting portion is identical to an axial direction of the casing, and the mounting portion is connected to a radial side of the casing.

In some embodiments of the present disclosure, the mounting portion is detachably connected to the dust cup assembly.

In some embodiments of the present disclosure, the finger gripping portion is configured as a gripping hole, the handle casing is configured as an annular casing, and the gripping hole is defined by an inner ring of the handle casing.

In some embodiments of the present disclosure, the handle casing further includes a handle top and a handle bottom connected between the mounting portion and the holding portion and disposed opposite to each other, and an electric control board connected to the power supply device is disposed in the handle top and/or the handle bottom.

In some embodiments of the present disclosure, the handle casing includes: the holding portion spaced apart from the casing; an upper arm portion between an upper end of the holding portion and the casing; and a lower arm portion connected between a lower end of the holding portion and the casing, in which the power supply device is disposed to an inner top of the upper arm portion or an outer top of the upper arm portion.

In some embodiments of the present disclosure, the upper end of the holding portion is connected to a center of a bottom of the upper arm portion, and the lower end of the holding portion extends in a direction running away from the casing.

In some embodiments of the present disclosure, the upper arm portion is a rectangle shell disposed horizontally, and the power supply device is disposed in the upper arm portion.

In some embodiments of the present disclosure, the casing has an electrical connection port, and the power supply device is disposed to the outer top of the upper arm portion and electrically plugged in the electrical connection port.

In some embodiments of the present disclosure, the lower arm portion obliquely extends upwards in a direction from the casing to the holding portion.

In some embodiments of the present disclosure, at least part of the upper arm portion, at least part of the lower arm portion and at least part of the casing are integrally molded.

In some embodiments of the present disclosure, at least part of the holding portion, at least part of the upper arm portion and at least part of the lower arm portion are integrally molded.

In some embodiments of the present disclosure, an outer surface of the casing has an upright tube shape, the upper arm portion is connected to a top end of a circumferential surface of the casing, and the lower arm portion is connected to a bottom end of the circumferential surface of the casing.

In some embodiments of the present disclosure, an outer surface of the casing has the upright tube shape, a center line of the holding portion, a center line of the upper arm portion, a center line of the lower arm portion and an axis of the casing are located in a same plane.

In some embodiments of the present disclosure, a central chamber, a dedusting chamber and a dust collecting chamber are provided in the casing; the central chamber has an upright columnar shape and includes an air exhaust chamber and a mounting chamber in communication with each other in an up-and-down direction; the dedusting chamber has a closed annular cross section and surrounds the air exhaust chamber by one circle; the dust collecting chamber is located below the dedusting chamber, and the dust collecting chamber has a non-closed annular cross section and surrounds the mounting chamber by less than one circle, in which the dedusting device is disposed in the dedusting chamber, and the negative pressure device is disposed in the mounting chamber and is in communication with the air exhaust chamber.

In some embodiments of the present disclosure, the casing includes: a dust cup defining the dust collecting chamber, and a cabinet mounted on the dust cup and defining the central chamber and the dedusting chamber; the dust cup includes a base and a cup casing, and the cup casing has a non-closed annular cross section with an opening so as to define the dust collecting chamber whose cross section has the non-closed annular shape in the cup casing; the cup casing is disposed on a top of the base, and a mounting space located outside the dust collecting chamber is defined between an inner-ring wall face of the cup casing and a top wall of the base, in which a top portion of the mounting space is directly opened, and a side portion of the mounting portion is opened by the opening.

In some embodiments of the present disclosure, the central chamber, the dedusting chamber and the dust collecting chamber are provided in the casing; the central chamber has an upright columnar shape and includes an air exhaust chamber and a mounting chamber in communication with each other in an up-and-down direction; the dedusting chamber has a closed annular cross section and surrounds the air exhaust chamber by one circle; the dust collecting chamber is located below the dedusting chamber, and the dust collecting chamber has a closed annular cross section and surrounds the mounting chamber by one circle, in which the dedusting device is disposed in the dedusting chamber, and the negative pressure device is disposed in the mounting chamber and is in communication with the air exhaust chamber.

In some embodiments of the present disclosure, a device housing having a tube shape is provided in the casing, an outer end surface of the device housing at an axial side thereof abuts against or extends beyond a part of an inner surface of the casing, the dedusting chamber is defined between the inner surface of the casing and an outer circumferential surface of the device housing and surrounds the device housing in a circumferential direction of the device housing, and the central chamber is defined in the device housing.

In some embodiments of the present disclosure, the casing includes: a mounting frame, in which the dedusting device is supported on a top of the mounting frame, and the negative pressure device is mounted to a bottom of the mounting frame; and a dust collecting cup covered outside the negative pressure device and detachably connected to the mounting frame.

The handheld cleaner according to some specific embodiments of the present disclosure will be described below.

In some embodiments of the present disclosure, the dust cup assembly includes a casing including a cup body with an open top, and a cleaner cover disposed at a top of the cup body and capable of being opened and closed; a negative pressure device provided in the cup body and used to suck airflow from the environment into the casing; and a dedusting device provided in the cup body, located above the negative pressure device and withdrawable from the top of the cup body when the cleaner cover is opened.

In some embodiments of the present disclosure, the cleaner cover is a circular cleaner cover and has a first end and a second end located at two ends thereof in a diameter direction, in which, the first end is articulated with an upper end edge of the cup body, and the second end is connected to the upper end edge of the cup body by a snap connection.

In some embodiments of the present disclosure, the cleaner cover is detachably mounted on the cup body by a snap connection or a threaded connection.

In some embodiments of the present disclosure, a central chamber and a dedusting chamber surrounding the central chamber are provided in the cup body, the negative pressure device is provided in the central chamber, the dedusting device is provided in the dedusting chamber, a communicating chamber is provided in the cleaner cover, an end surface at a side of the cleaner cover facing towards the cup body has an air inlet communicating the communicating chamber with the dedusting chamber and an air outlet communicating the communicating chamber with the central chamber.

In some embodiments of the present disclosure, the cleaner cover includes an inner cover disposed at the top of the cup body, an outer cover disposed at the top of the cup body and covering over the inner cover, and an in-cover air passage member detachably provided between the inner cover and the outer cover or integrally formed in an inner surface of the outer cover, and the communicating chamber is defined between the inner cover and the in-cover air passage member.

In some embodiments of the present disclosure, the cleaner cover further includes an in-cover filter detachably provided in the communicating chamber to filter the airflow flowing into the communicating chamber.

In some embodiments of the present disclosure, the end face at the side of the cleaner cover is provided with a detachable filter covering on the air inlet.

In some embodiments of the present disclosure, a central chamber, a dedusting chamber and a dust collecting chamber are provided in the cup body, the central chamber is configured to have an upright columnar shape and includes an air exhaust chamber and a mounting chamber in communication with each other in an up-and-down direction, the dedusting chamber has a closed annular cross section and surrounds the air exhaust chamber by one circle, the dust collecting chamber is located below the dedusting chamber, has a non-closed annular cross section, and surrounds the mounting chamber by less than one circle, in which, the dedusting device is provided in the dedusting chamber, and the negative pressure device is provided in the mounting chamber and is in communication with the air exhaust chamber. In some embodiments of the present disclosure, the cup body includes a dust cup defining the dust collecting chamber and a cabinet disposed on the dust cup and defining the central chamber and the dedusting chamber, in which, the dust cup includes a base and a cup casing, the cup casing is configured to have the non-closed annular cross section with an opening so as to define the dust collecting chamber having the non-closed annular cross section in the cup casing, the cup casing is disposed at a top of the base, a mounting space located outside the dust collecting chamber is defined between an inner-ring wall face of the cup casing and a top wall of the base, a top of the mounting space is directly opened, and a side of the mounting space is opened by the opening.

In some embodiments of the present disclosure, the cabinet includes an upper body and a lower body disposed at a bottom of the upper body, in which, the dedusting chamber and the air exhaust chamber are both formed in the upper body, the mounting chamber is formed in the lower body, the lower body is mounted at the mounting space via an opened portion of the mounting space, and the upper body is supported on the top of the cup casing.

In some embodiments of the present disclosure, the upper body includes a tube casing and an air exhaust pipe, in which, the air exhaust pipe is provided in the tube casing and the dedusting chamber is defined between the air exhaust pipe and the tube casing, a bottom of the air exhaust pipe penetrates through a bottom wall of the tube casing and the air exhaust chamber in communication with the mounting chamber is defined in the air exhaust pipe.

In some embodiments of the present disclosure, a lower portion of the air exhaust pipe is configured as an expansion pipe segment, and an upper end of the negative pressure device extends into the expansion pipe segment.

In some embodiments of the present disclosure, a central chamber, a dedusting chamber and a dust collecting chamber are provided in the cup body, the central chamber is configured to have an upright columnar shape and includes an air exhaust chamber and a mounting chamber in communication with each other in an up-and-down direction, the dedusting chamber has a closed annular cross section and surrounds the air exhaust chamber by one circle, the dust collecting chamber is located below the dedusting chamber, has a closed annular cross section and surrounds the mounting chamber by one circle, in which, the dedusting device is provided in the dedusting chamber, and the negative pressure device is provided in the mounting chamber and is in communication with the air exhaust chamber.

In some embodiments of the present disclosure, a tube-shaped device housing is provided in the cup body, an axial outer end face of the device housing abuts against or penetrates through a partial inner surface of the cup body, the dedusting chamber is defined between the inner surface of the cup body and an outer circumferential surface of the device housing and surrounds the device housing in a circumferential direction of the device housing, and the central chamber is defined in the device housing.

In some embodiments of the present disclosure, the cup body includes a mounting frame, in which, the dedusting device is supported at a top of the mounting frame, and the negative pressure device is mounted to a bottom of the mounting frame; and a dust collecting cup covering over the negative pressure device and detachably connected to the mounting frame.

In some embodiments of the present disclosure, the mounting frame includes a ring, a top end cup ring of the dust collecting cup is connected to the ring in a butt connection; a limiting and supporting portion provided in the ring and fitted with the dedusting device to limit a displacement of the dedusting device in directions other than an upward direction; and a fixed mounting portion provided in the ring and used to fixedly mount the negative pressure device.

In some embodiments of the present disclosure, the dedusting device has a limiting hole penetrating therethrough in an up-and-down direction and a support groove with an open bottom, the support groove includes two support sub-grooves disposed at two radial sides of the limiting hole, the limiting and supporting portion includes a limiting post and a support beam, in which, the limiting post is provided in the ring and fitted in the limiting hole in an insertion manner, the support beam includes two support sub-beams disposed at two radial sides of the limiting post respectively, and the two support sub-beams are correspondingly provided in the two support sub-grooves respectively and support top walls of the corresponding support sub-grooves.

In some embodiments of the present disclosure, the handheld cleaner includes an above-described dust cup assembly, and a handle assembly disposed on the dust cup assembly and used for handholding.

The handheld cleaner according to some specific embodiments of the present disclosure will be described below.

In some embodiments of the present invention, the dust cup is used for the cleaner having the negative pressure device, the dust cup includes a base and a cup casing, in which the cup casing has a non-closed annular cross section with an opening so as to define a dust collecting chamber having a non-closed annular cross section in the cup casing, the cup casing is disposed at a top of the base, a mounting space located outside the dust collecting chamber is defined between an inner-ring wall face of the cup casing and a top wall of the base, a top of the mounting space is directly opened, and a side of the mounting space is opened by an opening, and the negative pressure device is mounted to the mounting space via an opened portion of the mounting space.

In some embodiments of the present invention, the inner-ring wall face of the cup casing is configured as an arc-shaped plate formed by vertically stretching an arc-shaped curve.

In some embodiments of the present invention, the base is configured to have a flat cylindrical shape, and an outer-ring wall face of the cup casing is configured as an arc-shaped plate formed by vertically stretching an arc of a base edge.

In some embodiments of the present invention, a central angle of the above-described arc is 180°~200°.

In some embodiments of the present invention, the cup casing is provided with a chamber-partition wall, the chamber-partition wall is disposed between the inner-ring wall face and an outer-ring wall face and divides the dust collecting chamber into a first dust collecting chamber and a second dust collecting chamber located at two sides of the chamber-partition wall and isolated mutually, top ends of the first dust collecting chamber and the second dust collecting chamber are both opened as inlets, and bottom ends of the first dust collecting chamber and the second dust collecting chamber are both opened as outlets.

In some embodiments of the present invention, a bottom wall of the second dust collecting chamber is configured as an inclined wall with a high center and two low ends, and the two ends of the inclined wall are opened as outlets of the second dust collecting chamber.

In some embodiments of the present invention, the chamber-partition wall includes a vertical wall, in which, the vertical wall is vertically disposed between the inner-ring wall face and the outer-ring wall face, and a top end of the vertical wall is flush with a top end of the dust collecting chamber; and a horizontal wall connected between a bottom end of the vertical wall and the inner-ring wall face to define the second dust collecting chamber among the horizontal wall, the vertical wall and the inner-ring wall face.

In some embodiments of the present invention, a buffering chamber in communication with the dust collecting chamber is provided in the base.

In some embodiments of the present invention, the base includes a base body and a base bottom cover, the base bottom cover is connected to a bottom of the base body and capable of being opened and closed to define the buffering chamber between the base bottom cover and the base body, a top wall of the base body has a communication hole, a bottom end edge of the outer-ring wall face is connected to an edge of the communication hole in a butt joint, so as to communicate the first dust collecting chamber with the buffering chamber, bottom end edges of the inner-ring wall face and the chamber-partition wall are inserted in the communication hole while being fitted therewith and abut against the base bottom cover, so as to isolate the second dust collecting chamber from the first dust collecting chamber and the buffering chamber.

In some embodiments of the present invention, the dust cup further includes a cup cover, the cup cover is disposed at the top of cup casing, covered on the dust collecting chamber, and provided with a dust inlet in communication with the dust collecting chamber.

In some embodiments of the present invention, a dust cup assembly includes an above-described dust cup; a cabinet detachably mounted to the dust cup; a dedusting device provided in the cabinet and used to remove dust from the airflow sucked into the cabinet; a negative pressure device provided in the cabinet and used to suck airflow from the environment into the cabinet.

In some embodiments of the present invention, a handheld cleaner includes an above-described dust cup assembly; and a handle assembly disposed on the dust cup assembly and used for handholding.

The handheld cleaner according to some specific embodiments of the present disclosure will be described below.

In some embodiments of the present disclosure, the dust cup assembly includes a casing having a central chamber, a dedusting chamber and a dust collecting chamber, wherein the central chamber is configured to have an upright columnar shape and comprises an air exhaust chamber and a mounting chamber in communication with each other in an up-and-down direction, the dedusting chamber has a closed annular cross section and surrounds the air exhaust chamber by one circle, the dust collecting chamber is located below the dedusting chamber, has a non-closed annular cross section, and surrounds the mounting chamber by less than a circle; a negative pressure device, in which at least a majority of the negative pressure device is provided in the mounting chamber and used to suck airflow from the environment into the casing; and a dedusting device provided in the dedusting chamber to remove dust from the sucked airflow.

In some embodiments of the present disclosure, a lower portion of the air exhaust chamber is configured as an expansion pipe segment, and an upper end of the negative pressure device extends into the expansion pipe segment.

In some embodiments of the present disclosure, the dedusting device includes a plurality of cyclones provided around the air exhaust chamber and located directly above the dust collecting chamber, in which, each cyclone is configured as a conical tube having a tangential inlet in a side wall thereof and a tapered bottom.

In some embodiments of the present disclosure, the dedusting device further includes a filtration tube fitted over the plurality of cyclones, the filtration tube has a filtration hole and divides the dedusting chamber into a second cyclone chamber and a first cyclone chamber located at an inner side and an outer side of the filtration tube respectively, and the plurality of cyclones are located in the second cyclone chamber.

In some embodiments of the present disclosure, the dust collecting chamber includes a first dust collecting chamber located directly below the first cyclone chamber and in communication with the first cyclone chamber, and a second dust collecting chamber located directly below the second cyclone chamber and in communication with the plurality of cyclones, and the first dust collecting chamber and the second dust collecting chamber are not in communication with each other.

In some embodiments of the present disclosure, top ends of the first dust collecting chamber and the second dust collecting chamber are both opened to serve as inlets, and bottom ends of the first dust collecting chamber and the second dust collecting chamber are both opened to serve as outlets.

In some embodiments of the present disclosure, a bottom wall of the second dust collecting chamber is configured as an inclined wall with a high center and two low ends, and the two ends of the inclined wall are opened to serve as outlets of the second dust collecting chamber.

In some embodiments of the present disclosure, the casing includes a dust cup including a base and a cup casing, in which, the cup casing is configured to have a non-closed annular across section with an opening so as to define the dust collecting chamber having the non-closed annular cross section in the cup casing, the cup casing is disposed at a top of the base and a mounting space located outside the dust collecting chamber is defined between an inner-ring wall face of the cup casing and a top wall of the base, a top of the mounting space is directly opened, and a side of the mounting space is opened by the opening; and a cabinet, in which, the central chamber and the dedusting chamber are both formed in the cabinet and a portion of the cabinet for containing the negative pressure device is mounted at the mounting space via an opened portion of the mounting space.

In some embodiments of the present disclosure, the dust cup further includes the cup cover, the cup cover is disposed at a top of the cup casing and covers on the dust collecting chamber, the cup cover has a dust inlet in communication with the dust collecting chamber, the dust inlet includes a first dust inlet communicating the first dust collecting chamber with the first cyclone chamber, and a second dust inlet communicating the second dust collecting chamber with the plurality of cyclones, and a lower end of each cyclone penetrates through a bottom wall of the tube casing and is inserted in the corresponding second dust inlet while being fitted therewith.

In some embodiments of the present disclosure, the base includes a base body and a base bottom cover, the base bottom cover is connected to a bottom of the base body and capable of being opened and closed to define a buffering chamber between the base bottom cover and the base body, a top wall of the base body has the communication hole, a bottom end edge of an outer-ring wall face is connected to an edge of the communication hole in a butt joint to communicate the first dust collecting chamber with the buffering chamber, the inner-ring wall face and a bottom end edge of a chamber-partition wall are inserted in the communication hole while being fitted therewith and abut against the base bottom cover to isolate the second dust collecting chamber from the first dust collecting chamber and the buffering chamber.

In some embodiments of the present disclosure, the cabinet includes an upper body and a lower body disposed at a bottom of the upper body, in which, the dedusting chamber and the air exhaust chamber are both formed in the upper body, the mounting chamber is formed in the lower body, the lower body is mounted at the mounting space via the opened portion of the mounting space, and the upper body is supported on the top of the cup casing.

In some embodiments of the present disclosure, the lower body includes a protection casing plate and an appearance casing plate, the protection casing plate is disposed adjacent to the inner-ring wall face and matched with a shape of the inner-ring wall face, the appearance casing plate is located at a side of the protection casing plate far away from the inner-ring wall face, and the mounting space is defined between the appearance casing plate and the protection casing plate.

In some embodiments of the present disclosure, two side edges of the protection casing plate extend to be connected to two side edges of the cup casing in a ring length direction thereof respectively and correspondingly.

In some embodiments of the present disclosure, the mounting space is further provided with an air-exhaust filtration device, the air-exhaust filtration device is located between the negative pressure device and the appearance casing plate and an air exhaust space is defined between the air-exhaust filtration device and the appearance casing plate, in which, and the base is supported at a bottom of the lower body and avoids a bottom of the air exhaust space.

In some embodiments of the present disclosure, at least one of the protection casing plate and the appearance casing plate has a sliding groove extending in an up-and-down direction, the air-exhaust filtration device has an elastic sliding sheet, and the elastic sliding sheet is slidably fitted in the sliding groove and the elastic sliding sheet and has an interference fit with the sliding groove.

In some embodiments of the present disclosure, an isolating screen is provided in the cabinet and interposed between the negative pressure device and the air-exhaust filtration device.

In some embodiments of the present disclosure, the cabinet is detachably connected to the dust cup via a quick release assembly.

In some embodiments of the present disclosure, the cup casing is disposed in front of a top of the base, and the quick release assembly includes a first assembly disposed at a front top of the dust cup and a second assembly disposed at a rear bottom of the dust cup.

In some embodiments of the present disclosure, the first assembly includes a snap plate disposed at a front bottom of the cabinet, extending downwards and having a snap hole; and a snap piece disposed at the front top of the dust cup and extending forward into the snap hole to limit a detachment of the dust cup and the cabinet in a direction other than a front-and-rear direction.

In some embodiments of the present disclosure, the second assembly includes a first snap hook disposed at a rear bottom of the cabinet and having a front end bent downward to define a hooking groove; a second snap hook disposed at the rear bottom of the dust cup and having a rear end bent upward to extend into the hooking groove so as to limit a detachment of the dust cup and the cabinet in a front-rear direction; a movable latch disposed at the rear bottom of the cabinet, movable in a front-rear direction and having a front end abutting against a bottom of the second snap hook to prevent the second snap hook from moving downward out of the hooking groove; and an unlocking button capable of being pressed and disposed to the cabinet and fitted with the movable latch, and the movable latch moves backward to release the position limit for the second snap hook when the unlocking button is pressed.

In some embodiments of the present disclosure, the upper body includes a tube casing and an air exhaust pipe, in which, the air exhaust pipe is provided in the tube casing and the dedusting chamber is defined between the air exhaust pipe and the tube casing, a bottom of the air exhaust pipe penetrates through a bottom wall of the tube casing and the air exhaust chamber in communication with the mounting chamber is defined in the air exhaust pipe.

In some embodiments of the present disclosure, a handheld cleaner includes an above-described dust cup assembly, and a handle assembly disposed on the dust cup assembly and used for handholding.

In some embodiments of the present disclosure, the handheld cleaner further includes an extension pipe including a pipe body member, in which, the pipe body member is configured as a hollow pipe with two open ends and has one end connected to the dust suction inlet of the casing; and a rotating member, in which, the rotating member is disposed at the other end of the pipe body member and integrally formed with the pipe body member, the rotating member is provided with an inlet hole in communication with an interior of the pipe body member to make the dust enter the pipe body member via the inlet hole, and then enter the dust suction inlet along the pipe body member; the rotating member is rotatable with respect to the pipe body member and changes an orientation of the inlet hole with respect to the pipe body member during rotating.

In some embodiments of the present disclosure, the rotating member is connected to the pipe body member via a pivoting shaft, or the pipe body member is connected to the rotating member through a spherical fit.

In some embodiments of the present disclosure, the handheld cleaner further includes an extension pipe, the extension pipe is configured as a hollow pipe with two open ends, one end of the extension pipe is detachably communicated with the dust suction inlet of the casing and the other end thereof has a cleaning member integrally formed with the extension pipe.

In some embodiments of the present disclosure, the handheld cleaner further includes a telescopic hose having a first end extending into and fixed in the extension pipe and a second end detachably connected to the dust suction inlet, the first end of the extension pipe is detachably connected to the casing and the telescopic hose is accommodated in an interior of the extension pipe when the extension pipe is connected to the casing.

In some embodiments of the present disclosure, the handheld cleaner further includes a first detection device, in which, the first detection device is disposed to the casing and used to detect a motion state of the casing; a control device, in which, the control device is connected to the first detection device and the negative pressure device and configured to control a working state of the handheld cleaner according to information detected by the detection device.

In some embodiments of the present disclosure, the control device is configured to control the negative pressure device to increase a suction strength if the first detection device detects that a motion speed of the casing rises, and control the negative pressure device to decrease the suction strength if the first detection device detects that the motion speed of the casing drops.

In some embodiments of the present disclosure, the control device is configured to control the negative pressure device to shut down if the first detection device detects that the casing has never moved in a first predetermined duration, the control device is configured to control the negative pressure device to turn on if the first detection device detects displacement of the casing in a second predetermined duration after a shutdown of the negative pressure device, and the control device is configured to control the handheld cleaner to turn off if the first detection device detects no displacement of the casing in the second predetermined duration after the shutdown of the negative pressure device.

In some embodiments of the present disclosure, the casing has an air intake passage in communication with the dedusting chamber, the handheld cleaner further includes a second detection device used to detect a dust concentration in the air intake passage; and the control device connected to the second detection device and the negative pressure device and configured to control the working state of the handheld cleaner according to the information detected by the second detection device.

In some embodiments of the present disclosure, the control device is configured to control the negative pressure device to increase the suction strength thereof if the second detection device detects that the dust concentration rises, and control the negative pressure device to decrease the suction strength thereof if the second detection device detects that the dust concentration drops.

The handheld cleaner according to some specific embodiments of the present disclosure will be described below.

In some embodiments of the present disclosure, the dust cup assembly includes: a negative pressure device configured to suck and blow an airflow; a dedusting device configured to remove dust from the airflow; and a casing including a cup body with an open top and a cleaner cover disposed at the top of the cup body, in which the cup body includes a mounting frame and a dust collecting cup, the dedusting device is supported on a top of the mounting frame, the negative pressure device is mounted to a bottom of the mounting frame, and the dust collecting cup is covered outside the negative pressure device and connected to the mounting frame.

In some embodiments of the present disclosure, the dust collecting cup is detachably connected to the mounting frame via a button-hook or an internal-external-thread structure.

In some embodiments of the present disclosure, the mounting frame includes: a ring connected to a top cup ring of the dust collecting cup in a butt connection; a limiting and supporting portion provided in the ring and fitted with the dedusting device to limit a displacement of the dedusting device in directions other than an upward direction; and a fixed mounting portion provided in the ring and configured to fix and mount the negative pressure device.

In some embodiments of the present disclosure, the dedusting device includes a limiting hole penetrating therethrough in an up-and-down direction, and a support groove having an open bottom; the support groove includes two support sub-grooves disposed at two radial sides of the limiting hole; the limiting and supporting portion includes a limiting post and a support beam, in which the limiting post is disposed in the ring and inserted in the limiting hole while being fitted therewith, the support beam includes two support sub-beams disposed at two radial sides of the limiting post respectively, and the two support sub-beams are correspondingly disposed in the two support sub-grooves respectively and configured to support top walls of the corresponding support sub-grooves.

In some embodiments of the present disclosure, each support sub-beam has one splicing plate extending downwards, and the dedusting device includes: a split-type filtration tube, in which the split-type filtration tube includes two arc filters respectively disposed at two sides of the support beam in a width direction thereof, and two splicing plates are connected between side edges of the two arc filters adjacent to each other so as to make up a continuous filtration tube together with the two arc filters; and a filtration tube cover plate covered on a top of the split-type filtration tube, in which the limiting hole is formed in a center of the filtration tube cover plate, and the support groove is formed in a bottom wall of the filtration tube cover plate.

In some embodiments of the present disclosure, the dedusting device further includes a cyclone assembly disposed in the split-type filtration tube, two cyclone assemblies are provided and located at two sides of the support groove in a width direction thereof, each cyclone assembly is connected to the corresponding arc filter and includes a plurality of cyclones arranged in a circumferential direction of the split-type filtration tube, and the filtration tube cover plate has an air outlet pipe correspondingly extending into each cyclone.

In some embodiments of the present disclosure, the mounting frame is integrally molded.

In some embodiments of the present disclosure, the cup body further includes a suction nozzle fixed to the mounting frame or integrally molded with the mounting frame.

In some embodiments of the present disclosure, the handheld cleaner includes the dust cup assembly according to embodiments of the first aspect of the present disclosure, and a handle assembly disposed to the dust cup assembly and configured for handholding.

In some embodiments of the present disclosure, the handheld cleaner further includes an extension pipe, and the extension pipe includes: a pipe body member configured as a hollow pipe with two open ends and a first end of the pipe body member being connected with a dust suction inlet in the casing; and a rotating member disposed at a second end of the pipe body member, integrally formed with the pipe body member, and provided with an inlet hole in communication with an interior of the pipe body member, so as to allow dust to enter the pipe body member via the inlet hole and then enter the dust suction inlet along the pipe body member, in which the rotating member is rotatable with respect to the pipe body member and configured to change orientation of the inlet hole with respect to the pipe body member during rotation of the rotating member.

In some embodiments of the present disclosure, the rotating member is connected to the pipe body member via a pivoting shaft, or the pipe body member is connected to the rotating member through a spherical fit.

In some embodiments of the present disclosure, the handheld cleaner further includes an extension pipe, the extension pipe is configured as a hollow pipe having two open ends, a first end of the extension pipe is detachably communicated with a dust suction inlet in the casing and a second end thereof has a cleaning member formed in one piece with the extension pipe.

In some embodiments of the present disclosure, the handheld cleaner further includes a telescopic hose having a first end extending into and fixed in the extension pipe and a second end detachably connected to the dust suction inlet; the first end of the extension pipe is detachably connected to the casing, and the telescopic hose is accommodated within the extension pipe when the extension pipe is connected to the casing.

In some embodiments of the present disclosure, the handheld cleaner further includes: a first detection device disposed to the casing and configured to detect a motion state of the casing; and a control device connected to the first detection device and the negative pressure device, and configured to control a working state of the handheld cleaner according to information detected by the first detection device.

In some embodiments of the present disclosure, the control device is configured to control the negative pressure device to increase a suction strength thereof if the first detection device detects that a motion speed of the casing rises, and to control the negative pressure device to decrease the suction strength thereof if the first detection device detects that the motion speed of the casing drops.

In some embodiments of the present disclosure, the control device is configured to control the negative pressure device to shut down, if the first detection device detects that the casing has never moved in a first predetermined duration during operation of the negative pressure device; the control device is configured to control the negative pressure device to turn on, if the first detection device detects a displacement of the casing in a second predetermined duration after the shutdown of the negative pressure device; and the control device is configured to control the handheld cleaner to turn off, if the first detection device detects no displacement of the casing in the second predetermined duration after the shutdown of the negative pressure device.

In some embodiments of the present disclosure, the casing includes an air intake passage in communication with a dedusting chamber, and the handheld cleaner further includes: a second detection device configured to detect a dust concentration in the air intake passage; and a control device connected to the second detection device and the negative pressure device, and configured to control the working state of the negative pressure device according to information detected by the second detection device.

In some embodiments of the present disclosure, the control device is configured to control the negative pressure device to increase a suction strength thereof if the second detection device detects that the dust concentration rises, and to control the negative pressure device to decrease the suction strength thereof if the second detection device detects that the dust concentration drops.

The handheld cleaner according to some specific embodiments of the present disclosure will be described below.

Embodiment 1

A handheld cleaner 1000 according to embodiments of the present disclosure will be described with reference to the drawings.

As shown in FIG. 1, the handheld cleaner 1000 according to embodiments of the present disclosure includes a dust cup assembly 100, an extension pipe 300 and a holding assembly. The dust cup assembly 100 may suck dusty air in the environment through the extension pipe 300, filter dust out from the dusty air, and blow a purified airstream back to the environment, which functions as absorption of dust in the environment. The holding assembly is mounted to the dust cup assembly 100 and configured for handheld use. For example, the holding assembly may be a lift handle or a handle assembly 200 shown in FIG. 1, such that a user may move the dust cup assembly 100 through the holding assembly to clean a target area (such as a sofa surface and a ceiling) in the environment.

As shown in FIG. 1, the dust cup assembly 100 includes a casing 1, a device housing 2 and a negative pressure device 3, in which the device housing 2 is disposed within the casing 1 and the negative pressure device 3 is disposed within the device housing 2. That is, the casing 1 encloses the device housing 2 and the device housing 2 encloses the negative pressure device 3, such that the negative pressure device 3 is accommodated in the casing 1, thereby improving structural compactness of the dust cup assembly 100, making the dust cup assembly 100 small and lightweight, facilitating handheld use and realizing aesthetic appearance. Preferably, the casing 1 and the device housing 2 are detachably connected to facilitate cleaning, maintenance and replacement.

It should be noted herein that the term "the device housing 2 disposed within the casing 1" should be interpreted broadly, i.e. interpreted in this way that other parts of the device housing 2 are disposed within the casing 1, except a part thereof disposed at an opening 111 and described in the following paragraph, and the part of the device housing 2 may be disposed within the casing 1 or extend out of an inner chamber of the casing 1 via the opening 111.

Referring to FIG. 1, the casing 1 has the opening 111, and the part of the device housing 2 has an air exhaust port 220 and is disposed at the opening 111 and exposed from the opening 111. That is, the part of the device housing 2 is disposed at the opening 111 and exposed from the opening 111, and has the air exhaust port 220 that is also exposed from the opening 111, such that an airstream in the device housing 2 may flow to the outside of the casing 1 through the air exhaust port 220 and the opening 111.

Figure 3:
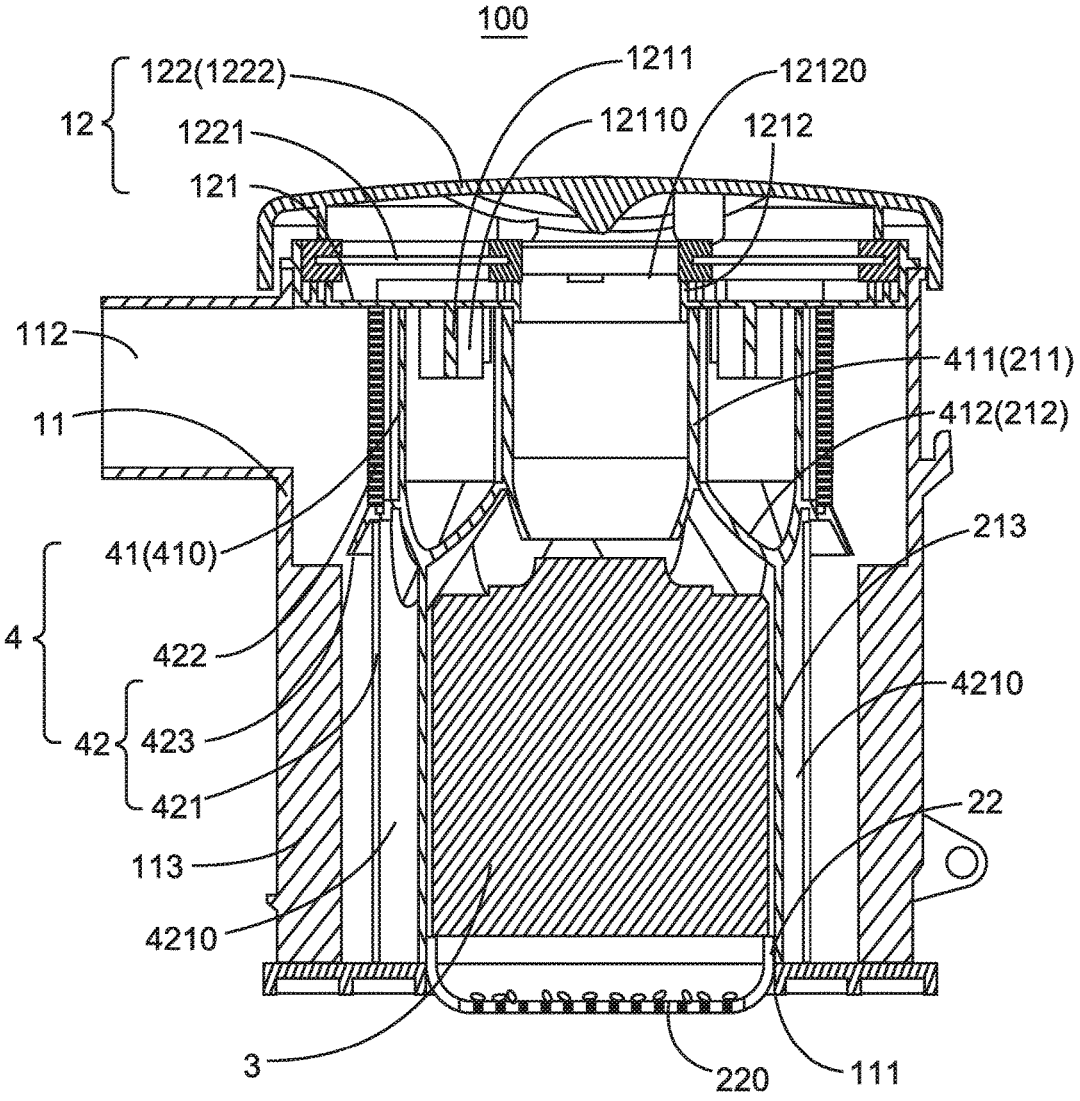
FIG. 3 is a sectional view of a dust cup assembly of a handheld cleaner according to another embodiment of the present disclosure.

The term "the part of the device housing 2 disposed at the opening 111" means that the part of the device housing 2 closely covers the opening 111 to make the opening 111 only in communication with the air exhaust port 220 of the part. The part may at least partially extend out of the inner chamber of the casing 1, as shown in FIGS. 1 and 3, so as to exhaust the airstream reliably and effectively, and improve accuracy of positioning the part of the device housing 2 with the opening to raise reliability of the dust cup assembly 100 during work.

Figure 2:
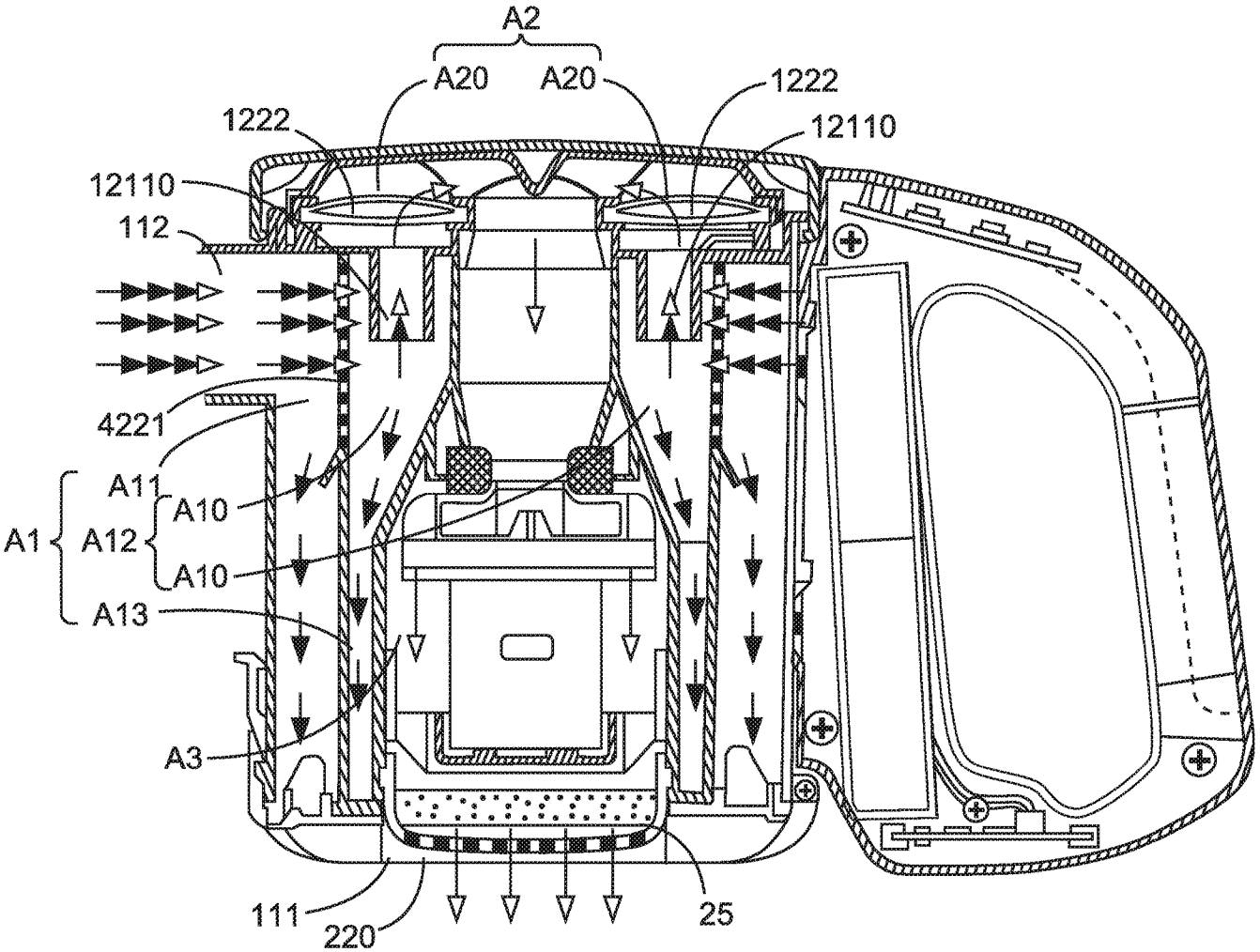
FIG. 2 is a schematic view showing a working principle of the handheld cleaner shown in FIG. 1.

Referring to FIG. 2, the casing 1 has a dust suction inlet 112; a dedusting chamber A1 is defined between the device housing 2 and the casing 1 and communicates with the dust suction inlet 112; the dedusting chamber A1 may be defined by an outer surface of the device housing 2 and an inner surface of the casing 1 together; and the device housing 2 defines an air exhaust chamber A3 therein that communicates the air exhaust port 220 with the dedusting chamber A1. In such a way, the dedusting chamber A1 surrounds the air exhaust chamber A3 because the dedusting chamber A1 is defined between the device housing 2 and the casing 1 and the air exhaust chamber A3 is defined in the device housing 2.

The negative pressure device 3 is configured to supply negative pressure to the air exhaust chamber A3, such that the dusty air in the environment may be sucked into the dedusting chamber A1 through the dust suction inlet 112 for dust and air separation, and the purified airstream separated from the dedusting chamber A1 enters the device housing 2, i.e. enters the air exhaust chamber A3 to be exhausted to the outside of the casing 1 through the air exhaust port 220 and the opening 111. In short, the dusty air in the environment passes through air passages (like an air passage from the dedusting chamber A1 to the air exhaust chamber A3) in the dust cup assembly 100 and hence dust in the dusty air may be filtered out and stored in the dust cup assembly 100, while the purified airstream may flow back to the environment.

Therefore, in terms of a layout of air passages in the dust cup assembly 100, the dedusting chamber A1 surrounds the air exhaust chamber A3, so the layout is more compact, which reduces suction power loss and improves energy efficiency. Moreover, since the air exhaust port 220 is formed in the device housing 2 and may directly exhaust the airstream to the outside environment via the opening 111 in the casing 1, an air exhaust path is shortened effectively and energy consumption is further reduced to improve the energy efficiency. Additionally, the dust suction inlet 112 is formed in the casing 1 and communicates with the dedusting chamber A1 defined between the casing 1 and the device housing 2, and the air exhaust port 220 is formed in the device housing 2 and communicates with the air exhaust chamber A3 in the device housing 2, such that the air passages have a simple layout, and are convenient to process and free of a problem of airflow short circuit, thus having high reliability of dust filtration and a good dust filtration effect.

Certainly, the present disclosure is not limited thereby. In other embodiments of the present disclosure, the air exhaust port 220 may be formed in the casing 1 instead of the device housing 2, and the air exhaust chamber A3 may be in communication with the air exhaust port 220 through a connecting passage, in which case the casing 1 may not necessarily have the opening 111 and the part of the device housing 2 may not be located at the opening 110 and exposed therefrom.

In some preferable embodiments of the present disclosure, the device housing 2 has a tube shape and is disposed in the casing 1; an outer end face (e.g. a lower end face shown in FIG. 1) of the device housing 2 at an axial side thereof abuts against or extends beyond a partial inner surface of the casing 1 (e.g. a lower surface shown in FIG. 1); and the dedusting chamber A1 is defined between the inner surface of the casing 1 and an outer circumferential surface of the device housing 2 and surrounds the device housing 2 along a circumferential direction of the device housing 2. Thus, the layout of air passages in the dust cup assembly 100 is more compact, the air exhaust path is shorter, the energy consumption is lower and the energy efficiency is higher.

Preferably, as shown in FIGS. 1 and 3, the casing 1 and the device housing 2 both have a tube shape, an axis of the casing 1 is in parallel to an axis of the device housing 2, and an outer bottom wall of the device housing 2 abuts against or penetrates through an inner bottom wall of the casing 1, in which case the dedusting chamber A1 may be a hollow annular-columnar chamber defined between an inner circumferential wall of the casing 1 and an outer circumferential wall of the device housing 2, such that when the dust suction inlet 112 is formed along a tangential direction of the dedusting chamber A1, the dedusting chamber A1 may be used as a cyclone separating chamber for cyclonic dust and air separation, so as to improve a purifying effect. Further preferably, the casing 1 and the device housing 2 are arranged coaxially, i.e. the axis of the tube-shaped casing 1 and that of the tube-shaped device housing 2 coincide with each other, and hence the dedusting chamber A1 may be a hollow annular-columnar chamber, which has a better dust and air separation effect and is conductive to mounting a dedusting device 4 described hereinafter.

In conclusion, the handheld cleaner 1000 according to the embodiments of the present disclosure is small and lightweight with a compact structure and effortless for handheld use, and the handheld cleaner 1000 has compact air passages, low energy consumption and high energy efficiency.

The extension pipe 300 according to some embodiments of the present disclosure will be described with reference to FIGS. 11 to 15.

Specifically, the extension pipe 300 is configured to be connected with the dust suction inlet 112 of the dust cup assembly 100. That is, when the dust cup assembly 100 needs the extension pipe 300 to suck dust, the extension pipe 300 may be assembled to the dust suction inlet 112; when the dust cup assembly 100 does not need the extension pipe 300 but another component (such as a gap nozzle a mite-killing nozzle, etc.) for dust suction, the extension pipe 300 may be detached from the dust suction inlet 112 and the other component required actually may be assembled to the dust suction inlet 112.

Figure 14:
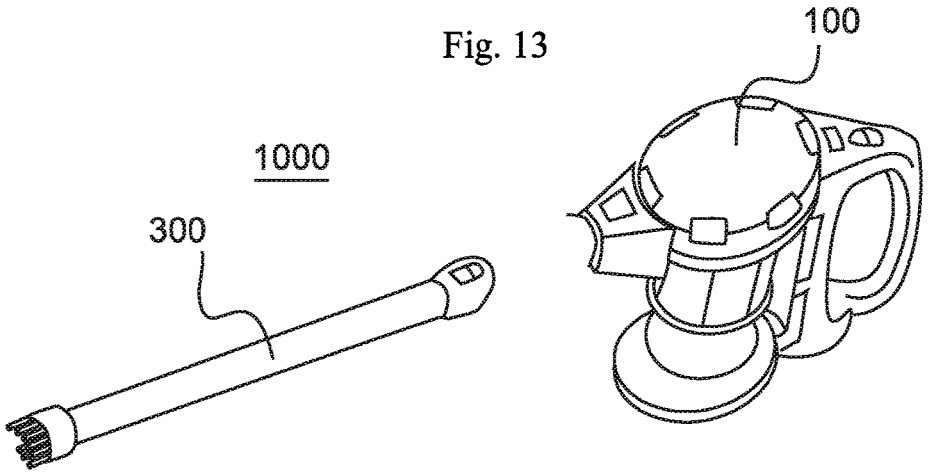
FIG. 14 is an assembling view of an extension pipe and a dust cup assembly according to some embodiments of the present disclosure.

In some specific examples of the present disclosure, referring to FIG. 14, a first end of the extension pipe 300 is directly and detachably connected with the dust suction inlet 112. For example, the extension pipe 300 may be mounted to and dismounted from the dust suction inlet 112 through a quick release snap structure, thus facilitating the mounting and dismounting thereof.

Figure 15:
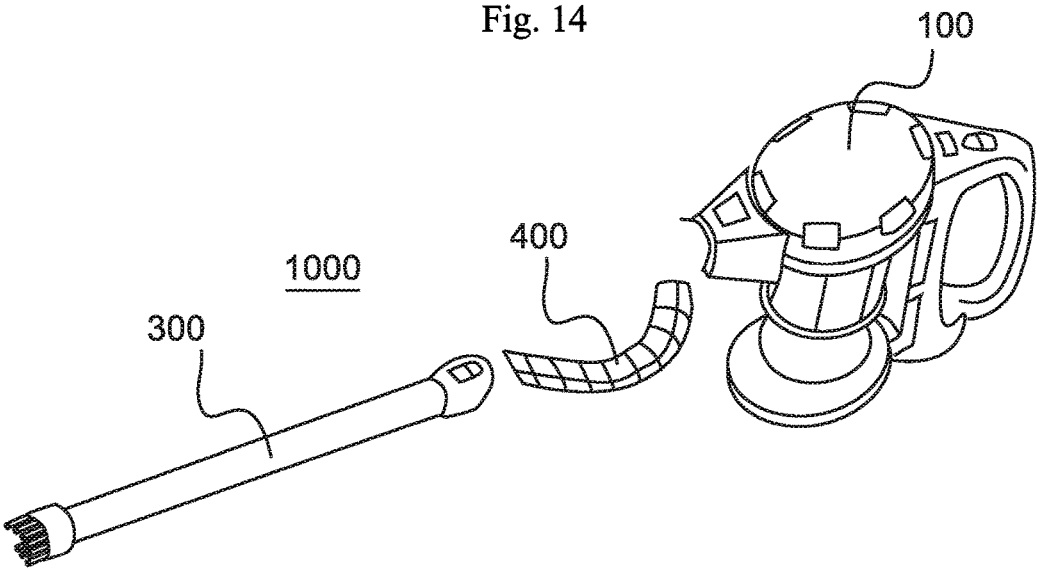
FIG. 15 is an assembling view of an extension pipe and a dust cup assembly according to some other embodiments of the present disclosure.

In some other specific examples of the present disclosure, referring to FIG. 15, the first end of the extension pipe 300 is indirectly and detachably connected with the dust suction inlet 112 through a telescopic hose 400. For example, the extension pipe 300 may be mounted to and dismounted from the telescopic hose 400 through a first quick release structure, and the telescopic hose 400 may be mounted to and dismounted from the dust suction inlet 112 through a second quick release structure, such that the extension pipe 300 may be stretched and retracted through adjustment of the telescopic hose 400. The mounting, dismounting and connecting are convenient, and a dust suction range of the handheld cleaner 1000 can be enlarged. It should be noted herein that the concept "the telescopic hose 400" is well known to those skilled in the art and hence will not be illustrated.

In some more specific examples of the present disclosure, referring to FIG. 15, the first end of the extension pipe 300 is in communication with the dust suction inlet 112 through the telescopic hose 400. For example, a first end of the telescopic hose 400 may extend into and be fixed in the extension pipe 300, and a second end thereof is detachably connected with the dust suction inlet 112. Thus, during assembling, the first end of the telescopic hose 400 may extend into an inner bore of the extension pipe 300 and fixed inside the extension pipe 300. Preferably, the dust cup assembly 100 has a first connecting structure, the first end of the extension pipe 300 has a second connecting structure, and the second connecting structure and the first connecting structure are detachably fitted with each other, such that when the first connecting structure and the second connecting structure are assembled together, the first end of the extension pipe 300 may be fixed to the dust cup assembly 100, and when the first connecting structure is disassembled from the second connecting structure, the extension pipe 300 may be removed from the dust cup assembly 100. For example, the first connecting structure may be a snap hook, and the second connecting structure may be a snap block.

Therefore, when the extension pipe 300 is used for cleaning, the second end of the telescopic hose 400 may be connected to the dust suction inlet 112 of the dust cup assembly 100, such that in the process of using the handheld cleaner 1000, the first end of the extension pipe 300 may be connected to a cup body 11, for example, through the quick release snap structure, if the extension pipe 300 does not needs to be stretched, and at this time the telescopic hose 400 may be completely accommodated in the extension pipe 300, but if the extension pipe 300 needs to be stretched to a long length, the extension pipe 300 may be separated from the cup body 11, and at this time the second end of the telescopic hose 400 may be pulled out and exposed from the extension pipe 300 to realize a lengthening effect.

Figure 11:
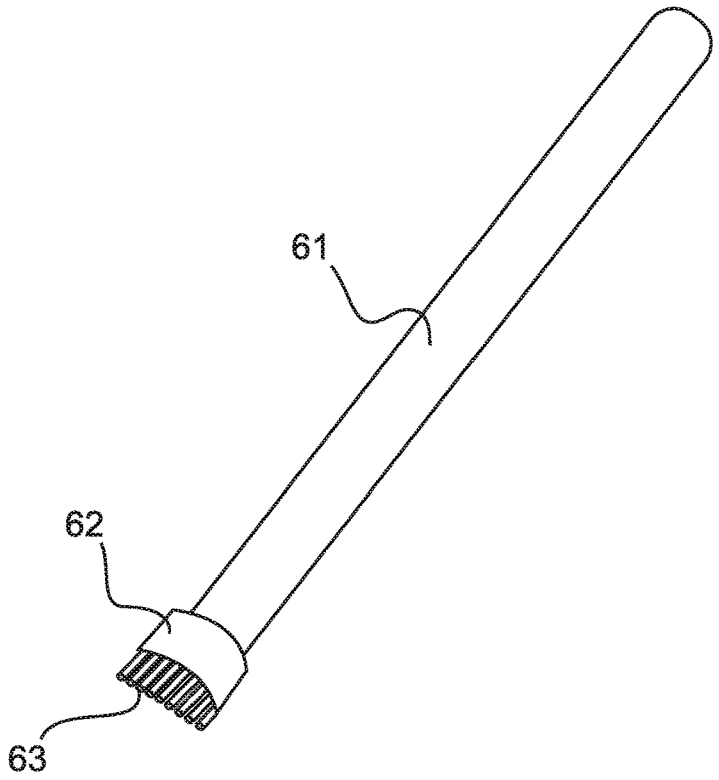
FIG. 11 is a schematic view of an extension pipe according to an embodiment of the present disclosure.

In some embodiments of the present disclosure, as shown in FIG. 11, the extension pipe 300 includes a pipe body member 61 and a rotating member 62; the pipe body member 61 is a hollow pipe with two open ends and a first end thereof is configured to connected with the dust suction inlet 112; and the rotating member 62 is provided at a second end of the pipe body member 61 and rotatably connected with the pipe body member 61, that is, the rotating member 62 may rotate freely around the second end of the pipe body member 61; the rotating member 62 is provided with an inlet hole 622 in communication with an interior of the pipe body member 61, and dust in the environment may enter the pipe body member 61 through the inlet hole 622 and enter the dust suction inlet 112 along the pipe body member 61. Hence, when the rotating member 62 rotates relative to the pipe body member 61, orientation of the inlet hole 622 may be changed with respect to the pipe body member 61. Therefore, when an inclination angle of the pipe body member 61 is constant, an entrance (i.e. the orientation) of the inlet hole 622 in the rotating member 62 may be directed to a place to be cleaned by rotating the rotating member 62, such that the extension pipe 300 may clean different positions effectively, which improves an angle range of dust suction of the extension pipe 300.

Therefore, when the user adopts the extension pipe 300 for cleaning different positions via dust suction, the dust cup assembly 100 no longer needs to be lifted, lowered or inclined to adjust the inclination angle of the whole extension pipe 300; instead, only the rotating member 62 needs to pivoted to adjust the orientation of the inlet hole 622 for targeted cleaning of different positions, so as to achieve a better dust suction effect, reduce labor intensity of the user and facilitate the use of the cleaner 1000.

Figure 12:
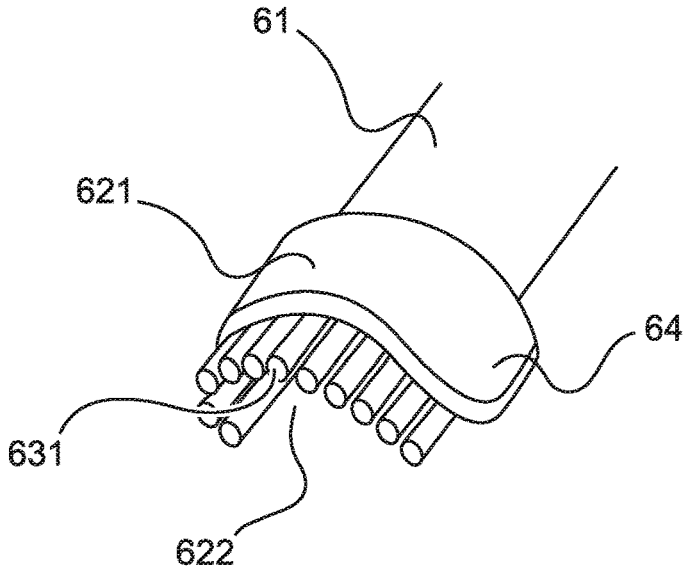
FIG. 12 is a partially enlarged view of the extension pipe shown in FIG. 11.
Figure 13:
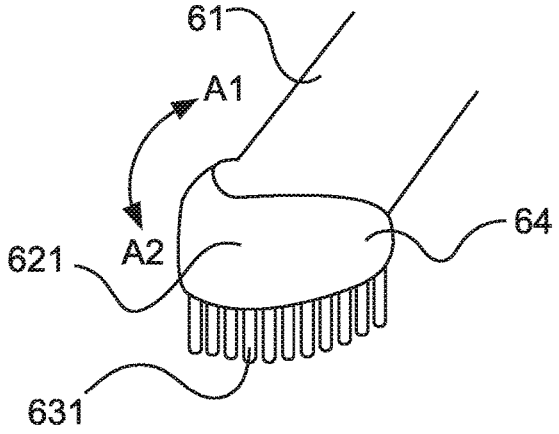
FIG. 13 is a partially enlarged view of the extension pipe of FIG. 12 in a use state.

For example, in a specific example of the present disclosure, as shown in FIGS. 12 and 13, when the extension pipe 300 is used for cleaning, the rotating member 62 may be rotated, for example, along a direction from A1 to A2 in FIG. 13, to rotate the inlet hole 622 to a position in perpendicular to a surface to be cleaned (as a state shown in FIG. 13), so as to improve the cleaning effect. When the extension pipe 300 is not needed for cleaning, the rotating member 62 may be rotated, for example, along a direction from A2 to A1 in FIG. 13, to rotate the inlet hole 622 to a position parallel to a central axis of the pipe body member 61 (as a state shown in FIG. 12), so as to facilitate storage thereof.

Specifically, the rotating member 62 and the pipe body member 61 are in one piece, that is, the rotating member 62 and the pipe body member 61 are connected together, regardless that the extension pipe 300 is in a use state or an unused state, so the user cannot take down the rotating member 62 from the pipe body member 61 or replace it with other components freely. Or, the second end of the pipe body member 61 has no structure configured to assemble other components, so the second end of the pipe body member 61 cannot be assembled with other components even if the rotating member 62 is disassembled from the second end of the pipe body member 61 forcibly. Thus, a problem that working flexibility of the rotating member 62 is reduced for forcible disassembling of the rotating member 62 may be avoided effectively. It should be noted herein that when the extension pipe 300 needs maintenance, a professional may forcibly detach the rotating member 62 from the pipe body member 61, which should be still understood as the technical solution where the rotating member 62 and the pipe body member 61 are in one piece.

It should be noted herein that some handheld cleaners in the related art have an extension pipe, to which various components may be mounted based on practical requirements, but the components can no longer be connected with the extension pipe firmly for repeated disassembling and assembling, thereby resulting in loose and insecure connection and decreasing service reliability and service life. However, in the present disclosure, the rotating member 62 and the pipe body member 61 are processed as a non-detachable one-piece structure, so as to solve the technical problem reliably and effectively.

In conclusion, as to the extension pipe 300 for the handheld cleaner 1000 according to the embodiments of the present disclosure, since the rotatable rotating member 62 is provided at the second end of the pipe body member 61 away from the dust suction inlet 112, suction orientation of the extension pipe 300 may be adjusted by pivoting the rotating member 62, so as to improve the angle range of dust suction of the extension pipe 300, and moreover, since the pipe body member 61 and the rotating member 62 cannot be detached from each other, operational reliability, flexibility and service life of the whole extension pipe 300 are enhanced effectively.

In the embodiments of the present disclosure, the rotating member 62 and the pipe body member 61 may be pivotably connected in various ways. In a first example described below, the pipe body member 61 and the rotating member 62 may be connected via a pivoting shaft 64. In a second example described below, the pipe body member 61 and the rotating member 62 are connected through spherical fit. Thus, the pivotable connection is reliable with high flexibility and is easy to realize.

Example I

Referring to FIGS. 12 and 13, the rotating member 62 includes a semi-annular portion 621, that is, the rotating member 62 has a substantially semicircular tube shape; the semi-annular portion 621 defines the inlet hole 622 extending along its axial direction and is fitted over the second end of the pipe body member 61; and two ends of the semi-annular portion 621 in its circumferential direction are connected with the pipe body member 61 through the pivoting shaft 64. Thus, the pipe body member 61 will not interfere with the rotation of the rotating member 62, which guarantees free and flexible pivoting of the rotating member 62.

Example II

This example is not shown in the drawings. The second end of the pipe body member 61 has an outer surface formed as an outer spherical surface, and the rotating member 62 has an inner surface formed as an inner spherical surface. For example, the rotating member 62 may be formed as a spherical casing and the inlet hole 622 may penetrate through the rotating member 62 along a radial direction of the rotating member 62, such that the rotating member 62 is fitted over the second end of the pipe body member 61 to make the inner spherical surface in fitted connection with the outer spherical surface. Thus, the pipe body member 61 will not interfere with the rotation of the rotating member 62, which guarantees free and flexible pivot of the rotating member 62.

Preferably, a damping member is provided between the pipe body member 61 and the rotating member 62. For example, in the first example, the damping member is provided between the semi-annular portion 621 and the pivoting shaft 64. For example, in the second example, the damping member is provided between the inner spherical surface and the outer spherical surface. Therefore, after the user pivots the rotating member 62, the rotating member 62 may stop at an angle reliably without further automatic rotation, such that the extension pipe 300 may suck dust stably and reliably towards a direction adjusted by the user, thereby further improving the dust suction effect. It should be noted herein that the damping member is a medium for increasing friction, and a specific product thereof is well known to those skilled in the art and hence will not be elaborated.

In some embodiments of the present disclosure, the rotating member 62 may have a cleaning member 63, such as a rag, a sponge or a bristle portion described below, such that the extension pipe 300 may do cleaning by the cleaning member 63 in the process of dust suction, so as to achieve a better cleaning effect. The cleaning member 63 may be fixed to the rotating member 62, i.e. non-detachable and irreplaceable, or may be detachably fixed to the rotating member 62, i.e. replaceable and detachable. Thus, if a second end of the extension pipe 300 has the cleaning member 63, it is more convenient for the user to clean with a higher cleaning efficiency.

In a specific example of the present disclosure, the rotating member 62 has the bristle portion 631 located at an edge of the inlet hole 622. Referring to FIGS. 12 and 13, the bristle portion 631 may be connected to an axial end of the semi-annular portion 621 and extend along a circumferential direction of the semi-annular portion 621, that is, a plurality of bristles are provided at an axial end face of the semi-annular portion 621, extend out along the axial direction of the semi-annular portion 621 and are spaced apart evenly in the circumferential direction of the semi-annular portion 621. Therefore, the bristle portion 631 is arranged in a simple way and easy to realize, and the bristle portion 631 is arranged on a periphery of the inlet hole 622 and thus will not interfere with dust suction of the inlet hole 622.

In some extended embodiments of the present disclosure, the extension pipe 300 may be a hollow pipe with two open ends, the first end of the extension pipe 300 is detachably connected with the dust suction inlet 112, and the second end thereof has the cleaning member 63 integrally formed with the extension pipe 300, such that when the extension pipe 300 is dismounted from the dust cup assembly 100, the user may use the extension pipe 300 with the cleaning member 63 separately to do cleaning, which makes the cleaning member 63 possess an independent function from the dust cup assembly 100.

In some specific examples of the present disclosure, the extension pipe 300 includes the pipe body member 61 and the cleaning member 63, the cleaning member 63 is directly mounted to the second end of the pipe body member 61, and the cleaning member 63 and the pipe body member 61 are in one piece. That is, the cleaning member 63 and the pipe body member 61 are connected together, regardless that the extension pipe 300 is in the use state or the unused state, so the user cannot take down the cleaning member 63 from the pipe body member 61 or replace it with other components freely, thus avoiding a problem that service life of the cleaning member 63 is reduced due to frequent dismounting and replacement thereof. It should be noted herein that when the extension pipe 300 needs maintenance, the professional may forcibly detach the cleaning member 63 from the pipe body member 61, which should be still understood as the technical solution where the cleaning member 63 and the pipe body member 61 are in one piece.

In some other specific examples of the present disclosure, the extension pipe 300 includes the pipe body member 61, the rotating member 62 and the cleaning member 63, the cleaning member 63 is directly mounted to the rotating member 62 so as to be indirectly mounted to the second end of the pipe body member 61, and at this time the cleaning member 63, the rotating member 62 and the pipe body member 61 are in one piece. That is, the cleaning member 63, the rotating member 62 and the pipe body member 61 are connected together, regardless that the extension pipe 300 is in the use state or the unused state, so the user cannot take down the rotating member 62 from the pipe body member 61 or take down the cleaning member 63 from the rotating member 62, or replace them with other components freely, thus avoiding the problem that the service lives of the cleaning member 63 and the rotating member 62 are reduced due to frequent dismounting and replacement thereof. It should be noted herein that when the extension pipe 300 needs maintenance, the professional may forcibly dismount the cleaning member 63 and the rotating member 62 from the pipe body member 61, which should be still understood as the technical solution where the cleaning member 63, the rotating member 62 and the pipe body member 61 are in one piece.

In some embodiments of the present disclosure, the extension pipe 300 is a telescopic pipe. Thus, the extension pipe 300 may be stretched and shortened based on practical requirements, i.e. its length may be adjusted adaptively according to a distance from the place to be cleaned, which is user-friendly. It should be noted herein that a specific implementation of the telescopic pipe is well known to those skilled in the art, such as an umbrella handle and a clothes-hanging rod, both of which are telescopic pipes, and no more elaboration is provided herein.

In conclusion, according to the extended embodiments of the present disclosure, when the extension pipe 300 is the telescopic pipe per se, or is connected with the dust cup assembly 100 through the telescopic hose 400, the extension pipe 300 may be stretched and shortened freely and the length thereof can be adjusted, which is user-friendly; moreover, when the extension pipe 300 is connected with the dust cup assembly 100 through the telescopic hose 400, dust suction may be implemented through transition connection of the telescopic hose 400 even if the extension pipe 300 is separated from the dust cup assembly 100. Additionally, since the second end of the extension pipe 300 is provided with the cleaning member 63, the extension pipe 300 may be used separately, for example, as a broom, when it is completely dismounted from the dust cup assembly 100, thereby improving versatility of the extension pipe 300.

The dust cup assembly 100 according to some embodiments of the present disclosure will be described with reference to FIGS. 1 to 10.

As shown in FIGS. 1 and 2, the casing 1 may have a communicating chamber A2 that communicates the dedusting chamber A1 with the air exhaust chamber A3, such that the airstream separated from the dedusting chamber A1 may enter the device housing 2 through the communicating chamber A2, i.e. entering the air exhaust chamber A3. Thus, the dedusting chamber A1 and the air exhaust chamber A3 are communicated by providing the communicating chamber A2 in the casing 1, such that the layout of air passages in the dust cup assembly 100 is more compact, the suction power consumption is lower and the energy efficiency is higher. Certainly, the present disclosure is not limited thereby, i.e. the dedusting chamber A1 and the air exhaust chamber A3 may be communicated in other manners, for example, by providing a connecting pipe to communicate the dedusting chamber A1 with the air exhaust chamber A3.

Referring to FIG. 1, the casing 1 includes the cup body 11 and a cleaner cover 12, in which the cup body 11 has an open end and the cleaner cover 12 is covered on the open end of the cup body 11, such that the casing 1 has a simple structure and is convenient to process and assemble. Preferably, the cleaner cover 12 is detachably covered on the open end of the cup body 11. That is, the cleaner cover 12 is detachably connected with the cup body 11, so it is convenient to dismount the cleaner cover 12 from the cup body 11 and clean the cup body 11 and the cleaner cover 12. For example, the cup body 11 and the cleaner cover 12 may be detachably connected through a thread structure or a snap structure.

In addition, in some embodiments of the present disclosure, the cup body 11 may further include a main body portion and a bottom cover portion, the main body portion has a tube shape with two open ends, and the bottom cover portion is connected to one open end of the main body portion in such a manner that the bottom cover portion may be opened or closed. Thus, when the bottom cover portion is opened, dust accumulating in the main body portion may be poured out, which is convenient for use.

Referring to FIG. 2, the dust suction inlet 112 and the opening 111 both may be formed in the cup body 11, and the communicating chamber A2 may be defined in the cleaner cover 12. That is, the cup body 11 has the opening 111 and the dust suction inlet 112, the cleaner cover 12 has the communicating chamber A2, such that the communicating chamber A2 is convenient to process, and when the communicating chamber A2 is defined in the cleaner cover 12, the communicating chamber A2 may be located at the same side of the device housing 2 and the dedusting chamber A1 (e.g. an upper side shown in FIG. 1), so as to further simplify the layout of air passages and improve working reliability. For example, in a preferable example of the present disclosure, the cup body 11 has an upright tube shape, i.e. a vertically disposed tube, a top end of the cup body 11 is open to be configured as the open end, the cleaner cover 12 is covered on the top end of the cup body 11, the dust suction inlet 112 may be formed in a side wall of the cup body 11, and the opening 111 may be formed in a bottom wall of the cup body 11. Thus, the casing 1 has an overall simple structure, and is convenient to process, assemble and disassemble.

It should be noted herein that the term "tube shape" is interpreted broadly, that is, a cross section of the tube shape is not limited to be circular, and sizes of various cross sections thereof may be equal or not. Additionally, the term "vertically disposed" means that an axis of the tube shape extends substantially along an up-and-down direction shown in FIG. 1, but the cup body 11 may not keep a vertical state any longer according to a change of handheld angle of the user when the handheld cleaner 1000 is used. For example, the cup body 11 may be in an oblique state or a horizontal state.

Further, the device housing 2 is disposed in the cup body 11, the dedusting chamber A1 is defined among the cleaner cover 12, the cup body 11 and the device housing 2, and the communicating chamber A2 is defined in the cleaner cover 12. Hence, the dedusting chamber A1 may be communicated with the communicating chamber A2 naturally and easily, and positions of the dedusting chamber A1 and the communicating chamber A2 are arranged reasonably, such that the air passages in the dust cup assembly 100 have high non-obstruction, and the problem of airflow short circuit may be avoided.

As shown in FIGS. 1 and 2, the cleaner cover 12 includes an inner cover 121 and an outer cover 122, the inner cover 121 and the outer cover 122 both are covered on the open end of the cup body 11 and the outer cover 122 is covered on the inner cover 121, the communicating chamber A2 is defined between the outer cover 122 and the inner cover 121, the dedusting chamber A1 is defined among the device housing 2, the inner cover 121 and the cup body 11, and the inner cover 121 has an inflow communication hole 12110 that communicates the communicating chamber A2 with the dedusting chamber A1, that is, the dedusting chamber A1 is in communication with the communicating chamber A2 through the inflow communication hole 12110 in the inner cover 121, such that the airstream separated from the dedusting chamber A1 may enter the communicating chamber A2 through the inflow communication hole 12110. Hence, the structure of the cleaner cover 12 is simple, and the communicating chamber A2 is convenient to process.

Preferably, the inner cover 121 has an extension segment 1211 extending towards an interior of the cup body 11, and the inflow communication hole 12110 is defined by the extension segment 1211. In an example shown in FIG. 1, the inner cover 121 may be horizontally disposed at the top of the cup body 11, and the extension segment 1211 may extend downwards from the inner cover 121 into the cup body 11. Thus, the inflow communication hole 12110 has a better communicating effect, and the airstream separated from the dedusting chamber A1 may enter the communicating chamber A2 stably and reliably through the extension segment 1211.

Preferably, the inner cover 121 further has an air outlet ring 1212 extending towards the interior of the cup body 11, and the air outlet ring 1212 is fitted in or over an open end of the device housing 2 and defines an outflow communication hole 12120 that communicates the communicating chamber A2 with an interior of the device housing 2, i.e. communicates the communicating chamber A2 with the air exhaust chamber A3. In examples shown in FIGS. 1 and 2, the inner cover 121 may be horizontally disposed at the top of the cup body 11, and the air outlet ring 1212 may extend downwards from the inner cover 121 into the cup body 11 and be fitted with the open end (i.e. an air inlet end, like a top end of the device housing 2 shown in FIG. 1) of the device housing 2 through sleeve connection. Thus, the outflow communication hole 12120 has a better air outflow effect, and the airstream separated from the communicating chamber A2 may enter the air exhaust chamber A3 more stably and reliably through the air outlet ring 1212 without the problem of airflow short circuit.

In an alternative example of the present disclosure, the inner cover 121 and the outer cover 122 are separately and detachably mounted to the cup body 11. That is, the inner cover 121 is detachably and directly connected with the cup body 11, the outer cover 122 is also detachably and directly connected with the cup body 11, and the inner cover 121 and the outer cover 122 are not directly connected with each other. Thus, the inner cover 121 and the outer cover 122 may be directly detached from the cup body 11, so as to clean the inner cover 121 and the outer cover 122 conveniently.

In the example shown in FIG. 1, part of the inner cover 121 is embedded in the cup body 11 and an edge thereof abuts against the open end of the cup body 11 to prevent the inner cover 121 from falling into the cup body 11; the outer cover 122 is connected with an outer wall of the open end of the cup body 11 through snap connection or threaded connection. Thus, the outer cover 122 may be detached from the cup body 11 easily, and then the inner cover 121 may be taken out of the cup body 11, so as to complete the disassembling. Hence, the structure is simple, and the dismounting and cleaning processes are convenient to implement.

In another alternative example of the present disclosure, which is not shown in the drawings, the inner cover 121 is detachably mounted to the outer cover 122, and one of the inner cover 121 and the outer cover 122 is detachably mounted to the cup body 11. That is, the inner cover 121 and the outer cover 122 are detachably and directly connected with each other, and one of the inner cover 121 and the outer cover 122 is detachably and directly mounted to the cup body 11. Thus, the cleaner cover 12 may be detached from the cup body 11 directly, and then the inner cover 121 and the outer cover 122 are detached from each other, so as to clean the inner cover 121 and the outer cover 122 conveniently.

Referring to FIGS. 1 and 2, the cleaner cover 12 further includes an in-cover filter 1221 that is detachably disposed between the inner cover 121 and the outer cover 122 and located in the communicating chamber A2, such that the airstream may be further filtered by the in-cover filter 1221 after entering the communicating chamber A2 from the dedusting chamber A1, so as to improve a dedusting effect, make cleaner air enter the air exhaust chamber A3, and ensure reliable operation of the negative pressure device 3 and provide longer service life therewith.

Preferably, the in-cover filter 1221 is detachably disposed in the communicating chamber A2. That is, the in-cover filter 1221 may be dismounted from the communicating chamber A2, thereby facilitating the cleaning and replacement of the in-cover filter 1221 and thus improving dust suction and filtration effects. In the example shown in FIG. 1, the in-cover filter 1221 may be clamped and positioned between an in-cover air passage member 1222 described below and the inner cover 121, and also, in an example shown in FIG. 3, the in-cover filter 1221 may be clamped and positioned between the inner cover 121 and the outer cover 122. Thus, after the inner cover 121 is separated from the outer cover 122, the in-cover filter 1221 may be taken out directly, so as to further improve the dismounting efficiency.

Referring to FIGS. 1 to 4, the cleaner cover 12 further includes the in-cover air passage member 1222 that defines, together with the inner cover 121, the communicating chamber A2, so as to facilitate formation of the communicating chamber A2. In the example shown in FIG. 3, the in-cover air passage member 1222 is integrally formed to an internal wall of the outer cover 122, that is, the internal wall of the outer cover 122 may be configured as the in-cover air passage member 1222, which is convenient to process. In the example shown in FIG. 1, the in-cover air passage member 1222 is detachably disposed between the inner cover 121 and the outer cover 122, so that it is convenient to dismount and clean the in-cover air passage member 1222.

Figure 4:
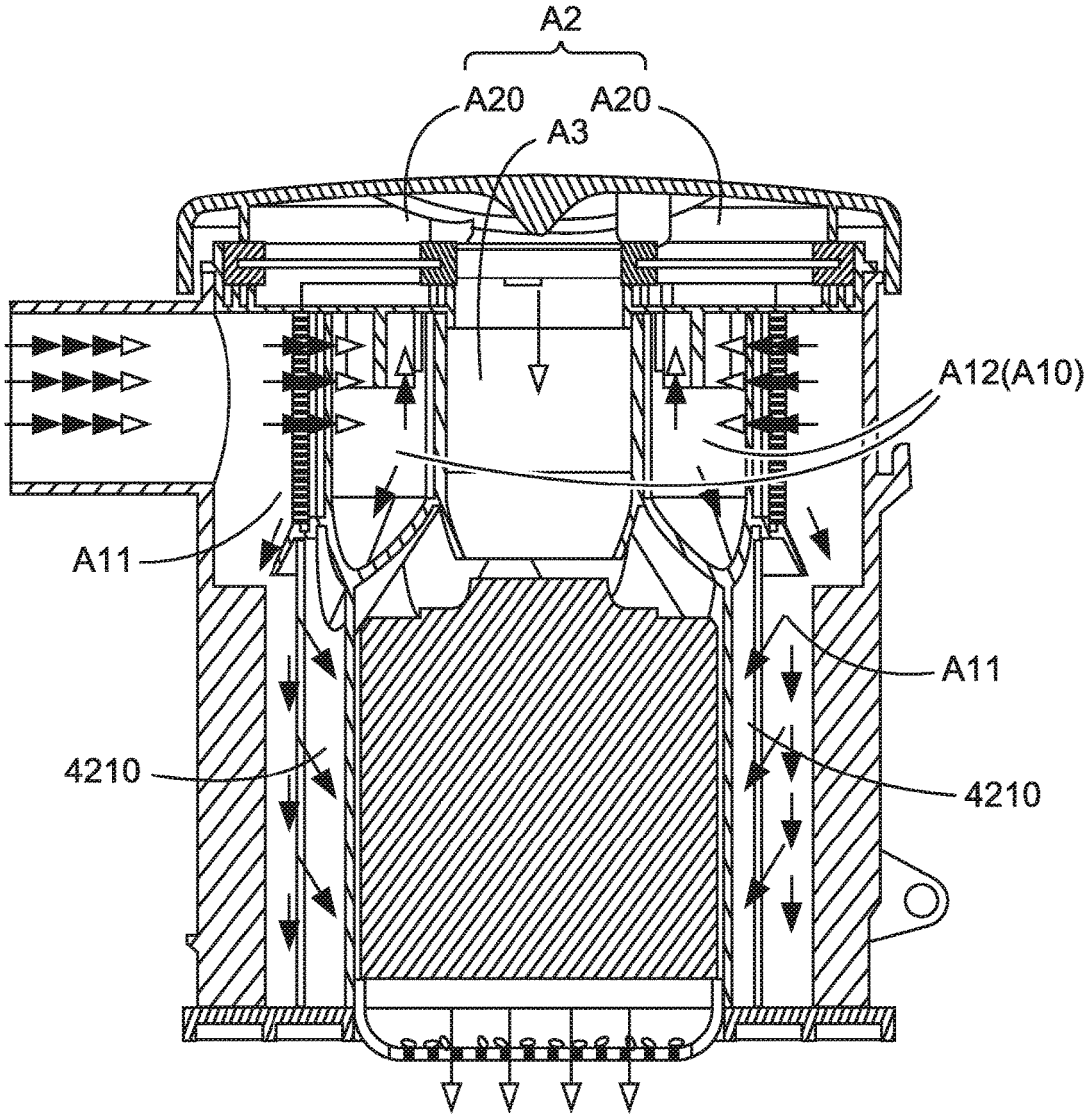
FIG. 4 is a schematic view showing a working principle of the handheld cleaner shown in FIG. 3.

Preferably, referring to FIGS. 3 and 4, the communicating chamber A2 includes a plurality of independent communication air passages A20. That is, the in-cover air passage member 1222 may be provided with a plurality of communicating grooves therein, each communicating groove and the inner cover 121 define one communication air passage A20 therebetween, and the plurality of communication air passages A20 constitute the communicating chamber A2. A plurality of inflow communication holes 12110 are provided and communicate with the plurality of communication air passages A20 correspondingly. That is, each inflow communication hole 12110 corresponds to one communication air passage A20, so the plurality of inflow communication holes 12110 may transport airstreams into the plurality of communication air passages A20 in one-to-one correspondence. Thus, the filtration effect is better.

Preferably, as shown in FIGS. 1 and 2, a plurality of in-cover filters 1221 are provided and disposed in the plurality of communication air passages A20 correspondingly, that is, the airstream entering each communication air passage A20 may be filtered by one in-cover filter 1221, so as to improve the filtration effect effectively. Certainly, the present disclosure is not limited thereby, because it is possible to provide only one in-cover filter 1221 having an annular shape, in which case part of the in-cover filter 1221 may be provided in each communication air passage A20, thus enhancing the filtration effect and facilitating the mounting and dismounting process.

In some embodiments of the present disclosure, the negative pressure device 3 in the device housing 2 may be mounted to the device housing 2, such that it is convenient to mount the negative pressure device 3 and a simple overall structure is provided. Certainly, the present disclosure is not limited thereby, and the negative pressure device 3 may be mounted to the casing 1.

In the example shown in FIG. 1, the negative pressure device 3 is mounted to the device housing 2 by a bracket 26. For example, the bracket 26 may include an upholding portion 261 and a connecting portion 262, a bottom of the negative pressure device 3 is supported on the upholding portion 261, and the connecting portion 262 is connected with the upholding portion 261 and also connected to the device housing 2. Thus, the bracket 26 has a simple structure and may fix the negative pressure device 3 in the device housing 2 stably and reliably.

Preferably, the connecting portion 262 is detachably connected with the device housing 2, so the negative pressure device 3 may be taken out from the device housing 2 by dismounting the bracket 26 from the device housing 2, so as to facilitate the maintenance and replacement of the negative pressure device 3. For example, in some preferable examples of the present disclosure, the connecting portion 262 and the device housing 2 both have a tube shape, and an outer circumferential wall of the connecting portion 262 and an inner circumferential wall of the device housing 2 are detachably connected through a snap structure or a thread structure, which is convenient to process and provides a better mounting and dismounting effect. It should be noted herein that in the description of the present disclosure, both technical solutions of the threaded connection and the snap connection are well known to those skilled in the art, which will not be elaborated.

Further, referring to FIG. 1, the bracket 26 may further include a position limiting portion 263 that is annular, fitted over the negative pressure device 3, and connected to the connecting portion 262 and/or the upholding portion 261. That is, the position limiting portion 263 is fitted with the negative pressure device 3 while limiting a position thereof on the one hand, and is connected to the connecting portion 262, or connected to the upholding portion 261, or connected to both of the connecting portion 262 and the upholding portion 261 on the other hand. In the example shown in FIG. 1, the position limiting portion 263 and the upholding portion 261 may be in one piece. Thus, the bracket 26 may fix the device housing 2 in the casing 1 more stably and reliably.

Referring to FIG. 1, a vibration absorbing member 264 is provided between the bracket 26 and the negative pressure device 3. Thus, even if vibration is generated in the working process of the negative pressure device 3, the vibration may be absorbed by the vibration absorbing member 264 and will not be fully transmitted to the bracket 26, so as to strengthen reliability of connection between the bracket 26 and the device housing 2. Moreover, the vibration absorbing member 264 is provided to reduce vibration noise effectively and improve comfort of using the handheld cleaner 1000.

Preferably, a part of a side surface of the vibration absorbing member 264 facing the negative pressure device 3 is spaced apart from the negative pressure device 3. In the example shown in FIG. 1, the vibration absorbing member 264 is provided with a protrusion 2641, and the negative pressure device 3 is supported on the protrusion 2641, such that part of the side surface of the vibration absorbing member 264 that does not have the protrusion 2641 may keep a certain gap with the negative pressure device 3, thereby improving a vibration absorbing effect of the vibration absorbing member 264.

As shown in FIG. 1, the device housing 2 further has a positioning member 23 for preventing an upward displacement of the negative pressure device 3. Hence, the negative pressure device 3 is subject to an upholding force exerted by the bracket 26 to prevent the negative pressure device 3 from falling down on one hand, and also subject to a force exerted by the positioning member 23 to prevent the negative pressure device 3 from moving upwards on the other hand. Thus, the negative pressure device 3 may be disposed in the device housing 2 more stably and reliably to improve the working reliability of the negative pressure device 3.

Preferably, the positioning member 23 has a tube shape, and has a first axial end (e.g. an upper end shown in FIG. 1) in communication with the air inlet end of the device housing 2 and a second axial end (e.g. a lower end shown in FIG. 1) in communication with an air inlet end of the negative pressure device 3, such that the positioning member 23 may serve to guide the airstream and make the airstream entering the device housing 2 better blown away by the negative pressure device 3, so as to reduce resistance on air suction and exhaust, lower the energy consumption and raise the energy efficiency. Preferably, a sealing member 24 is provided at connection of the second axial end (e.g. the lower end shown in FIG. 1) of the positioning member 23 and the negative pressure device 3, so as to improve air suction capacity of the negative pressure device 3 and lower the energy consumption.

Referring to FIGS. 1 and 2, the opening 111 may be formed in the bottom wall of the casing 1. In such a case, a bottom of the device housing 2 is disposed at the opening 111, and the air exhaust port 220 is formed at the bottom of the device housing 2, for example, in a bottom wall of the device housing 2. That is, the bottom wall of the casing 1 has the opening 111, the bottom of the device housing 2 has the air exhaust port 220, and the air exhaust port 220 is disposed at and exposed from the opening 111. Thus, the airstream in the device housing 2 may be exhausted in an up-to-down direction via the air exhaust port 220 and the opening 111. That is, the airstream purified by the handheld cleaner 1000 is exhausted downwards instead of upwards or laterally, which prevents the airstream from being blown to the user, improves user experience, and hence raises comfort of using the handheld cleaner 1000.

Preferably, a plurality of air exhaust ports 220 are provided and evenly disposed in the bottom wall of the device housing 2. Thus, the handheld cleaner 1000 may exhaust the purified air more efficiently, rapidly and smoothly, so as to decrease the resistance on air suction and exhaust, lower the energy consumption and raise the overall energy efficiency of the handheld cleaner 1000.

Referring to FIGS. 1 and 2, when the device housing 2 has an upright tube shape, the device housing 2 may include a housing body 21 and a housing bottom 22, the housing body 21 has an upright tube shape, the housing bottom 22 is shaped as a bowl and connected to a bottom of the housing body 21, and the air exhaust port 220 is formed in the housing bottom 22. Thus, the device housing 2 has a simple structure, and is convenient to assemble, disassemble and process. Moreover, due to the convenient assembling and disassembling of the device housing 2, the interior of the device housing 2 may be cleaned conveniently on one hand, and the negative pressure device 3 may be maintained and replaced conveniently by the professional on the other hand.

Certainly, the present disclosure is not limited thereby. When the device housing 2 only has the tube shape but not vertically disposed, the device housing 2 may also include the housing body 21 and the housing bottom 22, but the housing body 21 only has the tube shape rather than the vertically disposed tube shape, and the housing bottom 22 is shaped as a bowl and connected to an axial end of the housing body 21. A case where the device housing 2 has the upright tube shape will be taken an example for explanation in the following, and those skilled in the art may understand a technical solution where the device housing 2 only has the tube shape but not vertically disposed, after reading the following technical solution.

Preferably, the housing body 21 is located in the casing 1 and the bottom of the housing body 21 abuts against an inner bottom wall 110 of the casing 1, in which case the dedusting chamber A1 only surrounds the housing body 21 rather than the housing bottom 22 along a circumferential direction of the housing body 21, so as to further enhance compactness of the layout of air passages in the dust cup assembly 100 to reduce the energy consumption for air suction and exhaust and improve the energy efficiency, and meanwhile guarantee the small and lightweight structure of the dust cup assembly 100. Additionally, the housing body 21 and the casing 1 are positioned in that way, thereby improving reliability of positioning the device housing 2 and the casing 1 effectively and facilitating the mounting and dismounting processes.

In a preferable example of the present disclosure, which is not shown in the drawings, the housing body 21 and the housing bottom 22 both are located in the casing 1, an outer bottom wall of the housing bottom 22 is fitted with the inner bottom wall 110 of the casing 1, and a position where the housing bottom 22 is provided with the air exhaust port 220 is opposite the opening 111, which facilitates the mounting process.

In another preferable example of the present disclosure, referring to FIGS. 1 and 3, the housing body 21 is located in the casing 1, the housing bottom 22 has an upper portion extending into the casing 1 to be fitted with the housing body 21 and a lower portion extending downwards out of the inner bottom wall 110 of the casing 1 via the opening 111, and the air exhaust port 220 in the housing bottom 22 also extends downwards out of the inner bottom wall 110 of the casing 1 via the opening 111, in which case the bottom of the device housing 2 extends downwards out of the inner bottom wall 110 of the casing 1 via the opening 111. Thus, the mounting process is convenient to implement and the positioning effect is good. Preferably, a snap connection or a threaded connection is provided between an outer circumferential wall of the housing bottom 22 and an inner circumferential wall of the housing body 21. Thus, it is convenient to assemble and disassemble the housing body 21 and the housing bottom 22.

Further, referring to FIG. 1, the dust cup assembly 100 further includes an in-housing filter 25 that is disposed in the device housing 2 and located between the air exhaust port 220 and the negative pressure device 3. That is, the airstream in the air exhaust chamber A3 is exhausted through the air exhaust port 220 after being filtered by the in-housing filter 25. Thus, the effect of purifying the exhausted air of the handheld cleaner 1000 is further improved.

In some embodiments of the present disclosure, referring to FIG. 3, the dust cup assembly 100 further includes the dedusting device 4 that is disposed in the dedusting chamber A1 and defines a cyclone separating chamber in the dedusting chamber A1. Thus, dust in the dusty air entering the dedusting chamber A1 may be thrown out in a cyclone manner in the cyclone separating chamber, so as to further improve the dedusting effect.

Preferably, in a flow direction of the airstream, the cyclone separating chamber includes multiple stages of cyclone chambers communicated successively, so the dusty air entering the dedusting chamber A1 may go through the multiple stages of cyclone chambers successively for multi-stage dust and air separations, thereby improving the dedusting effect. A two-stage cyclone separating chamber and a three-stage cyclone separating chamber will be taken as examples for explanation in the following, and after reading the following technical solution, those skilled in the art may understand a technical solution having more stages of cyclone chambers, which is not elaborated herein.

In an example shown in FIG. 4, the two-stage cyclone separating chamber includes a first-stage cyclone chamber A11 and a second-stage cyclone chamber A12, and the first-stage cyclone chamber A11 is communicated with the second-stage cyclone chamber A12 and located at the upstream of the second-stage cyclone chamber A12, such that the dusty air entering the dedusting chamber A1 first enters the first-stage cyclone chamber A11 for dust and air separation and then enters the second-stage cyclone chamber A12 for further dust and air separation. For another example, which is not shown in the drawings, the three-stage cyclone separating chamber includes a first-stage cyclone chamber, a second-stage cyclone chamber and a third-stage cyclone chamber, the first-stage cyclone chamber is communicated with the second-stage cyclone chamber and located at the upstream of the second-stage cyclone chamber, and the second-stage cyclone chamber is communicated with the third-stage cyclone chamber and located at the upstream of the third-stage cyclone chamber, such that the dusty air entering the dedusting chamber A1 first enters the first-stage cyclone chamber for dust and air separation, then enters the second-stage cyclone chamber for dust and air separation, and finally enters the third-stage cyclone chamber for dust and air separation.

Preferably, the device housing 2 has the tube shape, each stage of cyclone chamber is configured to be a hollow annular-columnar chamber, and in the flow direction of the airstream, an upstream stage of cyclone chamber surrounds a downstream stage of cyclone chamber along the circumferential direction of the device housing 2. For example, the first-stage cyclone chamber surrounds the second-stage cyclone chamber along the circumferential direction of the device housing 2, the second-stage cyclone chamber surrounds the third-stage cyclone chamber along the circumferential direction of the device housing 2, and so on. Further preferably, the most downstream stage of cyclone chamber surrounds the device housing 2 along the circumferential direction of the device housing 2. For example, as to the two-stage cyclone separating chamber, the second-stage cyclone chamber A12 surrounds the device housing 2 along the circumferential direction of the device housing 2, and as to the three-stage cyclone separating chamber, the third-stage cyclone chamber surrounds the device housing 2 along the circumferential direction of the device housing 2. Thus, the overall layout of the cyclone chambers may be compact, thereby reducing the energy consumption for air suction of the negative pressure device 3.

The dedusting device 4 according to some embodiments of the present disclosure will be described briefly in the following.

As shown in FIGS. 1 and 2, the dedusting device 4 defines the two-stage cyclone separating chamber and hence includes a first cyclone separating member 41 and a second cyclone separating member 42. The first cyclone separating member 41 defines the second-stage cyclone chamber A12 and hence may be called a second-stage cyclone separating member, and the second cyclone separating member 42 defines the first-stage cyclone chamber A11 and hence may be called a first-stage cyclone separating member.

Certainly, the present disclosure is not limited thereby. The dedusting device 4 may only include the first cyclone separating member 41 or the second cyclone separating member 42, in which case the dedusting device 4 defines an one-stage cyclone separating chamber. A case where the dedusting device 4 includes the first cyclone separating member 41 and the second cyclone separating member 42 simultaneously will be taken an example for explanation in the following, and after reading the following technical solution, those skilled in the art may understand a technical solution where the dedusting device 4 only includes the first cyclone separating member 41 or the second cyclone separating member 42.

Referring to FIGS. 3 and 4, when the device housing 2 is tube-shaped, the first cyclone separating member 41 is disposed in the dedusting chamber A1 and surrounds the device housing 2 along the circumferential direction of the device housing 2, and the negative pressure device 3 makes the dusty air enter the dedusting chamber A1 and undergo dust and air separation by the first cyclone separating member 41. Thus, when the first cyclone separating member 41 surrounds the device housing 2 along the circumferential direction of the device housing 2, the first cyclone separating member 41 may make full use of space in the dedusting chamber A1 to improve the dust and air separation effect, and the structure of the dust cup assembly 100 becomes more compact, small and lightweight.

Referring to FIGS. 3 and 4, when the device housing 2 is tube-shaped, the second cyclone separating member 42 has a tube shape and sleeved between the device housing 2 and the casing 1, for example, coaxially fitted over the device housing 2, and the negative pressure device 3 makes the dusty air enter the dedusting chamber A1 and undergo dust and air separation by the second cyclone separating member 42. Thus, when the second cyclone separating member 42 surrounds the device housing 2 along the circumferential direction of the device housing 2, the second cyclone separating member 42 may make full use of the space in the dedusting chamber A1 to improve the dust and air separation effect, and the structure of the dust cup assembly 100 becomes more compact, small and lightweight. In this embodiment, when the dust cup assembly 100 also includes the first cyclone separating member 41, the first cyclone separating member 41 may be located between the second cyclone separating member 42 and the device housing 2, that is, the second cyclone separating member 42 may be located between the first cyclone separating member 41 and the casing 1, such that the dusty air entering the dedusting chamber A1 may first undergo the dust and air separation by the second cyclone separating member 42 and then undergo the dust and air separation by the first cyclone separating member 41.

In some embodiments of the present disclosure, as shown in FIGS. 2 and 4, at least one stage of cyclone chamber includes a plurality of cyclone air passages A10 of the same stage, and the plurality of cyclone air passages A10 of the same stage are successively arranged along the circumferential direction of the device housing 2, such that the airstream separated from an upper stage of cyclone chamber may enter the plurality of cyclone air passages A10 to undergo independent dust and air separations, so as to further improve the dust and air separation effect and the purifying effect.

Preferably, the most downstream stage of cyclone chamber includes a plurality of cyclone air passages A10 of the most downstream stage, that are arranged successively along the circumferential direction of the device housing 2, the communicating chamber A2 includes the plurality of communication air passages A20, and the plurality of communication air passages A20 are in corresponding communication with the plurality of cyclone air passages A10 of the most downstream stage. In the example shown in FIG. 4, for the two-stage cyclone separating chamber, the second-stage cyclone chamber A12 includes the plurality of cyclone air passages A10, and for the three-stage cyclone separating chamber which is not shown in the drawings, the third-stage cyclone chamber includes the plurality of cyclone air passages A10.

The plurality of cyclone air passages A10 are in communication with the plurality of communication air passages A20 in one-to-one correspondence. In the examples shown in FIG. 3 and FIG. 4, a plurality of extension segments 1211 may be fitted in the plurality of communication air passages A20 in one-to-one correspondence, such that a plurality of inflow communication holes 12110 may communicate the plurality of cyclone air passages A10 with the plurality of communication air passages A20 in one-to-one correspondence. Hence, the filtration effect is better.

Figure 7:
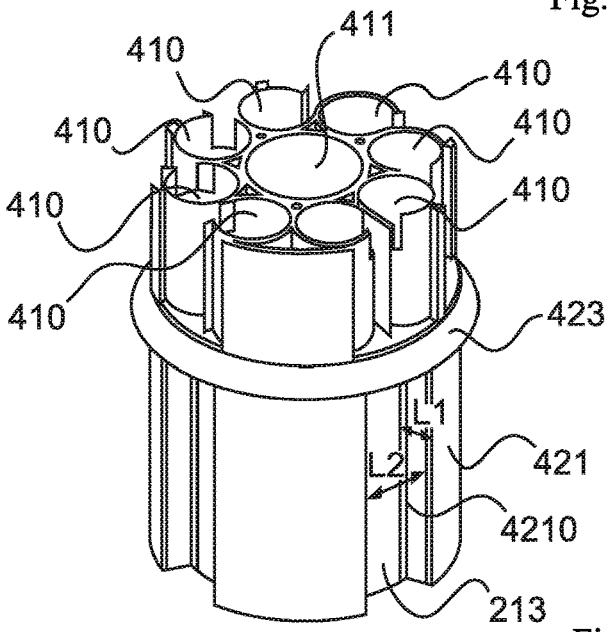
FIG. 7 is a schematic view showing a cyclone separating device and a device housing in FIG. 5, in which the device housing and the cyclone separating device are in one piece.
Figure 8:
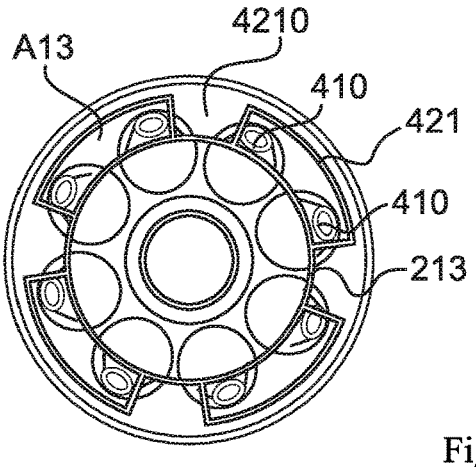
FIG. 8 is a bottom view of the device housing and the cyclone separating device shown in FIG. 7.

In some specific examples of the present disclosure, referring to FIGS. 3, 4 and 7, the first cyclone separating member 41 includes a plurality of cyclones 410 surrounding the device housing 2, and each cyclone 410 defines one cyclone air passage A10, such that the dusty air entering the dedusting chamber A1 may respectively enter the plurality of cyclones 410 to undergo independent dust and air separations in the cyclone manner, thereby improving the dust and air separation effect and the dust suction effect of the handheld cleaner 1000.

Preferably, as shown in FIGS. 3, 4 and 7, the cyclone 410 may have an upright tube shape, a side wall of the cyclone 410 may be opened to form an air inlet that extends along a tangential direction of the cyclone 410, a top end of the cyclone 410 may be opened to form an air outlet, a bottom end of the cyclone 410 may be opened to form a dust outlet, and the top ends of the cyclones 410 may abut against a bottom wall of the inner cover 121 and be fitted over the plurality of extension segments 1211 in one-to-one correspondence. That is, the plurality of extension segments 1211 extend into the plurality of cyclones 410 in one-to-one correspondence.

Therefore, referring to FIGS. 4 and 9, the dusty air entering the cyclone 410 from the air inlet may flow in a cyclone manner to separate dust from air, the separated dust may be exhausted from the dust outlet at the bottom end of the cyclone 410 and deposited at the bottom of the dedusting chamber A1 (for example, deposited in a secondary dust accumulating chamber A13 described hereinafter and defined between a second tube segment 213 of the device housing 2 and a separating tube portion 421 of the second cyclone separating member 42), and the separated air may be exhausted from the air outlet at the top end of the cyclone 410 and flow into the communicating chamber A2 of the cleaner cover 12.

Preferably, as shown in FIGS. 3 and 4, the first cyclone separating member 41 includes a straight tube segment 411 and a tapered tube segment 412. For example, when the device housing 2 has the upright tube shape, the straight tube segment 411 is connected to a top of the tapered tube segment 412, and the tapered tube segment 412 has a cross section area decreased gradually in the up-to-down direction. Thus, the dusty air entering the cyclone 410 may undergo the dust and air separation more effectively and reliably while flowing in the cyclone 410 in the cyclone manner, thus improving the dust and air separation effect.

Preferably, as shown in FIGS. 3 and 7, the first cyclone separating member 41 and the device housing 2 are in one piece, which raises processing efficiency, spares a procedure of assembling the first cyclone separating member 41 with the device housing 2 to raise assembling efficiency, and lowers assembling difficulty due to high modularity, that is, the dust cup assembly 100 may be assembled easily after the user disassembles it for cleaning. Additionally, when the first cyclone separating member 41 and the device housing 2 are in one piece, the structural compactness of the dust cup assembly 100 may be enhanced to make the dust cup assembly 100 small and lightweight, dust capacity of the dedusting chamber A1 may be improved, and strength of the device housing 2 may be strengthened without increasing cost.

In an example shown in FIG. 7, the first cyclone separating member 41 may include the plurality of cyclones 410 integrally molded to the outer circumferential wall of the device housing 2 and surrounding the device housing 2, thus reducing the assembling difficulty more effectively, that is, the user may complete the assembling and disassembling of the dust cup assembly 100 very easily. It should be noted herein that "two components being in one piece" means two components are non-detachable, and that "two components being integrally molded" means that two components are molded simultaneously and configured as a whole non-detachable part.

Preferably, as shown in FIGS. 1 and 3, when the device housing 2 is tube-shaped, in an axial direction of the device housing 2, the negative pressure device 3 is at least partially located at a side of the first cyclone separating member 41. Thus, the negative pressure device 3 may make full use of space inside the device housing 2, while the first cyclone separating member 41 may make full use of space outside the device housing 2, thereby making the structure of the dust cup assembly 100 more compact. It should be noted herein that the first cyclone separating member 41 is not shown in FIGS. 1 and 2.

Alternatively, referring to FIG. 1, the negative pressure device 3 includes a fan 31 and a motor 32 connected successively along the axial direction of the device housing 2, and the motor 32 is spaced apart from the first cyclone separating member 41 in the axial direction of the device housing 2, that is, the motor 32 is completely located at the side of the first cyclone separating member 41, so as to make better use of space. Moreover, since the negative pressure device 3 is constituted by the fan 31 and the motor 32, such that the negative pressure device 3 has a simple structure and is convenient to obtain. Certainly, the present disclosure is not limited thereby, and the negative pressure device 3 may include other components, for example, a vacuum pump.

Referring to FIGS. 1 to 4, the device housing 2 includes a first tube segment 211, a transition tube segment 212 and a second tube segment 213, in which a maximum diameter of the first tube segment 211 is smaller than a minimum diameter of the second tube segment 213. Thus, when the device housing 2 and the casing 1 have the tube shape and coaxially disposed, and the dedusting chamber A1 is defined between the inner circumferential wall of the casing 1 and the outer circumferential wall of the device housing 2, a first portion of the dedusting chamber A1 radially opposite to the first tube segment 211 has a larger capacity than a second portion of the dedusting chamber A1 radially opposite to the second tube segment 213, and a first portion of the air exhaust chamber A3 radially opposite to the second tube segment 213 has a larger capacity than a second portion of the air exhaust chamber A3 radially opposite to the first tube segment 211.

Therefore, in a radial direction of the housing device 2, when the first cyclone separating member 41 is opposite to the first tube segment 211, or opposite to the first tube segment 211 and the transition tube segment 212, the first cyclone separating member 41 may make full use of space of the dedusting chamber A1 to improve the filtration effect on the dusty air. Meanwhile, in the radial direction of the housing device 2, when the negative pressure device 3 is opposite to the second tube segment 213, or opposite to the second tube segment 213 and the transition tube segment 212, the negative pressure device 3 may make full use of space of the air exhaust chamber A3 to improve the filtration effect on the dusty air.

Preferably, an axial length of the second tube segment 213 is greater than an axial length of the transition tube segment 212, for example, more than twice the axial length of the transition tube segment 212, but an axial length of the first tube segment 211 may be greater than or equal to the axial length of the transition tube segment 212. Thus, the first cyclone separating member 41 and the negative pressure device 3 may make better use of space, and the overall dust suction effect of the handheld cleaner 1000 may be improved.

Preferably, referring to FIG. 3, the first tube segment 211 and the second tube segment 213 both are configured as straight tube segments, and the transition tube segment 212 is a divergent tube segment, which is convenient for processing and assembling. Thus, when the first cyclone separating member 41 is integrally molded to an outer circumferential wall of the first tube segment 211 and an outer circumferential wall of the transition tube segment 212, the first cyclone separating member 41 may be naturally molded as the plurality of cyclones 410 spliced by a plurality of straight tube segments 411 and a plurality of tapered tube segments 412, which not only makes full use of the space, but also improves the dust and air separation effect.

In the example shown in FIG. 3, the housing body 21 has the upright tube shape and includes the first tube segment 211, the transition tube segment 212 and the second tube segment 213 successively in the up-to-down direction, and along this direction, a cross section area of the first tube segment 211 is equal everywhere, a cross section area of the transition tube segment 212 increases gradually, and a cross section area of the second tube segment 213 is equal everywhere. Thus, the processing is convenient, and the plurality of cyclones 410 is easy to mold.

In some embodiments of the present disclosure, the device housing 2 and the second cyclone separating member 42 are vertically disposed, and two axial ends of the second cyclone separating member 42 abut against an internal wall of the casing 1. In the examples shown in FIGS. 1 and 3, a top end the second cyclone separating member 42 abuts against a lower surface of the inner cover 121 and a bottom end thereof abuts against the inner bottom wall 110 of the casing 1.

Therefore, a primary annular-columnar dedusting chamber may be defined between an outer circumferential wall of the second cyclone separating member 42 and the inner circumferential wall of the casing 1, a secondary annular-columnar dedusting chamber may be defined between an inner circumferential wall of the second cyclone separating member 42 and the outer circumferential wall of the device housing 2, and the primary dedusting chamber surrounds the secondary dedusting chamber to defines the whole dedusting chamber together with the secondary dedusting chamber. Since the primary dedusting chamber and the secondary dedusting chamber are located outside and inside of the second cyclone separating member 42 respectively and both configured to have annular-columnar space, the layout of the dedusting chamber becomes more compact, and volumes of the primary dedusting chamber and the secondary dedusting chamber are increased to make dust and air more fully separated.

Referring to FIGS. 3 and 4, the whole primary dedusting chamber may be configured as the first-stage cyclone chamber A11, and the first cyclone separating member 41 may be disposed in the secondary dedusting chamber, i.e. between the inner circumferential wall of the second cyclone separating member 42 and the outer circumferential wall of the device housing 2, to define the second-stage cyclone chamber A12 in the secondary dedusting chamber. In such a case, rest of the secondary dedusting chamber except the second-stage cyclone chamber A12 is configured as the secondary dust accumulating chamber A13.

Preferably, referring to FIGS. 1 and 2, the second cyclone separating member 42 is vertically disposed and includes a separating tube portion 421 and a filtration tube portion 422 axially connected with the separating tube portion 421. The filtration tube portion 422 may be detachably connected to a top end of the separating tube portion 421 and define a filtration hole 4221 communicating the first-stage cyclone chamber A11 with the second-stage cyclone chamber A12. A bottom end of the separating tube portion 421 may abut against the inner bottom wall 110 of the casing 1 and a top end of the filtration tube portion 422 may abut against the lower surface of the inner cover 121. Hence, the second cyclone separating member 42 is formed by connecting a tube-shaped member having holes (i.e. the filtration tube portion 422) therein with a tube-shaped member having no hole (i.e. the separating tube portion 421) therein in series, such that the second cyclone separating member 42 has a simple structure and is convenient to process and manufacture.

Certainly, the present disclosure is not limited thereby, and the second cyclone separating member 42 may be constituted by other components, for example, by a separating tube with a plurality of notches and filter discs embedded in the plurality of notches, which will not be described in detail.

Preferably, the second cyclone separating member 42 is at least partially in one piece with the first cyclone separating member 41. That is, the second cyclone separating member 42 may be completely in one piece with the first cyclone separating member 41, or only a part of the second cyclone separating member 42 is in one piece with the first cyclone separating member 41. For example, only the separating tube portion 421 and the first cyclone separating member 41 are in one piece, while the filtration tube portion 422 and the separating tube portion 421 are detachably connected with each other. Thus, when the second cyclone separating member 42 is at least partially in one piece with the first cyclone separating member 41, the assembling and disassembling difficulty may be further lowered and the user may conveniently disassemble the dust cup assembly 100 for cleaning.

In some embodiments of the present disclosure, the dedusting device 4 is disposed in the dedusting chamber A1 and defines at least one stage of annular or columnar cyclone chamber. For example, when the dedusting device 4 includes the plurality of cyclones 410, the cyclone 410 may defines the columnar cyclone chamber, but when the dedusting device 4 includes the second cyclone separating member 42, the annular cyclone chamber may be defined between the second cyclone separating member 42 and the casing 1.

The dedusting device 4 further defines a dust collecting groove 4210 in the dedusting chamber A1 and the dust collecting groove 4210 is in communication with the cyclone chamber. Thus, when the dusty air flows in the cyclone chamber in a cyclone manner, the separated dust may accumulate in the dust collecting groove 4210 rather than be rolled up again by the flowing airstream, so as to improve the dust and air separation effect effectively.

In some preferable embodiments (not shown in the drawings) of the present disclosure, the dust collecting groove 4210 is defined by the dedusting device 4, and thus is convenient to process and realize. In a specific example, the dedusting device 4 includes a continuous tube-shaped filter that has a tube shape and only has the filtration hole 4221 therein (for example, the separating tube portion 421 and the filtration tube portion 422 axially connected may make up the continuous tube-shaped filter, and the filtration hole 4221 may be formed in the filtration tube portion 422). The continuous tube-shaped filter is sleeved between the device housing 2 and the casing 1 to define the first-stage cyclone chamber A11 together with the casing 1. The dust collecting groove 4210 is formed by recessing an outer circumferential surface of the continuous tube-shaped filter inwards and communicates with the first-stage cyclone chamber A11, that is, the outer circumferential surface of the continuous tube-shaped filter has a groove recessed towards its central axis and the groove may be used as the dust collecting groove 4210.

In some other preferable embodiments of the present disclosure, the dust collecting groove 4210 is defined by the dedusting device 4 and the device housing 2 together, so as to further improve the structural compactness and save space. In a specific example, referring to FIGS. 7 and 8, the dedusting device 4 includes a split tube-shaped filter that is sleeved between the device housing 2 and the casing 1 to define the first-stage cyclone chamber A11 together with the casing 1. The split tube-shaped filter is tube-shaped, and has the filtration hole 4221 and a plurality of splits formed by recessing a first axial end face of the split tube-shaped filter to a second axial end face thereof (i.e., the split is formed in a surface of the split tube-shaped filter and extends from an axial end of the split tube-shaped filter to another axial end thereof), such that at least part of the split tube-shaped filter is split into pieces (for example, the separating tube portion 421 and the filtration tube portion 422 axially connected may make up the split tube-shaped filter, in which the filtration hole 4221 may be formed in the filtration tube portion 422 and the separating tube portion 421 may be split into pieces). An edge of each piece that forms the split is bent and extends towards the device housing 2, and abuts against the outer circumferential surface of the device housing 2. The dust collecting groove 4210 is defined by the split of the split tube-shaped filter and the outer circumferential surface of the device housing 2, and communicates with the first-stage cyclone chamber A11. Specifically, the dust collecting groove 4210 is defined by opposite bent edges of two adjacent pieces and the outer circumferential surface of the device housing 2.

Figure 10:
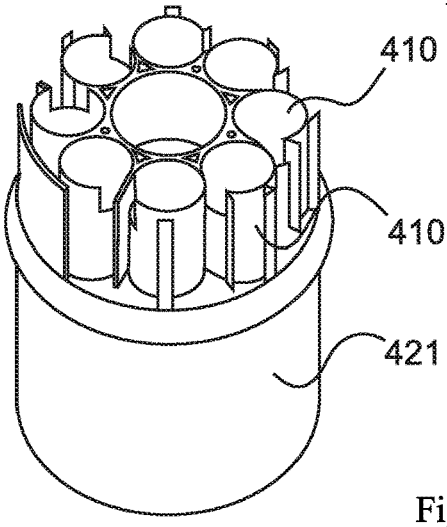
FIG. 10 is a schematic view showing a device housing and a cyclone separating device of a handheld cleaner according to another embodiment of the present disclosure, in which the device housing and the cyclone separating device are in one piece.

Certainly, the present disclosure is not limited thereby, and in other embodiments of the present disclosure, as shown in FIG. 10, the second cyclone separating member 42 may have no dust collecting groove 4210 and at this time the separating tube portion 421 may be configured to be cylindrical.

Referring to FIG. 4, preferably, the dust collecting groove 4210 extends along the axial direction of the device housing 2, and two axial ends of the dust collecting groove 4210 may be flush with two axial ends of the separating tube portion 421 respectively, that is, upper and lower ends of the dust collecting groove 4210 are flush with upper and lower ends of the separating tube portion 421 respectively, which may further improve the dust and air separation effect. Certainly, the present disclosure is not limited thereby, and the two axial ends of the dust collecting groove 4210 may not be flush with the two axial ends of the separating tube portion 421, in which case an axial length of the dust collecting groove 4210 is smaller than an axial length of the separating tube portion 421.

Preferably, referring to FIG. 7, a plurality of dust collecting grooves 4210 are provided and spaced apart from one another in the circumferential direction of the device housing 2, for example, three to eight dust collecting grooves 4210 being provided, so as to further improve the dust and air separation effect. Preferably, a depth L1 of the dust collecting groove 4210 in a radial direction of the first-stage cyclone separating member ranges from 8 mm to 25 mm, thus improving the dust and air separation effect. Preferably, a width L2 of the dust collecting groove 4210 in a circumferential direction of the first-stage cyclone separating member ranges from 15 mm to 35 mm, thus improving the dust and air separation effect.

Further, referring to FIG. 7, the second cyclone separating member 42 further includes an eaves ring portion 423, and the eaves ring portion 423 has an inner ring wall connected between the separating tube portion 421 and the filtration tube portion 422, and an outer ring wall obliquely extending away from an outer circumferential surface of the separating tube portion 421 along a direction from the filtration tube portion 422 to the separating tube portion 421. Therefore, referring to FIGS. 2 and 4, the dusty air entering the first-stage cyclone chamber A11 may undergo the dust and air separation better under guidance of the eaves ring portion 423. Moreover, the separated air may enter the second-stage cyclone chamber A12 more smoothly through the filtration tube portion 422. Furthermore, the separated dust can hardly cross the eaves ring portion 423 to enter the second-stage cyclone chamber A12 through the filtration tube portion 422, thus improving the dust and air separation effect.

Figure 5:
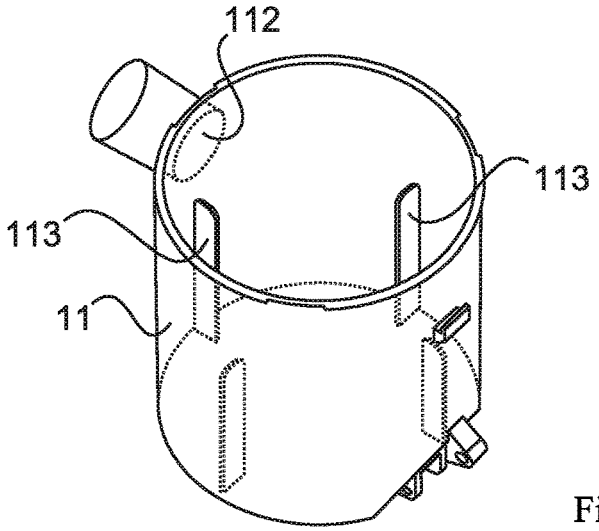
FIG. 5 is a schematic view of a part of a casing shown in FIG. 4.

In an embodiment of the present disclosure, referring to FIGS. 3 and 5, when the casing 1 is tube-shaped, the inner circumferential wall of the casing 1 (i.e. a part of the whole inner surface of the casing 1 that is not run through by its axis) is provided with a first dust-blocking sheet 113 extending towards an interior of the casing 1. Thus, when the dust moves in the first-stage cyclone chamber A11 in a cyclone manner, the dust may be blocked by the first dust-blocking sheet 113 rather than be rolled up repeatedly by the airstream to obstruct the filtration hole 4221 or enter the second-stage cyclone chamber A12, thus improving the dust and air separation effect.

Preferably, the first dust-blocking sheet 113 extends along an axial direction of the casing 1. Therefore, when the casing 1 is vertically disposed, the blocked dust may flow downwards along the first dust-blocking sheet 113 to the bottom of the casing 1 to prevent the dust from being rolled up repeatedly to obstruct the filtration hole 4221 or enter the second-stage cyclone chamber A12, so as to further improve the dust and air separation effect. Preferably, a plurality of first dust-blocking sheets 113 are provided and spaced apart from one another in a circumferential direction of the casing 1. Thus, in the whole circumferential direction of the casing 1, the first dust-blocking sheets 113 may serve to block the dust effectively, so as to further improve the dust and air separation effect.

Figure 6:
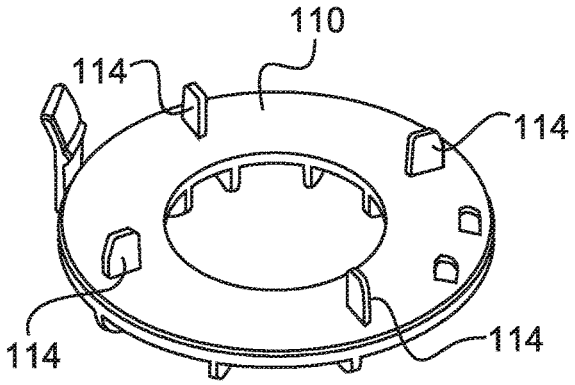
FIG. 6 is a schematic view of a rest part of the casing shown in FIG. 4.

In an embodiment of the present disclosure, referring to FIGS. 1 and 6, the casing 1 is tube-shaped, and an inner end wall of the casing 1 (i.e. one of two surfaces in the whole inner surface of the casing 1 that are run through by its axis) is provided with a second dust-blocking sheet 114 extending towards the interior of the casing 1. For example, when the casing 1 is vertically disposed, the second dust-blocking sheet 114 may extend upwards from the inner bottom wall 110 of the casing 1. Thus, when the dust moves in the first-stage cyclone chamber A11 in a cyclone manner, the dust may be blocked by the second dust-blocking sheet 114 rather than be rolled up repeatedly by the airstream to obstruct the filtration hole 4221 or enter the second-stage cyclone chamber A12, thus improving the dust and air separation effect.

Preferably, the second dust-blocking sheet 114 extends along a radial direction of the casing 1. Therefore, in the whole radial direction of the casing 1, the second dust-blocking sheet 114 may serve to block the dust effectively, so as to further improve the dust and air separation effect. Preferably, a plurality of second dust-blocking sheets 114 are provided and spaced apart from one another in the circumferential direction of the casing 1. Thus, in the whole circumferential direction of the casing 1, the second dust-blocking sheets 114 may serve to block the dust effectively, so as to further improve the dust and air separation effect.

A working principle of the dust cup assembly 100 according to an embodiment of the present disclosure will be described with reference to the drawings.

Figure 9:
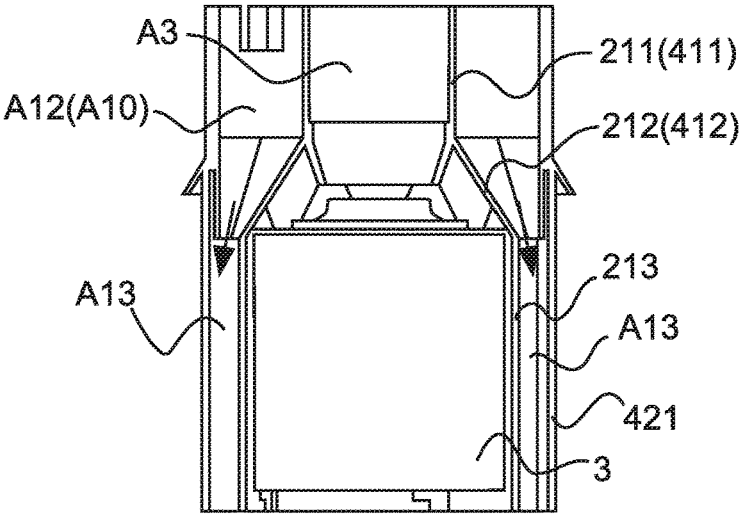
FIG. 9 is a sectional view of the device housing and the cyclone separating device shown in FIG. 7.

Referring to FIG. 2, in combination with FIGS. 4 and 9, the dusty air enters the first-stage cyclone chamber A11 from the dust suction inlet 112 along a tangential direction to undergo the cyclone dust and air separation. In this process, part of the separated dust enters and accumulates in the dust collecting groove 4210, rest of the separated dust falls down and accumulates at the bottom of the first-stage cyclone chamber A11, and the separated airstream enters the second-stage cyclone chamber A12 from the filtration hole 4221 in a tangential direction to undergo the cyclone dust and air separation. In this process, the separated dust falls down and accumulates in the secondary dust accumulating chamber A13, the separated airstream enters the communicating chamber A2 through the inflow communication hole 12110 and is filtered by the in-cover filter 1221, and the filtered airstream enters the air exhaust chamber A3 through the outflow communication hole 12120 and is exhausted from the air exhaust port 220 and the opening 111 after being filtered by the in-housing filter 25.

The handle assembly 200 according to some embodiments of the present disclosure will be described with reference to FIG. 1.

Specifically, the holding assembly has a user-friendly handheld feature, and may be, for example, a lift handle or a handle assembly 200. When the holding assembly is configured as the handle assembly 200, the user may control orientation of the dust cup assembly 100 conveniently. For example, it is convenient for the user to make the dust suction inlet 112 of the dust cup assembly 100 face upwards or downwards, so as to facilitate dust suction. Only the handle assembly 200 used as the holding assembly will be taken as an example for explanation in the following. Additionally, it should be noted that the structure of the lift handle is well known to those skilled in the art and hence will not be described in detail.

As shown in FIG. 1, the handle assembly 200 includes a handle casing 51 and a power supply device 52. The handle casing 51 includes a holding portion 512 for user handholding, and the power supply device 52 may be disposed in the holding portion 512, or may be disposed at a position in the handle casing 51 opposite to the holding portion 512, for example in a mounting portion 511 to be described below, such that a center of gravity of the handle assembly 200 may be optimized, i.e. close to a handheld position, and hence the user may hold the handle assembly 200 more effortlessly, which improves comfort and convenience of using the handheld cleaner 1000.

The power supply device 52 may be a battery, for example, a rechargeable battery, which is easy to realize at a low cost and convenient to use.

As shown in FIG. 1, the handle casing 51 has a finger gripping portion 510, and the mounting portion 511 and the holding portion 512 located at two sides of the finger gripping portion 510. The mounting portion 511 is used to be connected with the dust cup assembly 100 and the holding portion 512 is used for holding by hand. The power supply device 52 is disposed in the mounting portion 511 and/or in the holding portion 512. Thus, the handle casing 51 has a simple structure and is convenient to process and manufacture. Alternatively, the finger gripping portion 510 is a gripping hole to be penetrated through and gripped by fingers, the handle casing 51 is an annular housing, and the gripping hole is defined by an inner ring of the handle casing 51. Thus, it is convenient for holding, and the power supply device 52 may be mounted conveniently.

Preferably, the power supply device 52 is mounted in the mounting portion 511 and has a same length direction as the mounting portion 511. Thus, the power supply device 52 makes full use of space in the mounting portion 511 to make the handle assembly 200 miniaturized and allow the user to hold the handle assembly 200 with less effort.

Preferably, the power supply device 52 is mounted in the holding portion 512 and has a same length direction as the holding portion 512. Thus, the power supply device 52 makes full use of space in the holding portion 512 to make the handle assembly 200 miniaturized and allow the user to hold the handle assembly 200 with less effort.

Preferably, the dust cup assembly 100 is tube-shaped, the length direction of the mounting portion 511 is identical to an axial direction of the dust cup assembly 100, and the mounting portion 511 is connected to a radial side of the handle assembly 200, so as to increase a connection area between the mounting portion 511 and the dust cup assembly 100, enhance connection reliability between the handle assembly 200 and the dust cup assembly 100, and save effort for holding. Alternatively, the mounting portion 511 is detachably connected to the dust cup assembly 100. That is, the handle assembly 200 is detachably connected to the dust cup assembly 100, and thus it is convenient for mounting, dismounting, cleaning and replacement.

Further, as shown in FIG. 1, the handle casing 51 further includes a handle top 513 and a handle bottom 514 connected between the mounting portion 511 and the holding portion 512 and arranged opposite to each other. That is, the mounting portion 511, the handle top 513, the holding portion 512 and the handle bottom 514 are successively connected end to end to form the handle casing 51, such that the structure of the handle casing 51 has high reliability.

Certainly, the present disclosure is not limited thereby. The handle casing 51 may not be annular, i.e. not include the handle top 513 and the handle bottom 514. Instead, the handle casing 51 may be I-shaped and constituted by the mounting portion 511 and the holding portion 512 arranged opposite to each other, and a bridging portion connected between the mounting portion 511 and the holding portion 512, and this example is not shown in the drawings.

Preferably, an electric control board 53 connected with the power supply device 52 may be provided in the handle top 513, the electric control board 53 connected with the power supply device 52 may be provided in the handle bottom 514, or the electric control board 53 connected with the power supply device 52 may be provided in each of the handle top 513 and the handle bottom 514 simultaneously. Thus, space in the handle casing 51 may be fully utilized.

Figure 16:
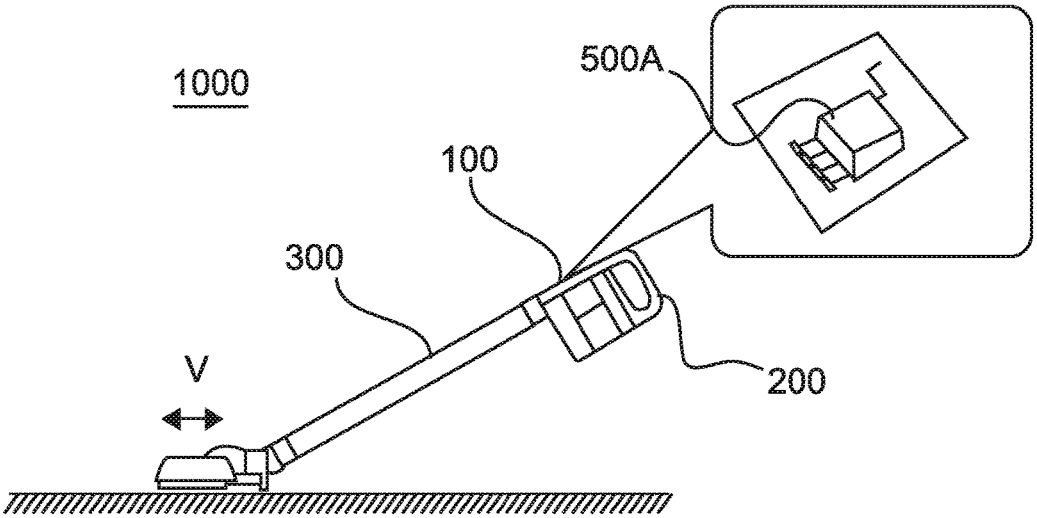
FIG. 16 is a working state diagram of a handheld cleaner according to an embodiment of the present disclosure, in which a detection device is exploded.
Figure 17:
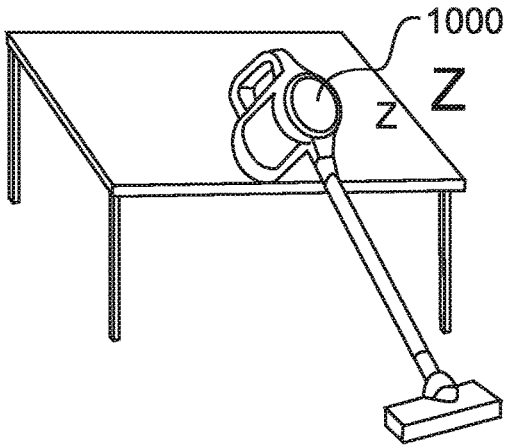
FIG. 17 is another working state diagram of a handheld cleaner according to the embodiment of the present disclosure.
Figure 18:
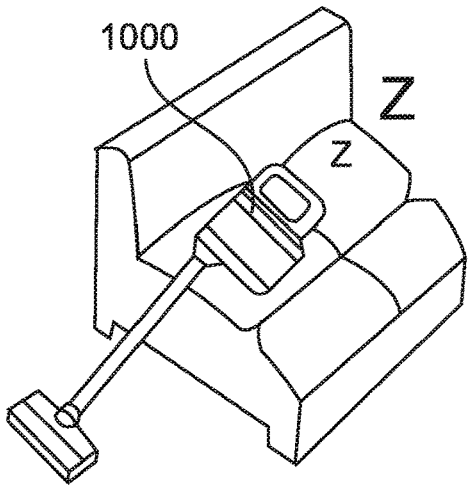
FIG. 18 is another working state diagram of a handheld cleaner according to the embodiment of the present disclosure.

The handheld cleaner 1000 according to some embodiments of the present disclosure will be described with reference to FIGS. 16 to 18, in combination with FIGS. 1 to 10.

As shown in the drawings, the handheld cleaner 1000 according to the embodiments of the present disclosure includes a casing 1, the negative pressure device 3, a first detection device 500A and a control device.

The casing 1 may have an air intake passage that refers to a passage through which the dusty air in the environment flows after entering the casing 1 but before being filtered. The negative pressure device 3 is disposed in the casing 1 and used to make the dusty air outside the casing 1 enter the air intake passage. For example, in a specific example of the present disclosure, the casing 1 may include the casing 1 and the handle casing 51 in this description, the casing 1 has the dust suction inlet 112, and an inner hole of the dust suction inlet 112 defines the air intake passage. The negative pressure device 3 may include the fan 31 and the motor 323 connected with the fan 31, and suction strength of the negative pressure device 3 depends on an operating power of the motor 32. That is, the higher the operating power of the motor 32 is, the faster the fan 31 rotates and the greater the suction strength of the negative pressure device 3 is; the lower the operating power of the motor 32 is, the more slowly the fan 31 rotates and the smaller the suction strength of the negative pressure device 3 is.

The first detection device 500A is disposed to the casing 1 and used to detect a motion state of the casing 1, i.e. to detect whether the casing 1 is moving and how fast the casing 1 moves. For example, the first detection device 500A may be an acceleration sensor or a speed sensor. The control device is connected with the first detection device 500A and the negative pressure device 3. For example, the control device may be a printed circuit board (PCB) of the handheld cleaner 1000, and configured to control a working state of the handheld cleaner 1000 according to information detected by the first detection device 500A, for example, controlling the handheld cleaner 1000 to switch to a turn-on state, a turn-off state, a standby state, a high-suction state and a lower-suction state to be described below.

Therefore, the handheld cleaner 1000 according to the embodiments of the present disclosure may switch to a corresponding working state automatically and intelligently according to a change of its motion state, so as to achieve the dust suction effect and an energy saving effect simultaneously.

In some specific examples of the present disclosure, the control device may be configured to control the negative pressure device 3 to increase the suction strength if the first detection device 500A detects that a motion speed of the casing 1 rises. That is, when the first detection device 500A detects that the user moves the handheld cleaner 1000 faster, i.e., with an increasing speed, the control device increases the suction strength of the negative pressure device 3 to guarantee the dust suction effect.

In some specific examples of the present disclosure, the control device may be configured to control the negative pressure device 3 to decrease the suction strength if the first detection device 500A detects that the motion speed of the casing 1 drops. That is, when the first detection device 500A detects that the user moves the handheld cleaner 1000 more slowly, i.e., with a decreasing speed, the control device decreases the suction strength of the negative pressure device 3 to reduce the energy consumption.

In some specific examples of the present disclosure, the control device may be configured to control the negative pressure device 3 to operate with a first suction strength if the first detection device 500A detects that the motion speed of the casing 1 is higher than a first predetermined value, and control the negative pressure device 3 to operate with a second suction strength if the first detection device 500A detects that the motion speed of the casing 1 is lower than a second predetermined value, in which the first predetermined value is greater than or equal to the second predetermined value, and the first suction strength is greater than or equal to the second suction strength. That is, when the first detection device 500A detects that the motion speed of the handheld cleaner 1000 is relatively great, the handheld cleaner 1000 may switch to the high-suction state automatically and intelligently; and when the first detection device 500A detects that the motion speed of the handheld cleaner 1000 is relatively small, the handheld cleaner 1000 may switch to the low-suction state automatically and intelligently.

Therefore, when the first detection device 500A detects that the user moves the handheld cleaner 1000 in a relatively high speed, the control device may control the negative pressure device 3 to suck dust with a relatively great suction strength, so as to guarantee the dust suction effect; when the first detection device 500A detects that the user moves the handheld cleaner 1000 in a relatively low speed, the control device may control the negative pressure device 3 to suck dust with a relatively small suction strength, so as to reduce the energy consumption.

In some specific examples of the present disclosure, the control device may be configured to control the negative pressure device 3 to shut down, if the first detection device 500A detects that the casing 1 has never moved in a first predetermined duration (like one second). That is, when the handheld cleaner 1000 is at the turn-on state, if the user does not move the handheld cleaner 1000 in the first predetermined duration, i.e. no displacement of the handheld cleaner 1000 is detected by the first detection device 500A, the control device controls the handheld cleaner 1000 to enter the standby state where the negative pressure device 3 stops working but the first detection device 500A keeps working. Thus, when the user puts aside the handheld cleaner 1000 temporarily to do something else, the handheld cleaner 1000 may enter the standby state automatically and intelligently, so as to save unnecessary energy consumption and make it convenient for the user to continue to use the handheld cleaner 1000.

Further, the control device may be configured to control the negative pressure device 3 to turn on, if the first detection device 500A detects displacement of the casing 1 in a second predetermined duration (like ten minutes) after a shutdown of the negative pressure device 3. That is, after the handheld cleaner 1000 enters the standby state, if the user moves the handheld cleaner 1000 in the second predetermined duration, i.e. the first detection device 500A detects displacement of the handheld cleaner 1000 in the second predetermined duration, the control device controls the handheld cleaner 1000 to enter the turn-on state where the negative pressure device 3 starts to work, the first detection device 500A keeps working, and the control device controls the working state of the handheld cleaner 1000 according to the information detected by the first detection device 500A. Therefore, when the user continues to use the handheld cleaner 1000, the handheld cleaner 1000 may turn on automatically and intelligently, which is user-friendly.

Further, the control device may be configured to control the handheld cleaner 1000 to turn off, if the first detection device 500A detects no displacement of the casing 1 in the second predetermined duration (like ten minutes) after the shutdown of the negative pressure device 3. That is, after the handheld cleaner 1000 enters the standby state, if the user does not move the handheld cleaner 1000 in the second predetermined duration, i.e. no displacement of the handheld cleaner 1000 is detected by the first detection device 500A, the control device controls the handheld cleaner 1000 to enter the turn-off state where the negative pressure device 3 stops working, the first detection device 500A stops working, and the control device no longer controls the working state of the handheld cleaner 1000 according to the information detected by the first detection device 500A. Therefore, when the user leaves the handheld cleaner 1000 and forgets to turn it off, the handheld cleaner 1000 may turn off automatically and intelligently, thus saving the unnecessary energy consumption.

It should be noted herein that the first predetermined value and the second predetermined value may be set according to practical requirements, for example, preset by a designer before the handheld cleaner 1000 leaves the factory, or set and adjusted by the user after the handheld cleaner 1000 leaves the factory. Meanwhile, the first suction strength and the second suction strength may be set according to practical requirements, for example, preset by the designer before the handheld cleaner 1000 leaves the factory, or set and adjusted by the user after the handheld cleaner 1000 leaves the factory.

It should be noted herein that the first predetermined duration and the second predetermined duration may be set according to practical requirements, for example, preset by a designer before the handheld cleaner 1000 leaves the factory, or set and adjusted by the user after the handheld cleaner 1000 leaves the factory.

It should be noted herein that "the turn-on state" means that the handheld cleaner 1000 may conduct dust suction and switch to a corresponding working state by detecting the motion state thereof; "the standby state" means that the handheld cleaner 1000 cannot conduct dust suction; and "the turn-off state" means that the handheld cleaner 1000 can neither conduct dust suction nor switch to the corresponding working state by detecting the motion state thereof.

In some embodiments of the present disclosure, the handheld cleaner 1000 includes a control key connected with the control device. The control key is configured to control the control device to start controlling the working state of the handheld cleaner 1000 according to the information detected by the first detection device 500A after being trigged by an odd number of times (like the first time, the third time, the fifth time, etc.), and configured to control the control device to stop controlling the working state of the handheld cleaner 1000 according to the information detected by the first detection device 500A after being trigged by an even number of times (like the second time, the fourth time, the sixth time, etc.). The control key may be disposed to the casing 1 or other positions, for example, being configured as a virtual key of a phone application.

That is, only after the user triggers the control key by the odd number of times, can the control device start controlling the working state of the handheld cleaner 1000 according to the information detected by the first detection device 500A, i.e. entering an energy-saving mode. Before the user triggers the control key or when the user triggers the control key by the even number of times, the control device will not control the working state of the handheld cleaner 1000 according to the information detected by the first detection device 500A, i.e. stopping the energy-saving mode, even if the first detection device 500A performs the detection. Thus, the user is offered more options and enjoys using the handheld cleaner 1000. Moreover, the switching between entering the energy-saving mode and stopping the energy-saving mode can be realized by triggering one control key different times, which saves space occupied by the control key and improves simplicity.

In some other embodiments of the present disclosure, the handheld cleaner 1000 further includes a turn-on control key and a turn-off control key. The turn-on control key is connected with the control device and configured to control the control device to start controlling the working state of the handheld cleaner 1000 according to the information detected by the first detection device 500A after being trigged. The turn-off control key is connected with the control device and configured to control the control device to stop controlling the working state of the handheld cleaner 1000 according to the information detected by the first detection device 500A after being trigged. The turn-on control key and the turn-off control key may be disposed to the casing 1 and other positions, for example, be configured as virtual keys of a phone application.

That is, only after the user triggers the turn-on control key, can the control device start controlling the working state of the handheld cleaner 1000 according to the information detected by the first detection device 500A, i.e. entering the energy-saving mode. After the user triggers the turn-off control key, the control device will not control the working state of the handheld cleaner 1000 according to the information detected by the first detection device 500A, i.e. stopping the energy-saving mode, even if the first detection device 500A performs the detection. Thus, the user is offered more options and enjoys using the handheld cleaner 1000. Moreover, the switching between entering the energy-saving mode and stopping the energy-saving mode can be realized by the turn-on control key and the turn-off control key, which improves accuracy and reliability of operations and reduces the probability of misoperations.

In conclusion, in some specific embodiments of the present disclosure, by providing the handheld cleaner 1000 with a sensor chip for detecting displacement, speed or acceleration, a main PCB may automatically control the motor 32 to work with a small power when the handheld cleaner 1000 moves at a low motion speed for cleaning, so as to reduce an output power of the handheld cleaner 1000, and the main PCB may also automatically control the motor 32 to work with a large power when the handheld cleaner 1000 moves at a high motion speed for cleaning, so as to increase the output power of the handheld cleaner 1000, thus improving dust suction capacity and efficiency and saving energy. Meanwhile, if the handheld cleaner 1000 has no displacement in a preset duration (like one second), the handheld cleaner 1000 may enter the standby state automatically; when the handheld cleaner 1000 is in the standby state, if the displacement thereof happens, the handheld cleaner 1000 may switch to the turn-on state, but if no displacement thereof happens during a certain period of time (like ten minutes), the handheld cleaner 1000 may turn off automatically, i.e. entering the turn-off state, so as to achieve the energy-saving effect. Thus, the handheld cleaner 1000 according to embodiments of the present disclosure may provide the improved dust suction efficiency and the energy-saving effect.

A method for controlling the handheld cleaner 1000 according to some extended embodiments of the present disclosure will be described in detail.

Specifically, the method may include the following steps.

First, (step A) the motion state of the handheld cleaner 1000 is detected, i.e. it is detected whether the handheld cleaner 1000 is moving and how fast the handheld cleaner 1000 moves. Then, (step B) the working state of the handheld cleaner 1000 is controlled according to the detected motion state. For example, the handheld cleaner 1000 is controlled to switch to the turn-on state, the turn-off state, the standby state, the high-suction state and the lower-suction state described above. Thus, with the method for controlling the handheld cleaner 1000 according to the embodiments of the present disclosure, it is possible to make the handheld cleaner 1000 switch to the corresponding working state by detecting the motion state of the handheld cleaner 1000, so as to combine the dust suction effect and the energy-saving effect.

It should be noted herein that step A may be realized by the first detection device 500A described above, and certainly may be realized in other manners. For example, the handheld cleaner 1000 may be provided with a GPS, and the motion state of the handheld cleaner 1000 is detected by a terminal connected with the GPS. Certainly, the present disclosure is not limited thereby, and for example, a camera device may be provided indoors to shoot the handheld cleaner 1000, and the motion state of the handheld cleaner 1000 may be detected by a terminal connected with the camera device. Step B may be realized by the control device described above, and certainly may be realized in other manners. For example, the control in step B may be realized by a remote terminal or a remote control device.

In some embodiments of the present disclosure, the method for controlling the handheld cleaner 1000 may further include: controlling the handheld cleaner 1000 to increase the suction strength when it is detected that the motion speed of the handheld cleaner 1000 rises. That is, when it is detected that the user moves the handheld cleaner 1000 faster, i.e., with an increasing speed, the handheld cleaner 1000 is controlled to increase the suction strength, so as to guarantee the dust suction effect.

In some embodiments of the present disclosure, the method for controlling the handheld cleaner 1000 may further include: controlling the handheld cleaner 1000 to decrease the suction strength when it is detected that the motion speed of the handheld cleaner 1000 drops. That is, when it is detected that the user moves the handheld cleaner 1000 more slowly, i.e., with a decreasing speed, the handheld cleaner 1000 is controlled to decrease the suction strength, so as to reduce the energy consumption.

In some embodiments of the present disclosure, the method for controlling the handheld cleaner 1000 may further include: controlling the handheld cleaner 1000 to operate with the first suction strength when it is detected that the motion speed of the handheld cleaner 1000 is higher than the first predetermined value. That is, when it is detected that the user moves the handheld cleaner 1000 at a relatively high speed, the handheld cleaner 1000 is controlled to switch to the high-suction state, and thus the handheld cleaner 1000 may suck dust with a relatively great suction strength, so as to guarantee the dust suction effect.

In some embodiments of the present disclosure, the method for controlling the handheld cleaner 1000 may further include: controlling the handheld cleaner 1000 to operate with the second suction strength when it is detected that the motion speed of the handheld cleaner 1000 is lower than the second predetermined value. That is, when it is detected that the user moves the handheld cleaner 1000 at a relatively low speed, the handheld cleaner 1000 is controlled to switch to the low-suction state, and thus the handheld cleaner 1000 may suck dust with a relatively small suction strength to reduce the energy consumption.

In some embodiments of the present disclosure, the method for controlling the handheld cleaner 1000 may further include: controlling the handheld cleaner 1000 to enter the standby state, if no displacement of the handheld cleaner 1000 is detected in the first predetermined duration (like one second), when the handheld cleaner 1000 is in the turn-on state.

That is, when the handheld cleaner 1000 is in the turn-on state, if it is detected that the user has never moved the handheld cleaner 1000 in the first predetermined duration (for example, the user puts aside the handheld cleaner 1000 to do something else), the handheld cleaner 1000 may be controlled to enter the standby state, so as to save unnecessary energy consumption and make it convenient for the user to continue to use the handheld cleaner 1000.

Further, the method for controlling the handheld cleaner 1000 may further include: controlling the handheld cleaner 1000 to enter the turn-on state, if it is detected that the handheld cleaner 1000 has a displacement in the second predetermined duration, when the handheld cleaner 1000 is in the standby state. That is, when the handheld cleaner 1000 is in the standby state, if it is detected that the user moves the handheld cleaner 1000 in the second predetermined duration (for example, the user continues to use the handheld cleaner 1000), the handheld cleaner 1000 may be controlled to enter the turn-on state again, which is user-friendly.

Further, the method for controlling the handheld cleaner 1000 may further include: controlling the handheld cleaner 1000 to enter the turn-off state, if no displacement of the handheld cleaner 1000 is detected in the second predetermined duration, when the handheld cleaner 1000 is in the standby state. That is, when the handheld cleaner 1000 is in the standby state, if it is detected that the user has never moved the handheld cleaner 1000 in the second predetermined duration (for example, the user leaves the handheld cleaner 1000 and forgets to turn it off), the handheld cleaner 1000 may be controlled to enter the turn-off state, so as to save the unnecessary energy consumption.

In some embodiments of the present disclosure, the method for controlling the handheld cleaner 1000 may further include: receiving an instruction of turning on the energy-saving mode, and starting to control the working state of the handheld cleaner 1000 according to the detected motion state thereof after receiving the instruction. That is, only after the instruction of turning on the energy-saving mode is received, can the working state of the handheld cleaner 1000 be controlled according to the detected information, i.e. entering the energy-saving mode. Thus, the user may be offered more options and enjoy using the handheld cleaner 1000.

In some embodiments of the present disclosure, the method for controlling the handheld cleaner 1000 may further include: receiving an instruction of turning off the energy-saving mode, and stopping controlling the working state of the handheld cleaner 1000 according to the detected motion state thereof after receiving the instruction. That is, after the instruction of turning off the energy-saving mode is received, the handheld cleaner 1000 cannot be controlled to switch the working state thereof, i.e. cannot enter the energy-saving mode, even if the information is detected. Thus, actual requirements of the user may be satisfied better.

In some specific examples of the present disclosure, reception of the instruction of turning on the energy-saving mode and reception of the instruction of turning off the energy-saving mode may be integrated into one key, for example, into the control key described above. When the control key is triggered by the odd number of times (like the first time, the third time, the fifth time, etc.), the instruction of turning on the energy-saving mode is received to make the handheld cleaner 1000 enter the energy-saving mode; when the control key is triggered by the even number of times (like the second time, the fourth time, the sixth time, etc.), the instruction of turning off the energy-saving mode is received to make the handheld cleaner 1000 stop the energy-saving mode.

In some specific examples of the present disclosure, the reception of the instruction of turning on the energy-saving mode and the reception of the instruction of turning off the energy-saving mode may be integrated into two keys respectively, for example into the turn-on control key and the turn-off control key described above. When the turn-on control key is triggered, the instruction of turning on the energy-saving mode is received to make the handheld cleaner 1000 enter the energy-saving mode; when the turn-off control key is triggered, the instruction of turning off the energy-saving mode is received to make the handheld cleaner 1000 stop the energy-saving mode.

Figure 19:
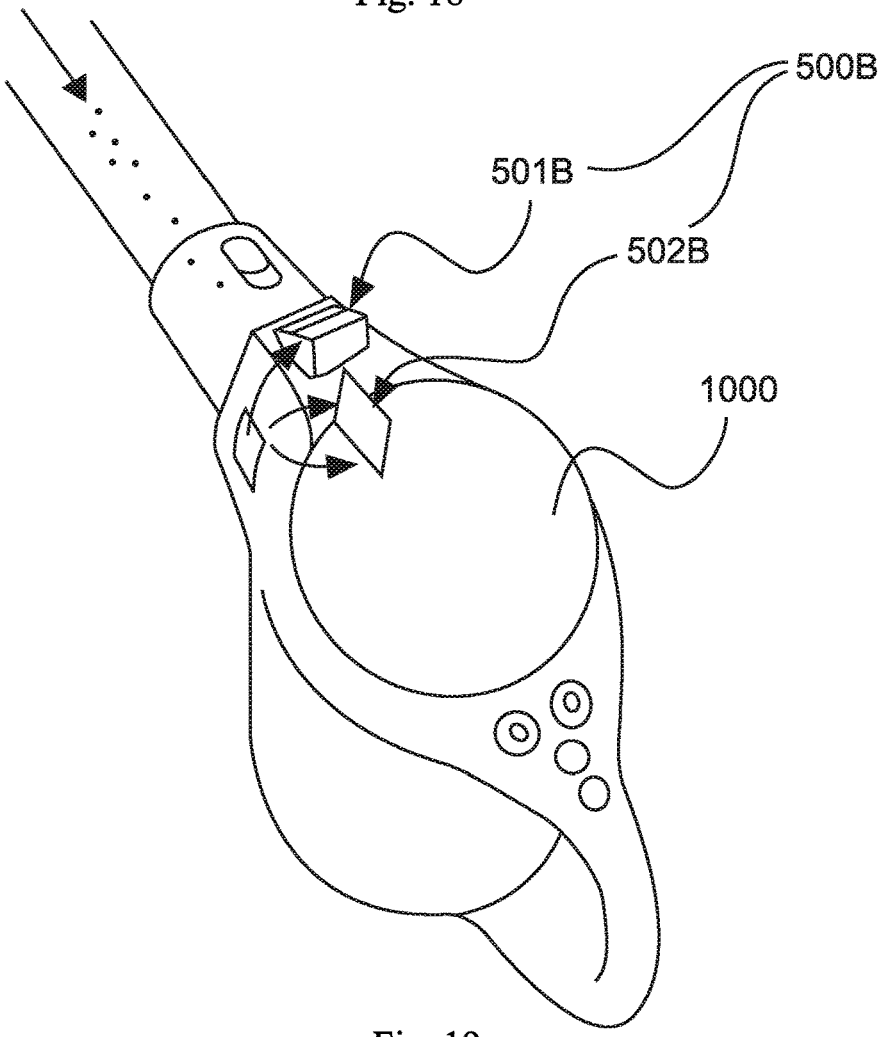
FIG. 19 is a schematic view of a handheld cleaner according to some embodiments of the present disclosure.

The handheld cleaner 1000 according to some embodiments of the present disclosure will be described with reference to FIG. 19, in combination with FIGS. 1 to 10.

As shown in the drawings, the handheld cleaner 1000 according to the embodiments of the present disclosure includes the casing 1, the negative pressure device 3, a second detection device 500B and a control device.

The casing 1 may have the air intake passage that refers to a passage through which the dusty air in the environment flows after entering the casing 1 but before being filtered. The negative pressure device 3 is disposed in the casing 1 and used to make the dusty air outside the casing 1 enter the air intake passage. For example, in a specific example of the present disclosure, the casing 1 may include the casing 1 and the handle casing 51 in this description, the casing 1 has the dust suction inlet 112, and the inner hole of the dust suction inlet 112 defines the air intake passage. The negative pressure device 3 may include the fan 31 and the motor 323 connected with the fan 31, suction strength of the negative pressure device 3 depends on an operating power of the motor 32. That is, the higher the operating power of the motor 32 is, the faster the fan 31 rotates and the greater the suction strength of the negative pressure device 3 is; the lower the operating power of the motor 32 is, the more slowly the fan 31 rotates and the smaller the suction strength of the negative pressure device 3 is.

The second detection device 500B is disposed to the casing 1 and used to detect a dust concentration in the air intake passage, in which the term "dust concentration in the air intake passage" refers to a dust concentration at a certain section of the air intake passage, or an average dust concentration in a certain segment of sections of the air intake passage, or an average dust concentration in the whole air intake passage. "The dust concentration at the certain section" refers to a ratio of an area occupied by the dust contained in the dusty air within the certain section to an area of the certain section.

In a specific example of the present disclosure, the second detection device 500B may include an emitter 501B and a receiver 502B, and the emitter 501B is disposed opposite to the receiver 502B, such that the dust entering the air intake passage may go through a space between the emitter 501B and the receiver 502B. The emitter 501B and the receiver 502B may be disposed at two sides in the air intake passage respectively, for example, disposed in the dust suction inlet 112 and located at two diametrical ends of the dust suction inlet 112 respectively.

The emitter 501B may be used to emit light to the receiver 502B, and the receiver 502B may be used to receive the light emitted by the emitter 501B. When the dusty airstream flows through the space between the emitter 501B and the receiver 502B, the dust may block some light from being received by the receiver 502B, so the amount of light received by the receiver 502B decreases. In such a way, when a large amount of dust flows through the space between the emitter 501B and the receiver 502B, i.e., the dust centration of the dusty air that flows through the space between the emitter 501B and the receiver 502B is relatively high, the amount of light received by the receiver 502B is small; when a small amount of dust flows through the space between the emitter 501B and the receiver 502B, i.e., the dust centration of the dusty air that flows through the space between the emitter 501B and the receiver 502B is relatively low, the amount of light received by the receiver 502B is large. Thus, the dust centration of the dusty air that flows through the space between the emitter 501B and the receiver 502B may be judged simply and reliably according to the amount of light received by the receiver 502B. It should be noted that structures of the emitter 501B and the receiver 502B are well known to those skilled in the art and hence will not be described in detail.

Certainly, the present disclosure is not limited thereby, and the second detection device 500B may be configured as other devices. In another specific example of the present disclosure, the second detection device 500B may be an image detection system, for example, including a camera and a data terminal. The camera may shoot a dust condition in the air intake passage, and the data terminal may obtain the dust concentration in the air intake passage through computation and analysis according to image information shot by the camera. In one more specific example of the present disclosure, the second detection device 500B may be a weight detection system, for example, including a sensitive scale and a data terminal, and the sensitive scale may be disposed at a bottom of the air intake passage to monitor a weight change in the air intake passage. Since dust is heavier than air, the weight change in the air intake passage mainly reflects a dust weight change, and then the data terminal may obtain the dust concentration in the air intake passage through computation and analysis according to weight information measured by the sensitive scale.

The control device is connected with the second detection device 500B and the negative pressure device 3. For example, the control device may be the PCB of the handheld cleaner 1000, and configured to control the working state of the handheld cleaner 1000 according to the information detected by the second detection device 500B, for example, controlling the handheld cleaner 1000 to switch to the high-suction state or the lower-suction state. Therefore, the handheld cleaner 1000 according to the embodiments of the present disclosure may switch to the corresponding working state automatically and intelligently according to changes of the dust concentration in the air intake passage, so as to achieve the dust suction effect and the energy-saving effect simultaneously.

In some specific examples of the present disclosure, the control device may be configured to control the negative pressure device 3 to increase the suction strength thereof if the second detection device 500B detects that the dust concentration rises. That is, when the second detection device 500B detects that the dust concentration in the air intake passage becomes high, the control device increases the suction strength of the negative pressure device 3 to guarantee the dust suction effect.

In some specific examples of the present disclosure, the control device may be configured to control the negative pressure device 3 to decrease the suction strength thereof if the second detection device 500B detects that the dust concentration drops. That is, when the second detection device 500B detects that the dust concentration in the air intake passage becomes low, the control device decreases the suction strength of the negative pressure device 3 to reduce the energy consumption.

In some specific examples of the present disclosure, the control device may be configured to control the negative pressure device 3 to operate with a first suction strength if the second detection device 500B detects that the dust concentration is higher than a first preset value, and control the negative pressure device 3 to operate with a second suction strength if the second detection device 500B detects that the dust concentration is lower than a second preset value, in which the first preset value is greater than or equal to the second preset value, and the first suction strength is greater than or equal to the second suction strength. That is, when the second detection device 500B detects that the dust concentration in the air intake passage is relatively high, the handheld cleaner 1000 may switch to the high-suction state automatically and intelligently; and when the second detection device 500B detects that the dust concentration in the air intake passage is relatively low, the handheld cleaner 1000 may switch to the low-suction state automatically and intelligently.

Therefore, when there is much dust on the surface to be cleaned, i.e. when the second detection device 500B detects that the dust concentration in the air intake passage is relatively high, the control device may control the negative pressure device 3 to suck dust with relatively great suction strength, so as to guarantee the dust suction effect; when there is little dust on the surface to be cleaned, i.e. when the second detection device 500B detects that the dust concentration in the air intake passage is relatively low, the control device may control the negative pressure device 3 to suck dust with relatively small suction strength, so as to reduce the energy consumption.

It should be noted herein that the first preset value and the second preset value may be set according to practical requirements, for example, preset by the designer before the handheld cleaner 1000 leaves the factory, or set and adjusted by the user after the handheld cleaner 1000 leaves the factory. Meanwhile, the first suction strength and the second suction strength may be set according to practical requirements, for example, predetermined by the designer before the handheld cleaner 1000 leaves the factory, or set and adjusted by the user after the handheld cleaner 1000 leaves the factory.

In some embodiments of the present disclosure, the handheld cleaner 1000 includes a control key connected with the control device. The control key is configured to control the control device to start controlling the working state of the handheld cleaner 1000 according to the information detected by the second detection device 500B after being trigged by an odd number of times (like the first time, the third time, the fifth time, etc.), and configured to control the control device to stop controlling the working state of the handheld cleaner 1000 according to the information detected by the second detection device 500B after being trigged by an even number of times (like the second time, the fourth time, the sixth time, etc.). The control key may be disposed to the casing 1 or other positions, for example, being configured as a virtual key of a phone application.

That is, only after the user triggers the control key by the odd number of times, can the control device start controlling the working state of the handheld cleaner 1000 according to the information detected by the second detection device 500B, i.e. entering the energy-saving mode. Before the user triggers the control key or when the user triggers the control key by the even number of times, the control device will not control the working state of the handheld cleaner 1000 according to the information detected by the second detection device 500B, i.e. stopping the energy-saving mode, even if the second detection device 500B performs the detection. Thus, the user is offered more options and enjoys using the handheld cleaner 1000. Moreover, the switching between entering the energy-saving mode and stopping the energy-saving mode can be realized by triggering one control key different times, which saves space occupied by the control key and improves simplicity.

In some other embodiments of the present disclosure, the handheld cleaner 1000 further includes a turn-on control key and a turn-off control key. The turn-on control key is connected with the control device and configured to control the control device to start controlling the working state of the handheld cleaner 1000 according to the information detected by the second detection device 500B after being trigged. The turn-off control key is connected with the control device and configured to control the control device to stop controlling the working state of the handheld cleaner 1000 according to the information detected by the second detection device 500B after being trigged. The turn-on control key and the turn-off control key may be disposed to the casing 1 and other positions, for example, being configured as virtual keys of a phone application.

That is, only after the user triggers the turn-on control key, can the control device start controlling the working state of the handheld cleaner 1000 according to the information detected by the second detection device 500B, i.e. entering the energy-saving mode; after the user triggers the turn-off control key, the control device will not control the working state of the handheld cleaner 1000 according to the information detected by the second detection device 500B, i.e. stopping the energy-saving mode, even if the second detection device 500B performs the detection. Thus, the user is offered more options and enjoys using the handheld cleaner 1000. Moreover, the switch between entering the energy-saving mode and stopping the energy-saving mode can be realized by the turn-on control key and the turn-off control key, which improves accuracy and reliability of operations and reduce the probability of misuse.

In conclusion, in the handheld cleaner 1000 according to some specific embodiments of the present disclosure, an emitting sensor and a receiving sensor are respectively provided at two sides of an air passage, through which the sucked dust passes, so that when the dust passes through the air passage between the two sensors, the sensors may perceive the amount of dust and transmit a signal indicating the amount of dust to the main PCB, and thus the main PCB adjusts the power output by the motor 32 according to the signal, thereby improving the dust suction efficiency and saving energy.

Another method for controlling the handheld cleaner 1000 according to some extended embodiments of the present disclosure will be described in detail.

Specifically, the method may include the following steps.

First, (step A) a concentration of dust sucked into the handheld cleaner 1000 is detected, i.e. the dust concentration in the air intake passage of the handheld cleaner 1000 is detected. Then, (step B) the working state of the handheld cleaner 1000 is controlled according to the detected dust concentration. For example, the handheld cleaner 1000 is controlled to switch to the high-suction state or the low-suction state described above. Thus, according to the method for controlling the handheld cleaner 1000 according to the embodiments of the present disclosure, it is possible to make the handheld cleaner 1000 switch to the corresponding working state according to changes of the dust concentration in the air intake passage, so as to combine the dust suction effect and the energy-saving effect.

It should be noted herein that step A may be realized by the second detection device 500B described above, and certainly may be realized in other manners. For example, the handheld cleaner 1000 may be provided with a camera device for shooting a dust condition on the surface to be cleaned, and the concentration of dust sucked into the handheld cleaner 1000 may be judged by a terminal connected with the camera device. Step B may be realized by the control device described above, and certainly may be realized in other manners. For example, the control in step B may be realized by a remote terminal or a remote control device.

In some embodiments of the present disclosure, the method for controlling the handheld cleaner 1000 may further include: controlling the handheld cleaner 1000 to increase the suction strength when it is detected that the concentration of dust sucked into the handheld cleaner 1000 rises. That is, when it is detected that the concentration of dust sucked into the handheld cleaner 1000 becomes high, the handheld cleaner 1000 is controlled to increase the suction strength, so as to guarantee the dust suction effect.

In some embodiments of the present disclosure, the method for controlling the handheld cleaner 1000 may further include: controlling the handheld cleaner 1000 to decrease the suction strength when it is detected that the concentration of dust sucked into the handheld cleaner 1000 drops. That is, when it is detected that the concentration of dust sucked into the handheld cleaner 1000 becomes low, the handheld cleaner 1000 is controlled to decrease the suction strength, so as to reduce the energy consumption.

In some embodiments of the present disclosure, the method for controlling the handheld cleaner 1000 may further include: controlling the negative pressure device 3 to operate with the first suction strength when it is detected that the dust concentration is higher than the first preset value. That is, when it is detected that the dust concentration is relatively high, i.e. there is much dust on the surface to be cleaned, the handheld cleaner 1000 is controlled to switch to the high-suction state, and thus the handheld cleaner 1000 may suck dust with a relatively great suction strength, so as to guarantee the dust suction effect.

In some embodiments of the present disclosure, the method for controlling the handheld cleaner 1000 may further include: controlling the negative pressure device 3 to operate with the second suction strength when it is detected that the dust concentration is lower than the second preset value. That is, when it is detected that the dust concentration is relatively low, i.e. there is little dust on the surface to be cleaned, the handheld cleaner 1000 is controlled to switch to the low-suction state, and thus the handheld cleaner 1000 may suck dust with a relatively small suction strength, so as to reduce the energy consumption.

In some embodiments of the present disclosure, the method for controlling the handheld cleaner 1000 may further include: receiving an instruction of turning on the energy-saving mode, and starting to control the working state of the handheld cleaner 1000 according to the detected dust concentration after receiving the instruction. That is, only after the instruction of turning on the energy-saving mode is received, can the working state of the handheld cleaner 1000 be controlled according to the detected information, i.e. entering the energy-saving mode. Thus, the user may be offered more options and enjoy using the handheld cleaner 1000.

In some embodiments of the present disclosure, the method for controlling the handheld cleaner 1000 may further include: receiving an instruction of turning off the energy-saving mode, and stopping controlling the working state of the handheld cleaner 1000 according to the detected dust concentration after receiving the instruction. That is, after the instruction of turning off the energy-saving mode is received, the handheld cleaner 1000 cannot be controlled to switch the working state, i.e. stopping the energy-saving mode, even if the information is detected. Thus, actual requirements of the user may be satisfied better.

In some specific examples of the present disclosure, reception of the instruction of turning on the energy-saving mode and reception of the instruction of turning off the energy-saving mode may be integrated into one key, for example, into the control key described above. When the control key is triggered by the odd number of times (like the first time, the third time, the fifth time, etc.), the instruction of turning on the energy-saving mode is received to make the handheld cleaner 1000 enter the energy-saving mode; when the control key is triggered by the even number of times (like the second time, the fourth time, the sixth time, etc.), the instruction of turning off the energy-saving mode is received to make the handheld cleaner 1000 stop the energy-saving mode.

In some specific examples of the present disclosure, the reception of the instruction of turning on the energy-saving mode and the reception of the instruction of turning off the energy-saving mode may be integrated into two keys, for example into the turn-on control key and the turn-off control key respectively. When the turn-on control key is triggered, the instruction of turning on the energy-saving mode is received to make the handheld cleaner 1000 enter the energy-saving mode; when the turn-off control key is triggered, the instruction of turning off the energy-saving mode is received to make the handheld cleaner 1000 stop the energy-saving mode.

In conclusion, the handheld cleaner 1000 according to some specific embodiments of the present disclosure has the following advantages.

a. The negative pressure device 3 is disposed in the casing 1, such that the dust cup assembly 100 may enjoy a compact, small and lightweight overall structure and be used with high comfort, and the air passages in the dust cup assembly 100 have a compact layout and thus result in less suction power loss and higher energy efficiency.

b. The cyclone separating device is provided in the casing 1, thus improving the cleaning effect of the handheld cleaner 1000, and when the dedusting device 4 surrounds the negative pressure device 3, the working noise of the handheld cleaner 1000 may be reduced, thus improving environmental friendliness of the handheld cleaner 1000.

c. When the negative pressure device 3 and the device housing 2 are in one piece, space may be saved effectively to further improve the structural compactness of the handheld cleaner 1000, the dust capacity may be improved, and the strength of the device housing 2 may be strengthened without increasing cost, such that the device housing 2 may protect the negative pressure device 3 better to prolong the service life of the negative pressure device 3.

d. Other components in the dust cup assembly 100, except some components in one piece, may be connected in a detachable manner, such that the dust cup assembly 100 is convenient to assemble and disassemble and also may be selectively assembled and disassembled, which facilitates targeted cleaning of internal components of the handheld cleaner 1000 and improves the cleaning effect of the handheld cleaner 1000.

e. The motor 32 and the cyclone 410 are axially spaced apart from each other, so as to make better use of the space in the casing 1 and improve the dust suction effect.

f. The air exhaust port 220 is disposed at the bottom of the dust cup assembly 100, the airstream purified by the handheld cleaner 1000 is exhausted downwards, which prevents the dust cup assembly 100 from blowing air to the user, improves the comfort of using the handheld cleaner 1000, and hence raises the user's willingness to use the handheld cleaner 1000.

g. The dust collecting groove 4210 is provided, such that the dust accumulates in dust collecting groove 4210 may be kept away from the airstream flowing in the casing 1 and hence will not be rolled up easily to block the filter or enter the next stage of cyclone chamber, and moreover, after the dust in dust collecting groove 4210 accumulates to a certain amount, dust outside the dust collecting groove 4210 may be adhered to, thereby preventing the dust from being blown up and improving the cleaning effect. Additionally, the first dust-blocking sheet 113 and the second dust-blocking sheet 114 are provided in the casing 1 to further prevent the dust from being blown repeatedly to block the filter or enter the next stage of cyclone chamber, which improves the cleaning effect.

h. The center of gravity of the handle assembly 200 is raised, such that the whole handheld cleaner 1000 may be held more effortlessly.

i. The extension pipe 300 may enlarge the whole angle range of dust suction of the handheld cleaner 1000 on one hand, and also may be detached from the dust cup assembly 100 to be used separately on the other hand.

j. The first detection device 500A is provided, such that the handheld cleaner 1000 may adjust the working state thereof automatically according to its own motion state, thus achieving the dust suction effect and the energy-saving effect simultaneously.

k. The second detection device 500B is provided, such that the handheld cleaner 1000 may adjust the working state thereof automatically according to the dust concentration, thus achieving the dust suction effect and the energy-saving effect simultaneously.

Embodiment 2

Hereinafter, a handheld cleaner w according to embodiments of the present disclosure will be described with reference to FIGS. 20 and 21.

Figure 20:
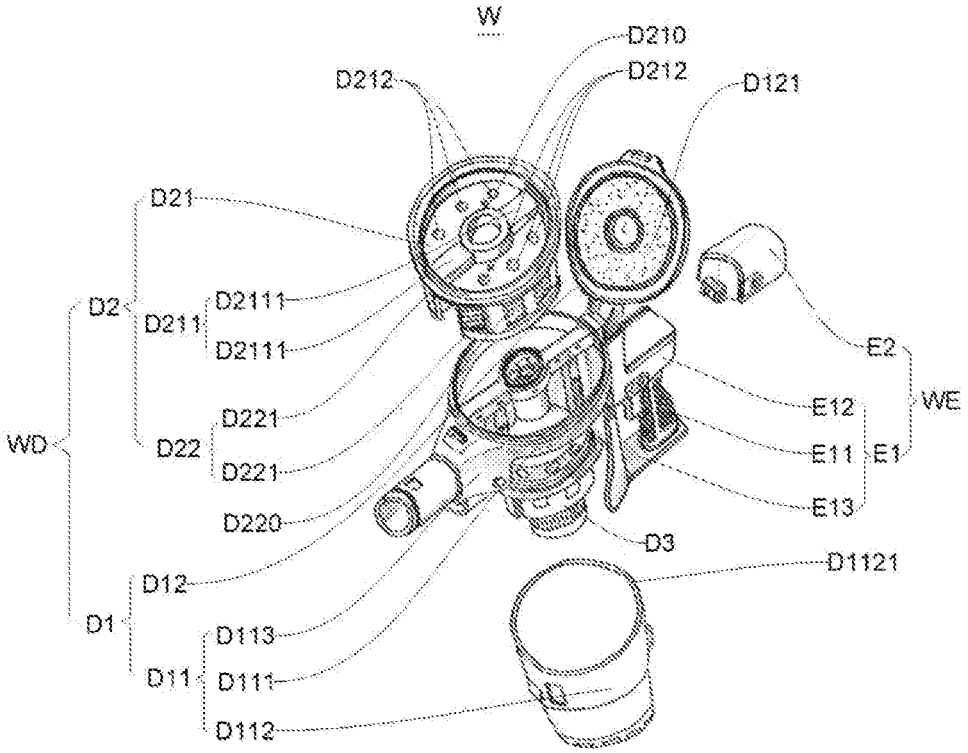
FIG. 20 is an exploded view of a handheld cleaner according to an embodiment of the present disclosure.
Figure 21:
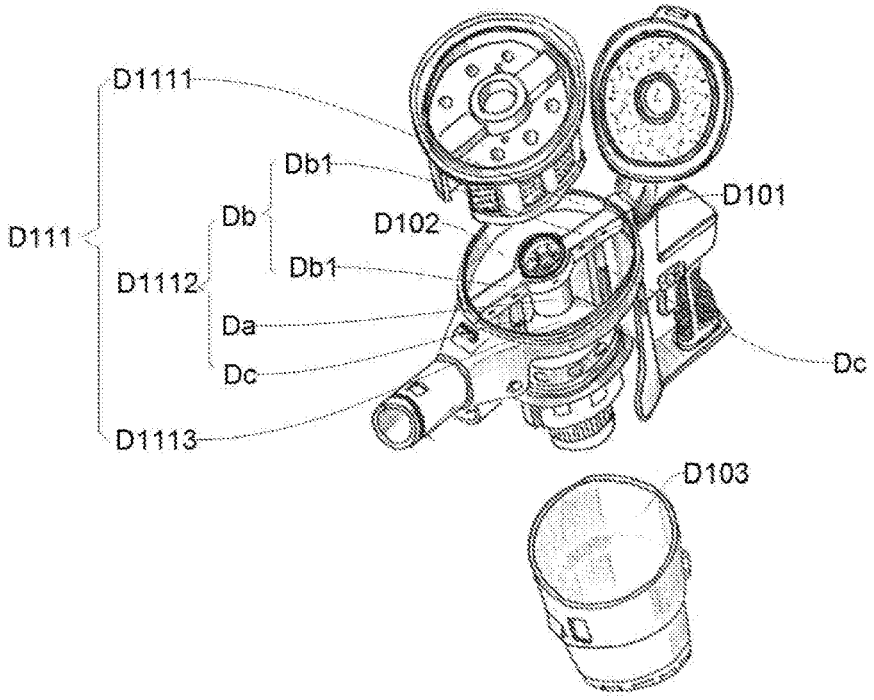
FIG. 21 is an exploded view of the handheld cleaner shown in FIG. 20, in which a power supply device is removed from the handheld cleaner.

As shown in FIGS. 20 and 21, the handheld cleaner W includes a dust cup assembly WD and a handle assembly WE, in which, the dust cup assembly WD includes a casing D1, a dedusting device D2 and a negative pressure device D3. The casing D1 may have an air suction port and an air exhaust port, the negative pressure device D3 is disposed in an interior of the casing D1 and used to suck dusty air from environment into the interior of the casing D1 via the air suction port, the dedusting device D2 is disposed in the interior of the casing D1 and used to perform dust and air separation for the airflow sucked into the casing D1. The separated airflow may be exhausted out of the casing D1 via the air exhaust port by the negative pressure device D3, and the separated dust matter may be retained in the interior of the casing D1. It should be noted herein that the handheld cleaner refer to a cleaner that a user may pick up the whole machine by handholding motion, which differs from a cleaner in the prior art that the whole machine needs to be pushed to move on a support surface.

Referring to FIGS. 20 and 21, the handle assembly WE is mounted to the dust cup assembly WD, for example, the handle assembly WE may be mounted to the casing D1 and used for handholding, that is to say, the user may pick up the dust cup assembly WD by holding the handle assembly WE so as to perform cleaning work. In addition, optionally, the handle assembly WE may include a handle casing E1 and a power supply device E2, in which, the handle casing E1 is disposed to the casing D1 and used for handholding, the power supply device E2 is mounted to the handle casing E1 and is electrically connected to the negative pressure device D3, thus, the power supply device E2 may supply power to the negative pressure device D3, furthermore, since the power supply device E2 is mounted to the handle casing E1 of the handle assembly WE and the negative pressure device D3 is mounted in the casing D1 of the dust cup assembly WD, an overall gravity center of the handheld cleaner W is optimized, such that the user may hold the handheld cleaner W more easily and effortlessly.

Hereinafter, the dust cup assembly WD according to embodiments of the present disclosure will be described with reference to FIGS. 20 and 21.

Referring to FIGS. 20 and 21, the dust cup assembly WD includes the casing D1, the negative pressure device D3 and the dedusting device D2, in which, the casing D1 includes a cup body D11 and a cleaner cover D12, an accommodating space with an open top is defined in the cup body D11, the negative pressure device D3 and the dedusting device D2 are both mounted in the accommodating space in the interior of the cup body D11 and the dedusting device D2 is located above the negative pressure device D3.

As examples shown in FIGS. 20 and 21, an air exhaust chamber D101, a dedusting chamber D102 and a dust collecting chamber D103 are provided in the cup body D11, in which, the air exhaust chamber D101 is configured to have an upright columnar shape (a cross section thereof is not limited to have regular shapes such as a circular shape, a polygonal shape, etc.), the dedusting chamber D102 (a cross section thereof is not limited to be in the shape of a closed circular ring, a closed polygonal ring, may also be an irregular ring) surrounds the air exhaust chamber D101 by one circle, the dust collecting chamber D103 is located below the dedusting device D2 and the air exhaust chamber D101, the dedusting device D2 is provided in the dedusting chamber D102, the negative pressure device D3 is provided in the dust collecting chamber D103 and in communication with the air exhaust chamber D101.

As shown in FIGS. 20 and 21, the cleaner cover D12 capable of being opened and closed is disposed on the cup body D11 to open and close the accommodating space, the dedusting device D2 is designed to be withdrawable, that is to say, the dedusting device D2 is detachably provided in the casing D1. Thus, when the handheld cleaner W needs to be cleaned, the user may open the cleaner cover D12 by himself and withdraw the dedusting device D2 located above upwardly from the interior of the casing D1, and clean it, which is convenient for the user to perform the cleaning, and improves the cleaning effect of the handheld cleaner W. Furthermore, when the user needs to perform a dust collection work using the handheld cleaner W, the user may mount the dedusting device D2 back into the cup body D11 by himself, and then cover the cleaner cover D12 on the top of the cup body D11, i.e. close the cleaner cover D12, such that the handheld cleaner W may operate normally.

Preferably, referring to FIGS. 20 and 21, a first end and a second end opposite to each other are provided on edges of the cleaner cover D12 (for example, when the cleaner cover D12 is circular, the first end and the second end are located at two sides of the cleaner cover D12 in a diameter direction thereof), the first end is articulated with the casing D1, and the second end is connected to the casing D1 by a snap connection. Thus, after the snap connection is released, the user may lift the second end of the cleaner cover D12 to open the cleaner cover D12, which is convenient for the user to open the cleaner cover D12, and avoids problems of being lost when the cleaner cover D12 is removed completely and being hard to be assembled back to the casing D1 after the cleaner cover D12 is removed completely. It should be noted herein that, the snap structure for connecting the casing D1 and the cleaner cover D12 is well known by those skilled in the art, for example, it may be a snap structure for opening a cover of a rice cooker, which will not be described in detail herein. Of course, the present disclosure is not limited thereto, the cleaner cover D12 may be designed as a structure completely withdrawable from the cup body D11, which will not be described in detail herein.

Further, as shown in FIGS. 20 and 21, a communicating chamber is provided in the cleaner cover D12, an end face at a side of the cleaner cover D12 facing towards the cup body D11 has an air inlet communicating the communicating chamber with the dedusting chamber D102 and an air outlet communicating the communicating chamber with the air exhaust chamber D101, the end face at the side of the cleaner cover D12 is provided with a filter D121 which is detachable and seals the air inlet. Thus, the airflow separated from the dedusting chamber D102 may enter the communicating chamber after passing through the filter D121 and the air inlet, and then the airflow entering the communicating chamber is exhausted into the air exhaust chamber D101 via the air outlet. Thus, the communicating chamber and the filter D121 are disposed to the cleaner cover D12, which may further improve the cleaning effect of the handheld cleaner W. Furthermore, since the cleaner cover D12 is disposed at a position that the user may take it directly and a side surface of the filter D121 used for filtrating faces outward, the user may clearly see that whether the filter D121 needs to be cleaned, and when the filter D121 needs to be cleaned, the user may easily remove the filter D121 and then mount it back after cleaning.

Further, referring to FIGS. 20 and 21, the cup body D11 includes a mounting frame D111 and a dust collecting cup D112, the dedusting device D2 is supported on a top of the mounting frame D111, the negative pressure device D3 is mounted to a bottom of the mounting frame D111. That is to say, on one hand, the mounting frame D111 may support the dedusting device D2, such that the dedusting device D2 may be taken out of the cup body D11 when the user lifts the dedusting device D2 upwardly, on the other hand, the mounting frame D111 may be used for mounting and fixing the negative pressure device D3, such that the negative pressure device D3 is located below the dedusting device D2 so as to avoid affecting the negative pressure device D3 being taken out upwardly.

As shown in FIGS. 20 and 21, the dust collecting cup D112 is a casing that at least a top thereof is opened, and covers over the negative pressure device D3, and the dust collecting cup D112 is detachably connected to the mounting frame D111. That is to say, the dust collecting cup D112 is detachably fixed together with the mounting frame D111. So that, when the user removes the dust collecting cup D112 from the mounting frame D111, the negative pressure device D3 is still mounted to the mounting frame D111 and does not move, such that the user may pour the dust in the dust collecting cup D112 and clean it, after cleaning the dust collecting cup D112, the user may fit it over the negative pressure device D3 from bottom to top and connect the dust collecting cup D112 to the mounting frame D111, thereafter, the dust collecting cup D112 may continue to collecting the dust.

Thus, with the dust cup assembly WD according to embodiments of the present disclosure, the cleaner cover D12 is openable, the dust collecting cup D112, the dedusting device D2 and the filter D121 are all detachable components, such that the user may selectively withdraw an component to be cleaned for cleaning, which is convenient for the user to use.

For example, in some optional embodiments of the present disclosure, the dust collecting cup D112 may be detachably connected to the mounting frame D111 by a button-hook structure, in which, the button-hook structure includes a hook for connecting the dust collecting cup D112 and the mounting frame D111 together, and a button for unlocking the hook, that is to say, when the button is pressed, the hook may perform a release motion, such that the dust collecting cup D112 and the mounting frame D111 are disconnected, thus the dust collecting cup D112 may be removed from the mounting frame D111. In which, specific structures and motion principles of the hook that locks two components together and the button unlocks the hook are well known by those skilled in the art, which will not be described in detail herein.

For example, in other optional embodiments of the present disclosure, the dust collecting cup D112 is detachably connected to the mounting frame D111 by an internal-external-thread structure. For example, an outer circumferential surface of a top end of the dust collecting cup D112 may have an external thread, the mounting frame D111 is annular and an inner circumferential surface thereof has an internal thread. Thus, when the dust collecting cup D112 is rotated, the external thread may be threaded into the internal thread, such that the internal thread and the external thread are in a threaded fit, thus the dust collecting cup D112 may be mounted to the mounting frame D111.

In some embodiments of the present disclosure, referring to FIGS. 20 and 21, the mounting frame D111 includes a ring D1111, a limiting and supporting portion D1112 and a fixed mounting portion D1113. A top cup ring D1121 of the dust collecting cup D112 is connected to the ring D1111 in a butt connection, that is to say, the top cup ring D1121 of the dust collecting cup D112 may be fitted over the ring D1111, the top cup ring D1121 of the dust collecting cup D112 may also be fitted in the ring D1111, a lower end of the ring D1111 may also be connected to a upper end face of the casing D1 in a butt connection, so as to achieve that the dust collecting cup D112 may be detachably connected to the ring D1111. Thus, since a shape of the ring D1111 may be easily matched to a shape of the top cup ring D1121 of the dust collecting cup D112, such that the dust collecting cup D112 may be simply mounted to the mounting frame D111, furthermore, sealing between the ring D1111 and the dust collecting cup D112 may be easily ensured, and an overall operation performance of the handheld cleaner W is ensured.

Referring to FIGS. 20 and 21, the fixed mounting portion D1113 is provided in the ring D1111, that is to say, the fixed mounting portion D1113 may be directly or indirectly fixed in the ring D1111, and the fixed mounting portion D1113 is used to fix the negative pressure device D3, that is to say, the negative pressure device D3 may be fixedly mounted to the fixed mounting portion D1113. The limiting and supporting portion D1112 is provided in the ring D1111, that is to say, the limiting and supporting portion D1112 may be directly or indirectly fixed in the ring D1111, the limiting and supporting portion D1112 is fitted with the dedusting device D2 to limit a displacement of the dedusting device D2 in directions other than an upward direction, that is to say, the limiting and supporting portion D1112 is fitted with the dedusting device D2, such that the dedusting device D2 may only be moved upward and taken out, but may not fall downward or traverse in a horizontal plane. Thus, with the limiting and supporting portion D1112, on one hand, the dedusting device D2 can be mounted to operate normally, and on the other hand, the dedusting device D2 may be conveniently taken out. It should be noted herein that the wording "provided in the ring D1111" in the present paragraph means that an axial projection of the ring D1111 is located inside an inner ring of the ring D1111.

Thus, a structure of the mounting frame D111 including the ring D1111, the limiting and supporting portion D1112 and the fixed mounting portion D1113 is simple, the one mounting frame D111 has multiple functions of mounting the dedusting device D2, the negative pressure device D3 and the dust collecting cup D112, such that the mounting frame D111 has a powerful function.

Preferably, referring to FIG. 20, the mounting frame D111 is formed in one piece, that is to say, the mounting frame D111 is one non-detachable integral component (unless it is damaged intentionally), for example, the ring D1111, the limiting and supporting portion D1112 and the fixed mounting portion D1113 may be processed into one integral component by an injection molding process. Thus, the mounting frame D111 has a simpler structure for easy production, and is more modularized for convenient assembly, furthermore, the structure of the dust cup assembly WD is more clearly and simpler, which is not easy to cause failure and has a high reliability.

In embodiments of the present disclosure, referring to FIG. 20, the cup body D11 may further include a suction nozzle D113, the suction nozzle D113 communicates an external environment of the handheld cleaner W with the interior of the dedusting chamber D102 to serve as an air suction port and to introduce the airflow from the external environment into the dedusting chamber D102. The suction nozzle D113 is fixed to the mounting frame D111, or the suction nozzle D113 and the mounting frame D111 are integrally formed (that is to say, the mounting frame D111 and the suction nozzle D113 are non-detachable unless it is damaged intentionally, i.e. the mounting frame D111 and the suction nozzle D113 are formed as one integral component). Thus, the mounting frame D111 has a powerful function and is more modularized, such that the structure of the dust cup assembly WD is more concise and clearer, which is not easy to cause failure and has a high reliability.

In addition, in embodiments of the present disclosure, referring to FIG. 20, at least part of the handle casing E1 described herein and the mounting frame D111 are also integrally formed (that is to say, the mounting frame D111 and at least part of the handle casing E1 are non-detachable unless it is damaged intentionally, i.e. the mounting frame D111 and the at least part of the handle casing E1 are formed as one integral component). Thus, the mounting frame D111 has a powerful function and is more modularized, such that the structure of the dust cup assembly WD is more concise and clearer, which is not easy to cause failure and has a high reliability.

Preferably, referring to FIG. 20, the suction nozzle D113, the at least part of the handle casing E1 and the mounting frame D111 are integrally formed (that is to say, the mounting frame D111, the at least part of the handle casing E1 and the suction nozzle D113 are non-detachable unless it is damaged intentionally, i.e. the mounting frame D111, the at least part of the handle casing E1 and the suction nozzle D113 are formed as one integral component). Thus, the mounting frame D111 has a powerful function and is more modularized, such that the structure of the dust cup assembly WD is more concise and clearer, which is not easy to cause failure and has a high reliability.

In embodiments of the present disclosure, the dedusting device D2 has a limiting hole D210 penetrating therethrough in an up-and-down direction and a support groove D211 with an open bottom, and the support groove D211 includes two support sub-grooves D2111 disposed at two radial sides of the limiting hole D210. The limiting and supporting portion D1112 includes a limiting post Da and a support beam Db, the limiting post Da is provided in the ring D1111 and fitted in the limiting hole D210 in an insertion manner, the support beam Db includes two support sub-beams Db1 disposed at two radial sides of the limiting post Da respectively, and the two support sub-beams Db1 are correspondingly provided in the two support sub-grooves D2111 and support top walls of the corresponding support sub-grooves D2111. It should be noted herein that, since the bottom of the support groove D211 is open, the support groove D211 has the top wall, and if a top wall of the support groove D211 is open, the support groove D211 may have a bottom wall.

Thus, the limiting hole D210 is fitted with the limiting post Da in an insertion manner, which effectively avoids a movement of the dedusting device D2 in a horizontal plane with respect to the mounting frame D111. The support groove D211 is supported by the support beam Db, such that the mounting frame D111 may effectively support the dedusting device D2 to prevent the dedusting device D2 from falling, and may effectively prevent the dedusting device D2 from rotating in the horizontal plane with respect to the mounting frame D111. Furthermore, structures of the dedusting device D2 and the limiting and supporting portion D1112 are simple, and may be processed and assembled conveniently, and the supporting effect and the limiting effect on the dedusting device D2 performed by the limiting and supporting portion D1112 are excellent.

It should be noted herein that, the wording "the limiting post Da is fitted in the limiting hole D210 in an insertion manner" means that shapes of the limiting post Da and the limiting hole D210 are matched to each other, after the limiting post Da is coaxially inserted into the limiting hole D210, the limiting post Da is in a clearance fit with the limiting hole D210 and the clearance is uniform. Preferably, a cross section of the limiting post Da is circular, but it is not limited thereto, the cross section of the limiting post Da may also be polygonal or irregular, in which, when the cross section of the limiting post Da is circular, a radial direction of the limiting post Da refers to a diameter direction thereof, and when the cross section of the limiting post Da is not circular, the radial direction of the limiting post Da refers to a length direction of the cross section thereof.

In one optional embodiment of the present disclosure, referring to FIGS. 20 and 21, each support sub-beam Db1 has one splicing plate Dc extending downward. The dedusting device D2 includes a split-type filtration tube D22 (the split-type filtration tube D22 refers to a filtration tube having a non-closed ring-like or an interrupted ring-like cross section) and a filtration tube cover plate D21, the split-type filtration tube D22 includes two arc filters D221 respectively disposed at two sides of the support groove D211, two splicing plates Dc are connected between side edges of the two arc filters D221 adjacent to each other so as to make up a continuous filtration tube (the continuous filtration tube refers to a filtration tube having a closed-ring-like cross section) together with the two arc-shaped filters D221, the filtration tube cover plate D21 is covered on a top of the continuous filtration tube, and the limiting hole D210 is formed in a center of the filtration tube cover plate D21 and the support groove D211 is formed in a bottom wall of the filtration tube cover plate D21. Thus, the dedusting device D2 has a simple structure, and may be assembled to the mounting frame D111 conveniently. Furthermore, by forming the continuous filtration tube, a first stage cyclone separation may be performed between an outer circumferential surface of the continuous filtration tube and the inner circumferential surface of the cup body D11, so as to obtain a good dedusting effect.

Optionally, the dedusting device D2 further includes a cyclone assembly, the cyclone assembly is provided in the split-type filtration tube D22, two cyclone assemblies are included and located at two sides of the support groove D211, each cyclone assembly is connected to the corresponding arc filter D221 and includes a plurality of cyclones arranged in a circumferential direction of the split-type filtration tube D22, the filtration tube cover plate D21 has air outlet pipes D212 correspondingly extending into each cyclone, in which, each cyclone is configured as a conical tube having a bottom tapered and a tangential inlet in a side wall thereof. Thus, the airflow separated by the first stage cyclone separation outside the continuous filtration tube may enter an interior of the continuous filtration tube via a filtration hole D220 of the arc filter D221, and then enters the plurality of cyclones to be subject to a second stage cyclone separation. The airflow separated by the second stage cyclone separation may output upward via the air outlet pipe D212, such that the dedusting effect of the dust cup assembly WD may be further improved. A plurality of air inlets of the above-described cleaner cover D12 are included and directly opposite to upper ends of the plurality of air outlet pipes D212 one to one, thus, the dedusting chamber D102 may conveniently introduce the air into the communicating chamber, which has a high efficiency for dust absorbing.

Preferably, the limiting post Da is a hollow cylinder and the air exhaust chamber D101 is defined therein, a bottom of the air exhaust chamber D101 is in communication with the negative pressure device D3, for example, the fixed mounting portion D1113 may be a cover body in a butt connection with and in communication with the limiting post Da in an up-and-down direction, and the negative pressure device D3 is disposed in the cover body. Thus, when the negative pressure device D3 is started, a negative pressure may be produced in the cover body, a negative pressure may also be produced in the limiting post Da in communication with the cover body, meanwhile, a negative pressure may also be produced in the communicating chamber in the cleaner cover 12 in communication with the air exhaust chamber D101 in the limiting post Da, a negative pressure may also be produced in the dedusting chamber D102 in communication with the communicating chamber, such that the dedusting chamber D102 may suck airflow from the outer environment via the suction nozzle D113.

Hereinafter, referring to FIGS. 20 and 21, the handle assembly WE according to embodiments of the present disclosure will be described.

Referring to FIGS. 20 and 21, the power supply device E2 is disposed to an inner top of the handle casing E1 or an outer top of the handle casing E1, for example, the power supply device E2 may be a battery assembly embedded in the handle casing, or the power supply device E2 may also be a battery pack detachably connected to the handle casing E1. Thus, by disposing the power supply device E2 to the top of the handle casing E1, an overall gravity center of the handheld cleaner W is optimized, such that the user may hold the handheld cleaner W more effortlessly.

Optionally, referring to FIGS. 20 and 21, the handle casing E1 includes an holding portion E11, and upper arm portion E12 and a lower arm portion E13, in which, the holding portion E11 is vertically provided and is spaced apart from the casing D1, the upper arm portion E12 is connected between an upper end of the holding portion E11 and the casing D1, the lower arm portion E13 is connected between a lower end of the holding portion E11 and the casing D1, in which, the power supply device E2 is provided to an inner or an outer top of the upper arm portion E12, so as to ensure that the power supply device E2 is located at the top of the handle casing E1. Thus, by providing the upper arm portion E12 and the lower arm portion E13, the holding portion E11 may be reliably mounted to the casing D1, furthermore, by providing the holding portion E11, the user may firmly grasp the handle assembly WE. Of course, the present disclosure is not limited thereto, in other embodiments of the present disclosure, the handle casing E1 may also have other shapes, for example, and the handle casing E1 may also do not include the lower arm portion E13 etc., which will not be described herein.

Preferably, referring to FIGS. 20 and 21, the upper end of the holding portion E11 is connected to a center of a bottom of the upper arm portion E12, the lower end thereof extends towards a direction far away from the casing D1, that is to say, the holding portion E11 obliquely extends towards the direction far away from the casing D1 along a direction from top to bottom, such that the user may hold the holding portion E11 more effortlessly, and the user may adjust an operation angle of the handheld cleaner W more easily. In addition, the upper end of the holding portion E11 is connected to the center of the bottom of the upper arm portion E12, such that a support reliability of the holding portion E11 may be improved and a force to the holding portion E11 is reduced. Optionally, the lower arm portion E13 obliquely extends upward in a direction from the casing D1 to the holding portion E11, thus, a grasping space for the user increases, such that the user may conveniently grasp the holding portion E11.

In one optional example of the present disclosure, referring to FIG. 20, the casing D1 has an electrical connection port, the power supply device E2 is mounted to the outer top of the upper arm portion E12 and is electrically inserted in the electrical connection port, thus, the power supply device E2 may be conveniently removed for charging. It should be understood herein that, the electrical connection port may be electrically connected to the negative pressure device D3 via a wire penetrating the handle casing E1 and the casing D1, which is not limited thereto.

Preferably, the holding portion E11 may include an inner holding casing and an outer holding casing, the upper arm portion E12 may include an upper-arm upper casing and an upper-arm lower casing, and the lower arm portion E13 may include a lower-arm lower casing and a lower-arm upper casing, in which, the inner holding casing, the upper-arm lower casing, the lower-arm upper casing and the casing D1 are formed in one piece, the outer holding casing may be detachably mounted to an outer side of the inner holding casing, the upper-arm upper casing may be detachably mounted to a top of the upper-arm lower casing, and the lower-arm lower casing may be detachably mounted to a bottom of the lower-arm upper casing.

Preferably, referring to FIGS. 20 and 21, the casing D1 has a cylindrical outer surface, the upper arm portion E12 is connected to a top end of the circumferential surface of the casing D1, and the lower arm portion E13 is connected to a bottom end of the circumferential surface of the casing D1. Thus, an overall size of the handle assembly WE may be increased, an overall gravity center of the handheld cleaner W is effectively optimized, and the user may hold the handheld cleaner W more effortlessly.

Preferably, referring to FIGS. 20 and 21, the casing D1 has a cylindrical outer surface, a center line of the holding portion E11 (i.e. a center line of the holding portion E11 extending in a length direction thereof), a center line of the upper arm portion E12 (i.e. a center line of the upper arm portion E12 extending in a length direction thereof), a center line of the lower arm portion E13 (i.e. a center line of the lower arm portion E13 extending in a length direction thereof) and an axis of the casing D1 are located in the same plane. Thus, an overall gravity center of the handheld cleaner W is effectively optimized, and the user may hold the handheld cleaner W more effortlessly.

Hereinafter, referring to FIGS. 20 and 21, a work principle of the handheld cleaner W according to embodiments of the present disclosure will be briefly described.

When the negative pressure device D3 (for example, including an electric motor and a fan) is started, the dedusting chamber D102 sucks the dusty air from the outer environment via the suction nozzle D113. After entering the cup body D11, the dusty air undergoes the first stage cyclone separation between the outer circumferential surface of the continuous filtration tube and the inner circumferential surface of the cup body D11, the dust matter separated by the first stage cyclone separation falls into the bottom of the dust collecting cup D112, and the airflow separated by the first stage cyclone separation may enter the continuous filtration tube via the filtration hole D220 of the continuous filtration tube, and enters the plurality of cyclones to undergo the second stage cyclone separation via the tangential inlet in the side wall of each cyclone. The dust matter separated by cyclone separation in the plurality of cyclones falls downward into the bottom of the dust collecting cup D112 via the outlet of the bottom of the cyclone, and the airflow separated by the second stage cyclone separation in the plurality of cyclones may flow upward, pass through the air outlet pipe D212 of the filtration tube cover plate D21 and the filter D121 and air inlet of the cleaner cover D12, and enter the communicating chamber, the airflow in the communicating chamber is discharged into the air exhaust chamber D101 via air outlet of the cleaner cover D12, and finally the airflow flows through the negative pressure device D3 and is discharged via the air exhaust port of the casing D1.

Hereinafter, beneficial effects of the handheld cleaner W according to embodiments of the present disclosure will be briefly described.

1. As to a handheld cleaner in the related art, a power supply device and a negative pressure device are both provided in the handle, and the power supply device is generally disposed to a bottom of the handle, such that the handle has a large volume and weight, which is not only inconvenient but also laborious for handholding with little comfort.

However, with the handheld cleaner W according to embodiments of the present disclosure, the power supply device E2 is disposed to the top of handle casing E1, meanwhile, the negative pressure device D3 is provided in the dust collecting cup D112, such that a distribution of the center of gravity of the handheld cleaner W is effectively improved, i.e. a position of the center of overall gravity of the handheld cleaner W is balanced, the comfort of the user holding the handheld cleaner W is improved, such that the user may use the handheld cleaner W more effortlessly and easily, improving the user experience.

2. As to the handheld cleaner in the related art, a dedusting device is fixed inside the cleaner body, the user may not remove the dedusting device by himself to clean it, thus, the residual dust in the dedusting device easily causes bacterial growth, resulting in stink, and further causes a secondary pollution for the next use, which reduces the overall cleaning effect.

However, with the handheld cleaner W according to embodiments of the present disclosure, since the cleaner cover D12 may be conveniently opened, and the dedusting device D2 may be taken out of the interior of the dust collecting cup D112, such that the user may clean the dedusting device D2 conveniently, which avoids residual dust in the casing D1, avoids problems of growth of bacteria, generation of stink, etc., and improves the overall cleaning effect of the handheld cleaner W.

Embodiment 3

Hereinafter, a handheld cleaner V according to an embodiment of the present disclosure will be described with reference to FIGS. 22 to 33.

Figure 22:
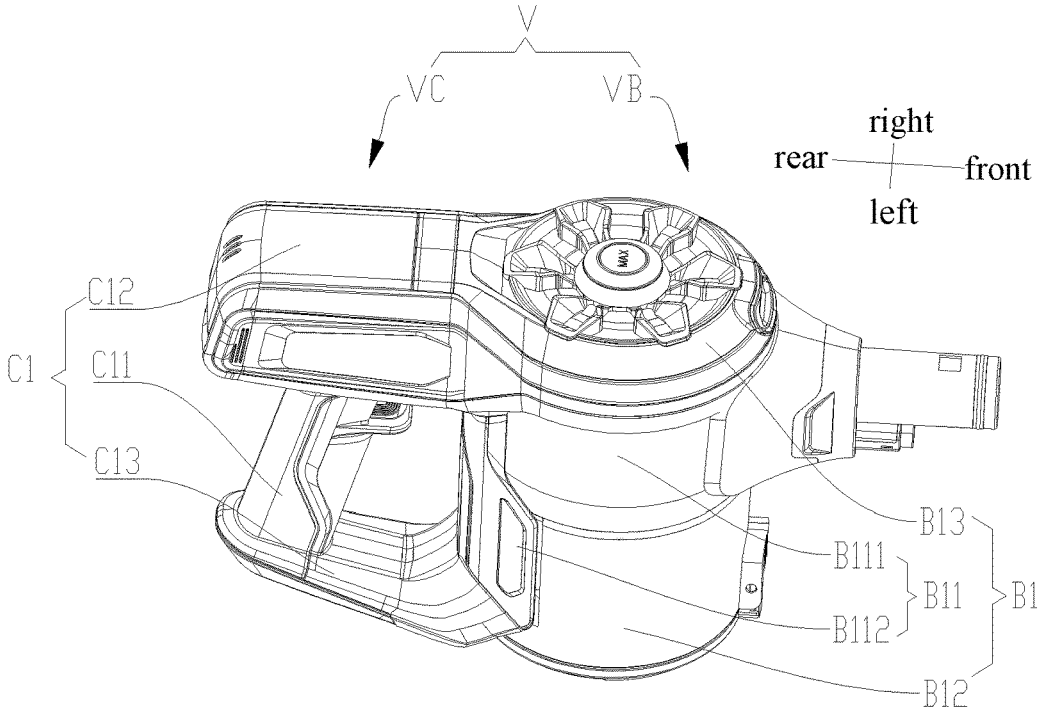
FIG. 22 is a perspective view of a handheld cleaner according to an embodiment of the present disclosure.
Figure 28:
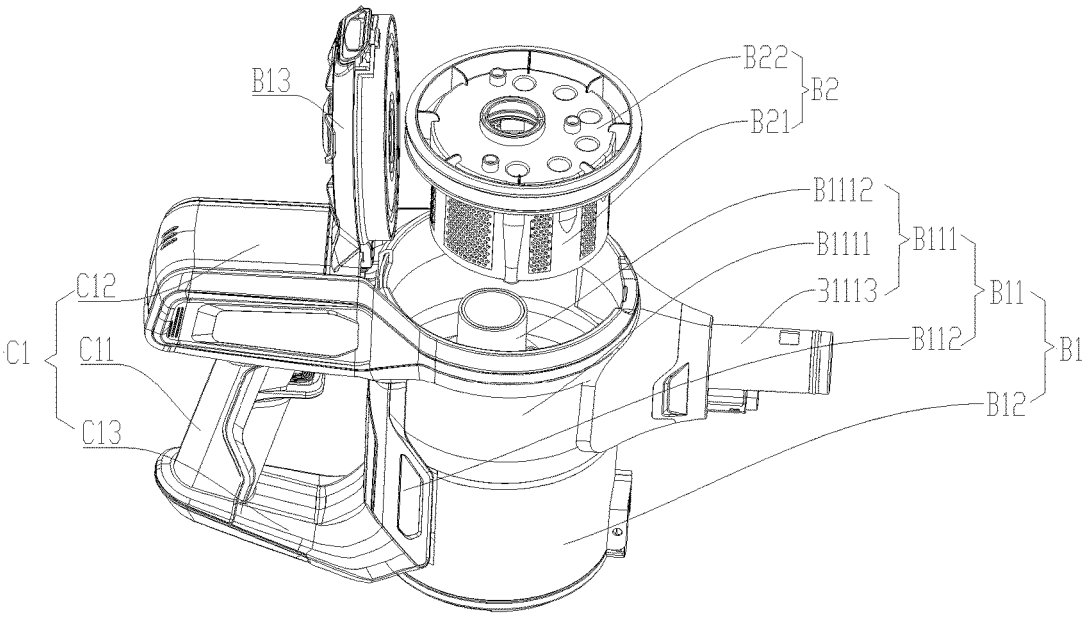
FIG. 28 is a partially exploded view of the handheld cleaner shown in FIG. 23.
Figure 30:
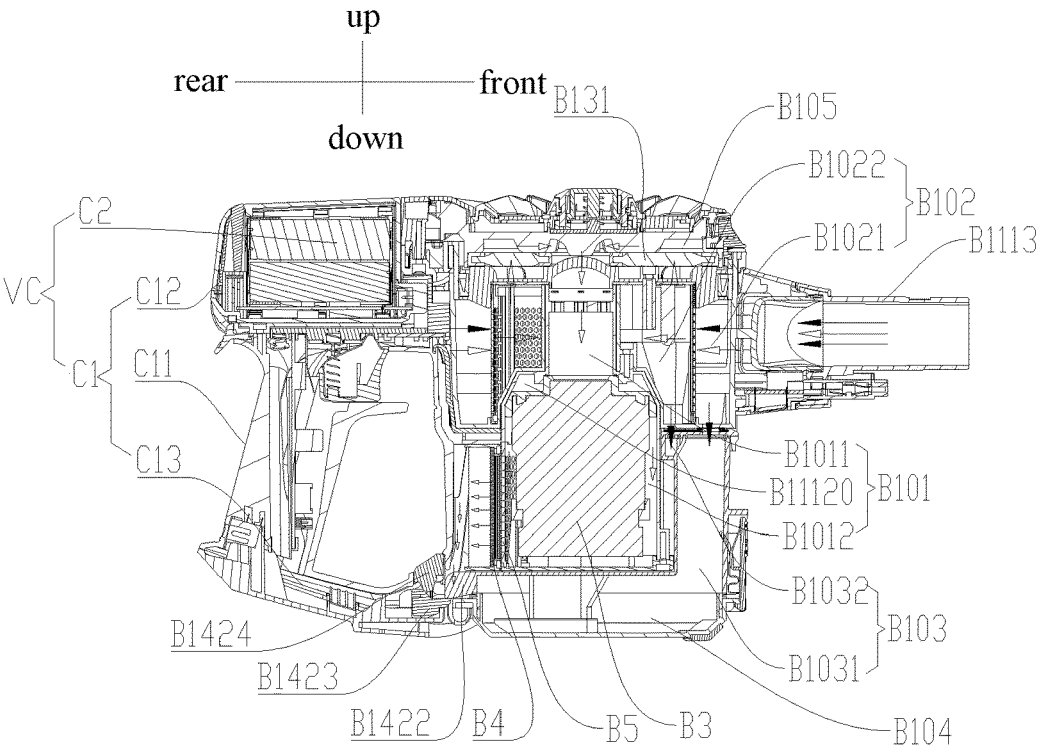
FIG. 30 is a side sectional view of the handheld cleaner shown in FIG. 22.

As shown in FIGS. 22, 28 and 30, the handheld cleaner V includes a dust cup assembly VB and a handle assembly VC, in which the dust cup assembly VB includes a casing B1, a dedusting device B2 and a negative pressure device B3. The casing B1 has an air suction port and an air exhaust port. The negative pressure device B3 is provided in the casing B1 and configured to suck dusty air from the environment into the casing B1 via the air suction port. The dedusting device B2 is provided in the casing B1 and configured to perform dust and air separation on an airflow sucked into the casing B1. The separated air may be exhausted out of the casing B1 via the air exhaust port by the negative pressure device B3, whereas the separated dust may remain in the casing B1. It should be noted herein that the handheld cleaner refers to a cleaner whose whole machine can be picked up by the user through a hand-holding action, which distinguishes from the cleaner in the prior art whose whole machine needs to be pushed on a support surface.

Referring to FIGS. 22 and 30, the handle assembly VC is mounted to the dust cup assembly VB, and for example, the handle assembly VC may be mounted to the casing B1 and used for handhold, that is, the user may pick up the dust cup assembly VB by holding the handle assembly VC so as to perform the cleaning work. In addition, optionally, the handle assembly VC may include a handle casing C1 and a power supply device C2, in which the handle casing C1 is provided to the casing B1 and used for handhold, and the power supply device C2 is mounted to the handle casing C1 and electrically connected with the negative pressure device B3, such that the power supply device C2 may supply power to the negative pressure device B3. Furthermore, since the power supply device C2 is mounted to the handle casing C1 of the handle assembly VC, and the negative pressure device B3 is mounted inside the casing B1 of the dust cup assembly VB, a gravity center of the entire handheld cleaner V may be optimized, such that the user may hold the handheld cleaner V more easily and effortlessly.

Hereinafter, the dust cup assembly VB according to the embodiment of the present disclosure will be described.

Referring to FIG. 30, a central chamber B101, a dedusting chamber B102 and a dust collecting chamber B103 are provided within the casing B1, in which the central chamber B101 has an upright columnar shape and includes an air exhaust chamber B1011 and a mounting chamber B1012 in communication with each other in an up-and-down direction. The dedusting chamber B102 has a closed annular cross section and the dedusting chamber B102 surrounds the air exhaust chamber B1011 by one circle. The dust collecting chamber B103 is located below the dedusting chamber B102, has a non-closed annular cross section and surrounds the mounting chamber B1012 by less than one circle. It should be noted herein that a cross section of the central chamber B101 is not limited to having a regular shape such as a circular shape or a polygonal shape, and a dimension of each cross section of the central chamber B101 may be inconsistent, that is, the shape of the central chamber B101 is not limited to a regular columnar shape having equal cross sections. In addition, a cross section of the dedusting chamber B102 is not limited to having a closed circular-ring shape or a closed polygonal-ring shape, but for example, may have an irregular ring shape. Similarly, a cross section of the dust collecting chamber B103 is not limited to having an open circular-ring shape or an open polygonal-ring shape, but for example, may have an irregular open ring shape.

Figure 33:
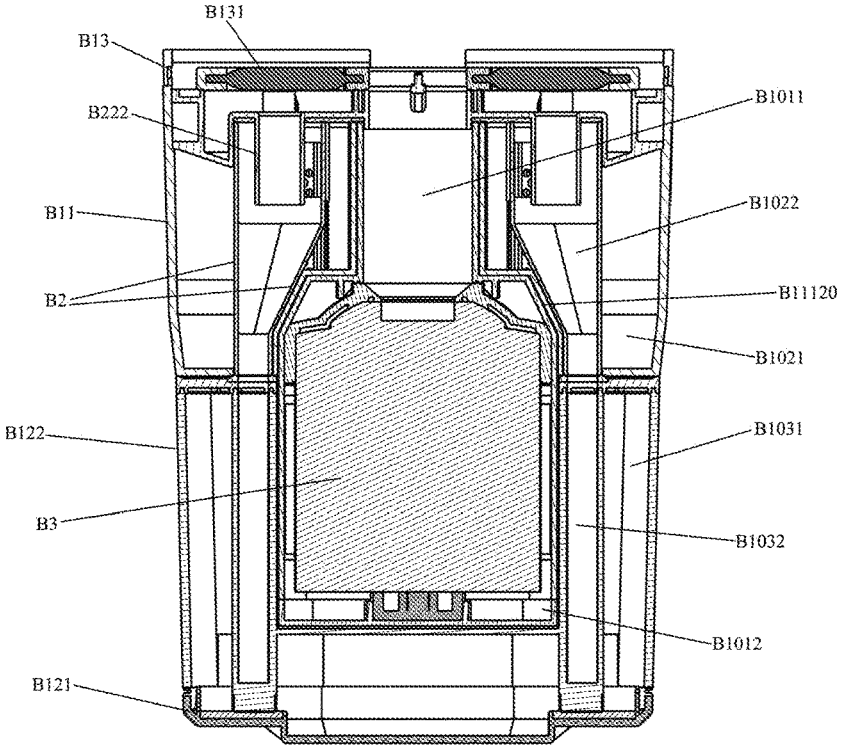
FIG. 33 is a front sectional view of a handheld cleaner according to an embodiment of the present disclosure.

Referring to FIGS. 30 and 33, at least a majority of the negative pressure device B3 is disposed in the mounting chamber B1012, that is, a volume of a portion of the negative pressure device B3 disposed within the mounting chamber B1012 accounts for more than half of a total volume of the negative pressure device B3. Thus, by configuring the cross section of the dust collecting chamber B103 to have the non-closed annular shape, i.e. the open ring shape, an occupation space of the dust collecting chamber B103 may be reduced to increase an occupation space of the mounting chamber B1012, thereby facilitating the mounting of the negative pressure device B3. Preferably, a lower portion of the air exhaust chamber B1011 is configured as an expansion segment, that is, a transverse volume of the lower portion of the air exhaust chamber B1011 is greater than a transverse volume of an upper portion thereof. For example, a cross-sectional area of the lower portion of the air exhaust chamber B1011 may increase gradually, in which case an upper end of the negative pressure device B3 extends into the expansion segment, so as to achieve a compact structure and lower a height of the mounting chamber B1012. Certainly, the present disclosure is not limited to this, and the negative pressure device B3 may be completely disposed in the mounting chamber B1012.

Certainly, the present disclosure is not limited to this, and in other embodiments of the present disclosure, the casing B1 may not have the air exhaust chamber B1011, in which case the dedusting chamber B102 may be a columnar cavity and superposed upon the dust collecting chamber B103 and the mounting chamber B1012, and the mounting chamber B1012 may be in direct communication with the dedusting chamber B102. Additionally, referring to FIG. 30, when the casing B1 has the air exhaust chamber B1011 therein, the air exhaust chamber B1011 may be communicated with the dedusting chamber B102 through a communicating chamber B105 or other means, such that the negative pressure device B3 may be communicated with the dedusting chamber B102 through the air exhaust chamber B1011 and the communicating chamber B105, so as to suck the dusty air in the environment into the dedusting chamber B102.

Referring to FIGS. 22 and 30, the casing B1 may include a cabinet B11 and a dust cup B12, in which the central chamber B101 and the dedusting chamber B102 both are formed in the cabinet B11 and configured to mount the negative pressure device B3 and the dedusting device B2 respectively. The dust collecting chamber B103 is formed in the dust cup B12 and configured to receive the dust separated by the dedusting device B2. The cabinet B11 and the dust cup B12 are detachably connected, such that when the handheld cleaner V needs to be used for cleaning, the user may mount the dust cup B12 to the cabinet B11 by himself to collect dust, and when the handheld cleaner V does not need to be used for cleaning, e.g. when the dust in the dust cup B12 needs to be poured out, or when the handheld cleaner V needs to be cleaned or maintained, the user may detach the dust cup B12 from the cabinet B11.

Figure 23:
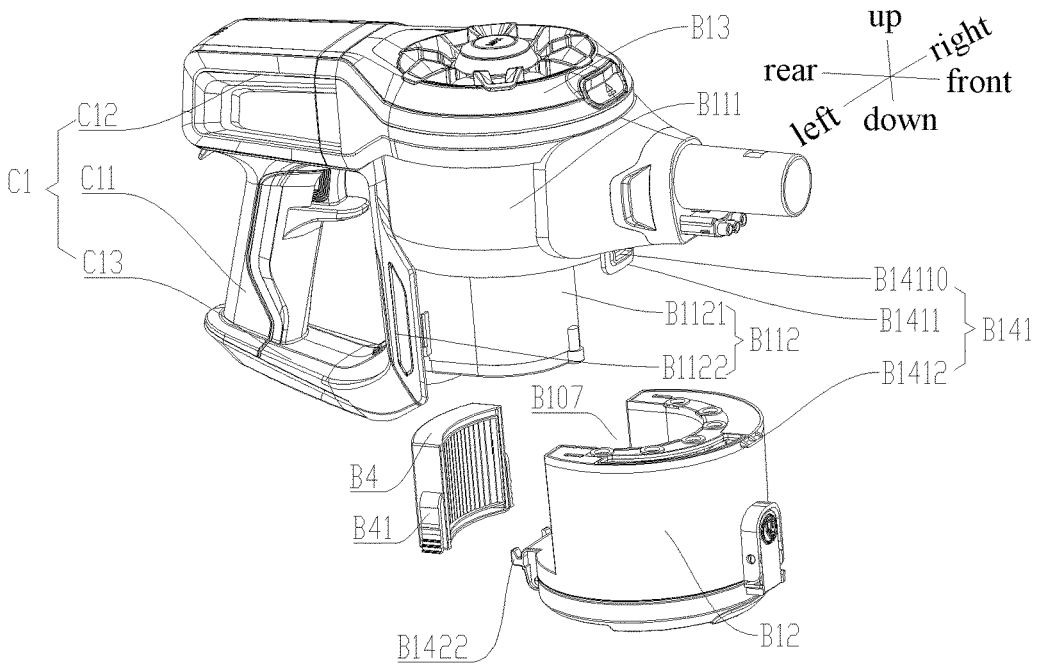
FIG. 23 is a partially exploded view of the handheld cleaner shown in FIG. 22.
Figure 31:
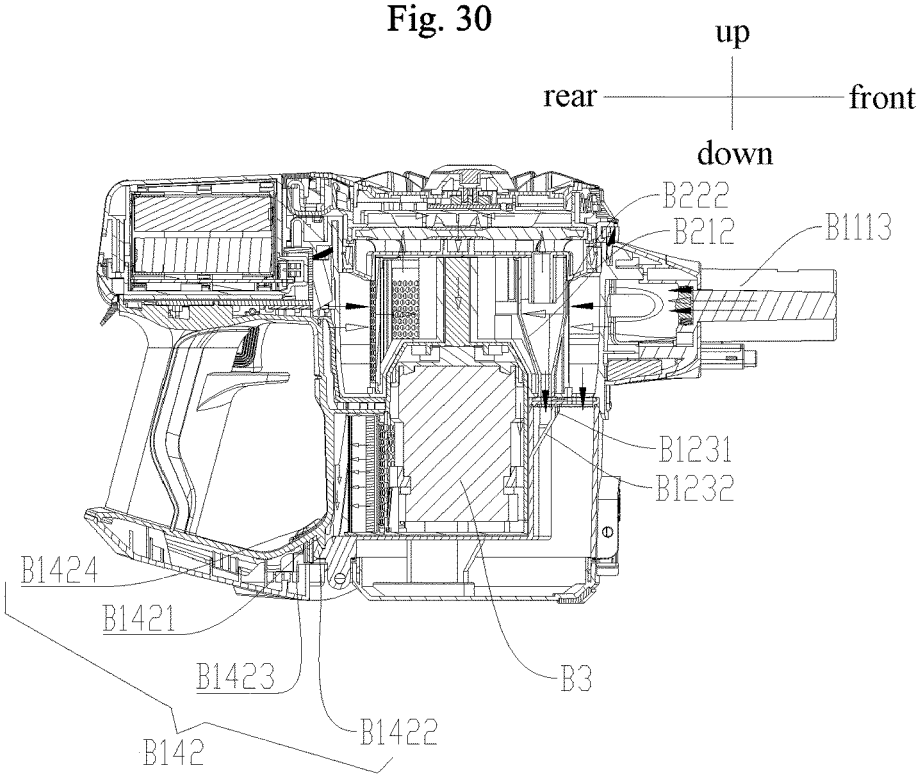
FIG. 31 is another side sectional view of the handheld cleaner shown in FIG. 22.

For example, in the embodiment shown in FIGS. 23, 30 and 31, the cabinet B11 may be detachably connected with the dust cup B12 via a quick release assembly, the dust collecting chamber B103 is located in front of the mounting chamber B1012 (i.e. a cup casing B122 is disposed in the front of a top of a base B121), and the quick release assembly includes a first assembly B141 disposed at a front top of the dust cup B12 and a second assembly B142 disposed at a rear bottom of the dust cup B12. Thus, the quick release assembly may detachably connect the front top of the dust cup B12 with the cabinet B11 and detachably connect the rear bottom of the dust cup B12 with the cabinet B11 respectively, so as to improve reliability and stability of connection between the dust cup B12 and the cabinet B11 effectively, and to facilitate the assembling and disassembling of the cabinet B11 and the dust cup B12.

Alternatively, referring to FIGS. 22 and 23, the first assembly B141 includes a snap plate B1411 and a snap piece B1412, in which the snap plate B1411 is disposed at a front bottom of the cabinet B11, extends downwards and has a snap hole B14110, and the snap piece B1412 is disposed at the front top of the dust cup B12 and extends forwards into the snap hole B14110 to limit a detachment of the dust cup B12 and the cabinet B11 in a direction other than a front-and-rear direction. That is, by the fitting between the snap plate B1411 and the snap piece B1412, the dust cup B12 and the cabinet B11 cannot be separated in other directions but only in the front-and-rear direction. Thus, the first assembly B141 has a simple structure, is convenient to process and assemble or disassemble, and has high reliability in position limitation.

Alternatively, referring to FIGS. 22, 30 and 31, the second assembly B142 includes a first snap hook B1421, a second snap hook B1422, a movable latch B1423 and an unlocking button B1424. The first snap hook B1421 is disposed at a rear bottom of the cabinet B11 and has a front end bent downwards to define a hooking groove. The second snap hook B1422 is disposed at the rear bottom of the dust cup B12 and has a rear end bent upwards to extend into the hooking groove so as to limit the detachment of the dust cup B12 and the cabinet B11 in the front-and-rear direction. That is, by the fitting between the first snap hook B1421 and the second snap hook B1422, the dust cup B12 and the cabinet B11 cannot be separated in the front-and-rear direction. Thus, the second assembly B142 has a simple structure, is convenient to process and assemble or disassemble, and has high reliability in position limitation. In addition, through combined position limitation of the first assembly B141 and the second assembly B142, the dust cup B12 and the cabinet B11 cannot be separated in any direction, thus enhancing the assembling reliability of the casing B1.

Alternatively, referring to FIGS. 22, 30 and 31, the second assembly B142 may further include the movable latch B1423 and the unlocking button B1424. The movable latch B1423 is disposed at the rear bottom of the cabinet B11 and is movable in the front-and-rear direction, and a front end of the movable latch B1423 abuts against a bottom of the second snap hook B1422 to prevent the second snap hook B1422 from moving downwards out of the hooking groove, such that the movable latch B1423 may prevent the second snap hook B1422 from moving downwards, so as to ensure the reliability of position limitation between the second snap hook B1422 and the first snap hook B1421. The unlocking button B1424 capable of being pressed is disposed to the cabinet B11 and fitted with the movable latch B1423. The unlocking button B1424 is configured to move the movable latch B1423 backwards when being pressed, so as to release the position limitation on the second snap hook B1422. That is, when the unlocking button B1424 is pressed down, the unlocking button B1424 drives the movable latch B1423 to move backwards, and at this time the front end of the movable latch B1423 does not abut against the bottom of the second snap hook B1422 any longer, such that the second snap hook B1422 may move downwards out of the hooking groove to release the position limitation therebetween. It can be understood herein that through a downward movement of the unlocking button B1424, the movable latch B1423 may be unlocked in various ways, for example, through fitting between a wedge-shaped block and a wedge-shaped groove shown in FIG. 22, which will not be elaborated herein.

As shown in FIGS. 22 to 25, the dust cup B12 may include the base B121 and the cup casing B122. The cup casing B122 is configured to have a non-closed annular cross section with an opening, so as to define the dust collecting chamber B103 having the non-closed annular cross section in the cup casing B122. The cup casing B122 is disposed at the top of the base B121, and a mounting space B107 located outside the dust collecting chamber B103 is defined between an inner-ring wall face B1221 of the cup casing B122 and a top wall of the base B121. A top of the mounting space B107 is directly opened, and a side portion thereof is opened by an opening. Thus, a portion of the cabinet B11 for containing the negative pressure device B3 may be mounted in the mounting space B107 via the opened portion of the mounting space B107, such that the cabinet B1 and the negative pressure device B3 may be assembled or disassembled very conveniently, thereby improving the assembling and disassembling efficiency and providing use convenience.

Figure 24:
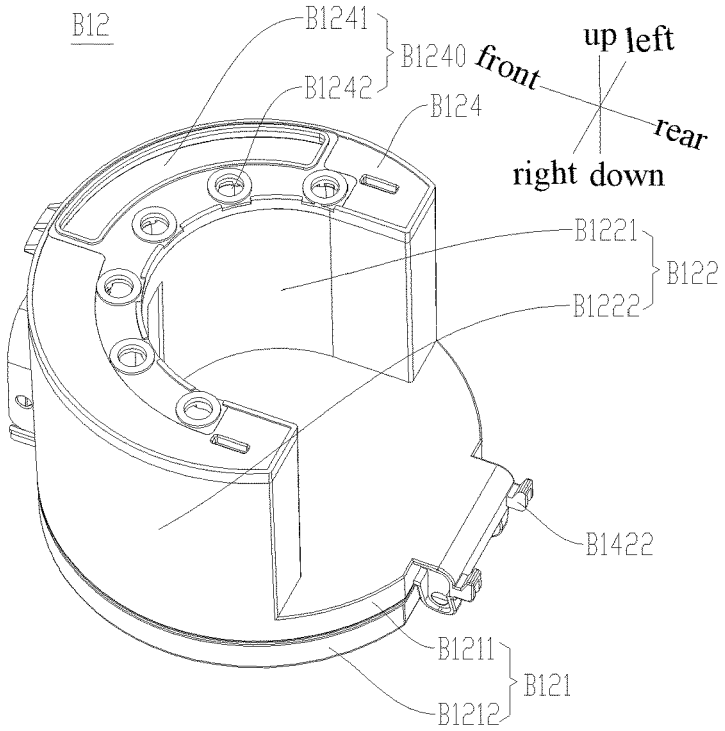
FIG. 24 is a schematic view of a dust cup assembly shown in FIG. 23.

Preferably, referring to FIGS. 23 and 24, the base B121 is configured to have a flat cylindrical shape (i.e. a cylinder having a diameter greater than an axial height thereof), and an outer-ring wall face B1222 of the cup casing B122 is configured as an arc-shaped plate formed by vertically stretching an arc of an edge of the base B121. That is, the outer-ring wall face B1222 of the cup casing B122 lies in a cylindrical surface where an outer circumferential wall face of the base B121 is located. Thus, the base B121 may be smoothly transmitted to the cup casing B122 at a junction of the base B121 and the cup casing B122, so as to improve overall aesthetics of the dust cup B12. Preferably, a central angle of the above-described arc is 180°~200°, that is, a central angle of the outer-ring wall face B1222 of the cup casing B122 is 180°~200°, so it may be ensured that a size of the dust collecting chamber B103 is large enough to improve a dust collection amount of the dust cup B12. In addition, the inner-ring wall face B1221 of the cup casing B122 may be processed as an arc-shaped plate formed by vertically stretching an arc-shaped curve, so as to facilitate processing and achieve good processing technology.

Referring to FIGS. 22, 23 and 30, the cabinet B11 may include an upper body B111 and a lower body B112, the upper body B111 is disposed at a top of the lower body B112 and defines the air exhaust chamber B1011 and the dedusting chamber B102 therein, and the lower body B112 is disposed at a bottom of the upper body B111 and defines the mounting chamber B1012 therein, in which the lower body B112 is mounted in the mounting space B107 via the opened portion of the mounting space B107, and the upper body B111 is supported on the top of the cup casing B122. Thus, the cabinet B11 has a simple structure and is matched with the profile of the dust cup B12, so that the assembling and disassembling of the cabinet B11 and the dust cup B12 are convenient, and an overall structure of the casing B1 is highly reliable.

Figure 32:
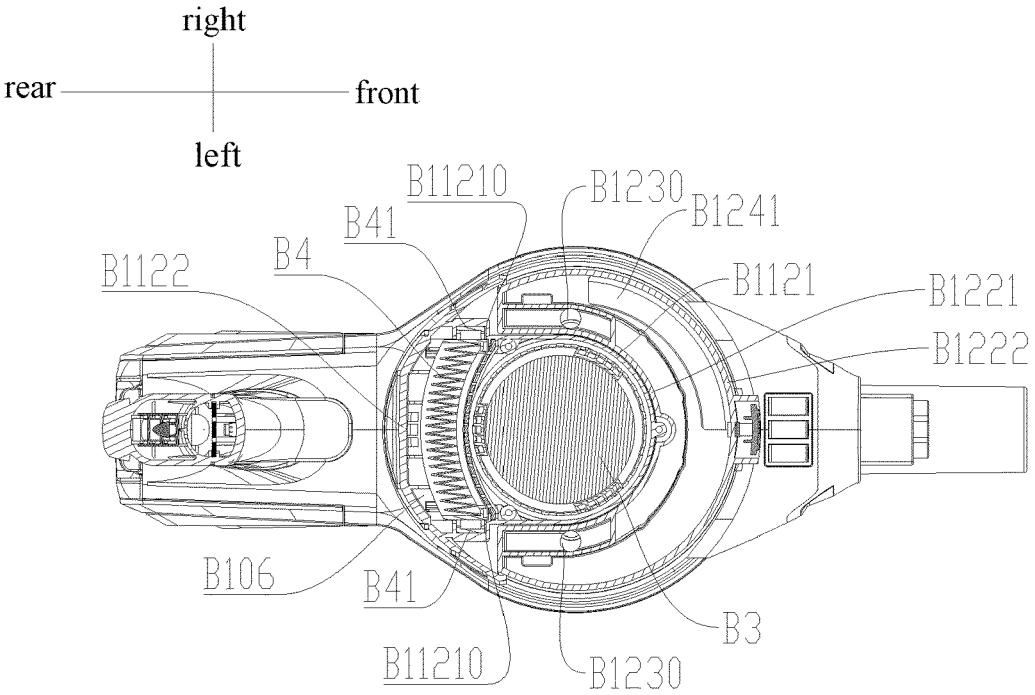
FIG. 32 is a bottom sectional view of the handheld cleaner shown in FIG. 22.

Referring to FIGS. 23 and 32, the lower body B112 may include a protection casing plate B1121 and an appearance casing plate B1122, in which the protection casing plate B1121 is disposed adjacent to the inner-ring wall face B1221, the appearance casing plate B1122 is located at a side of the protection casing plate B1121 away from the inner-ring wall face B1221, and the mounting chamber B1012 is defined between the appearance casing plate B1122 and the protection casing plate B1121. Thus, the lower body B112 has a simple structure and is convenient to process. Preferably, a shape of the protection casing plate B1121 is matched with a shape of the inner-ring wall face B1221, that is, a distance between the protection casing plate B1121 and the inner-ring wall face B1221 is equal everywhere, so as to improve a space utilization rate and address problems such as installation interference. Preferably, two side edges of the protection casing plate B1121 are connected with two side edges of the cup casing 122 in a ring-length direction correspondingly and respectively, thereby improving an overall aesthetic effect of the handheld cleaner V.

For example, in the embodiment shown in FIGS. 22, 23, 24 and 32, the cup casing B122 is disposed on a front portion of the base B121 and has a cross section of a circular-ring shape protruding forwards, the protection casing plate B1121 is configured as an arc-shaped plate protruding forwards, and the appearance casing plate B1122 is configured as an arc-shaped plate protruding rearwards. Left and right ends of the protection casing plate B1121 are respectively connected to an inner surface of the appearance casing plate B1122 to define the mounting chamber B1012 between the protection casing plate B1121 and the appearance casing plate B1122. A left end of the appearance casing plate B1122 extends forwards on the left and is connected with a left end of the cup casing B122, and a right end of the appearance casing plate B1122 extends forwards on the right and is connected with a right end of the cup casing B122. Thus, the lower body B112 has a simple structure and is easy to process.

Preferably, as shown in FIGS. 22, 23, 30 and 32, the mounting chamber B1012 may be further provided with an air-exhaust filtration device B4 therein, the air-exhaust filtration device B4 is located between the negative pressure device B3 and the appearance casing plate B1122 and an air exhaust space B106 is defined between the air-exhaust filtration device B4 and the appearance casing plate B1122, in which the base B121 supports a bottom of the lower body B112 and avoids a bottom of the air exhaust space B106. Therefore, the airflow sucked into the mounting chamber B1012 by the negative pressure device B3 may undergo filtration of the air-exhaust filtration device B4, and then be exhausted out of the casing B1 through the bottom of the air exhaust space B106, so as to improve an overall cleaning effect of the handheld cleaner V. Furthermore, since the base B121 supports the bottom of the lower body B112, it is possible to effectively prevent the negative pressure device B3 and the air-exhaust filtration device B4 from falling down, and also to prevent the cabinet B11 from applying the entire pressure thereof to the cup casing B122 and hence causing the cup casing B122 to be crushed. In addition, the cabinet B11 may further include a bottom cover mounted at a bottom of the protection casing plate B1121, so as to further prevent the negative pressure device B3 from falling down.

Preferably, as shown in FIGS. 23 and 32, the protection casing plate B1121 and/or the appearance casing plate B1122 have a sliding groove B11210 extending in the up-and-down direction, the air-exhaust filtration device B4 has an elastic sliding sheet B41, and the elastic sliding sheet B41 is slidably fitted in the sliding groove B11210 and has an elastic interference fit with the sliding groove B11210. Thus, through the elastic interference fit between the elastic sliding sheet B41 and the sliding groove B11210, it is possible to realize quick assembling and disassembling of the air-exhaust filtration device B4 and the mounting chamber B1012, so as to make it convenient for the user to replace the air-exhaust filtration device B4. For example, in the embodiment shown in FIGS. 23 and 32, left and right sides of the protection casing plate B1121 each have one sliding groove B11210, left and right sides of the air-exhaust filtration device B4 are each provided with one elastic sliding sheet B41, the elastic sliding sheet B41 at the left side is slidably fitted in the sliding groove B11210 at the left side, and the elastic sliding sheet B41 at the right side is slidably fitted in the sliding groove B11210 at the right side, thereby making the fitted sliding movement more stable and the position limitation more reliable.

Referring to FIGS. 30 and 32, an isolating screen B5 may be further provided in the mounting chamber B1012 and interposed between the negative pressure device B3 and the air-exhaust filtration device B4, thus further improving operation reliability of the negative pressure device B3 and preventing the air-exhaust filtration device B4 from being rolled into the negative pressure device B3.

Referring to FIGS. 28 and 30, the upper body B111 may include a tube casing B1111 and an air exhaust pipe B1112, in which the air exhaust pipe B1112 is provided in the tube casing B1111 and the dedusting chamber B102 is defined between the air exhaust pipe B1112 and the tube casing B1111, a bottom of the air exhaust pipe B1112 penetrates through a bottom wall of the tube casing B1111 and the air exhaust chamber B1011 in communication with the mounting chamber B1012 is defined in the air exhaust pipe B1112. In such a case, the dedusting device B2 may be fitted over the air exhaust pipe B1112 and located within the dedusting chamber B102, and the upper end of the negative pressure device B3 may stretch into the air exhaust pipe B1112. Preferably, a lower portion of the air exhaust pipe B1112 is configured as an expansion pipe segment B11120, that is, a transverse volume of the lower portion of the air exhaust pipe B1112 is greater than a transverse volume of an upper portion thereof. For example, a cross-sectional area of the lower portion of the air exhaust pipe B1112 may increase gradually, so as to achieve a compact structure of the casing B1 and lower an overall height of the casing B1.

Figure 29:
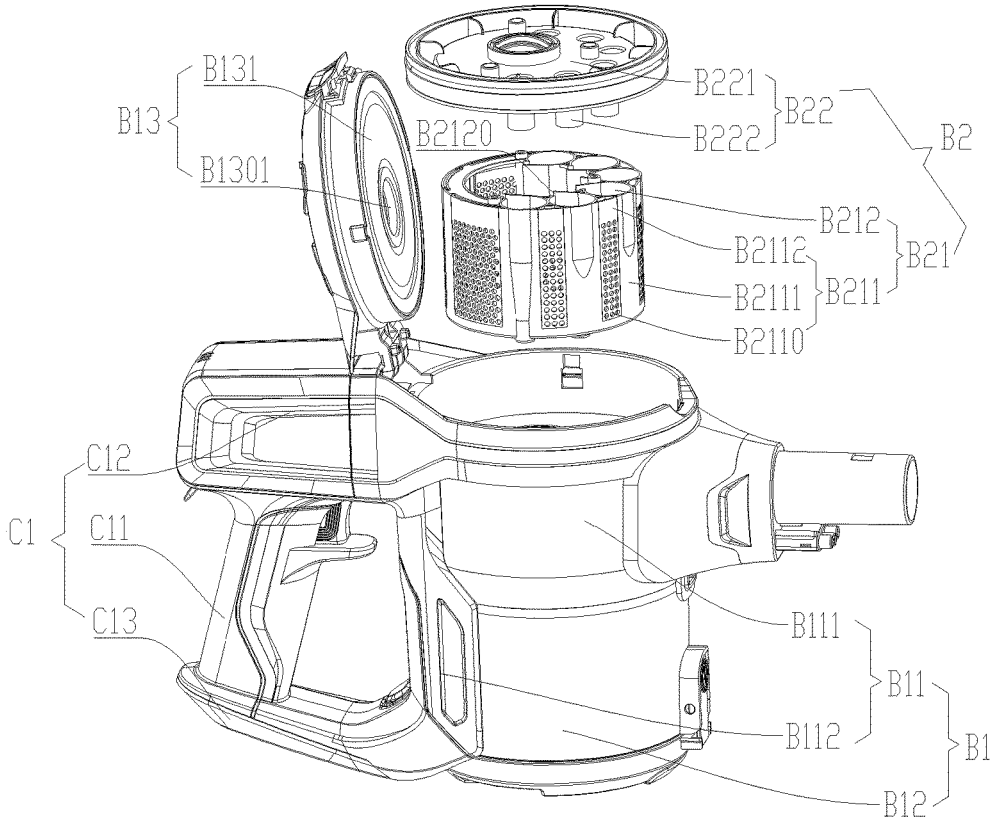
FIG. 29 is a partially exploded view of the handheld cleaner shown in FIG. 23.

In some embodiments of the present disclosure, referring to FIGS. 22, 28 and 29, the casing B1 may further include a cleaner cover B13 capable of being opened and closed and disposed at a top of the cabinet B11, that is, the cleaner cover B13 may be disposed at the top of the tube casing B1111, in which case the dedusting device B2 is removably disposed within the dedusting chamber B102 and located above the negative pressure device B3. Thus, when the handheld cleaner V needs to be cleaned, the user may open the cleaner cover B13 by himself/herself and take the dedusting device B2 located above out of the cabinet B11 to clean the dedusting device B2, such that it is convenient for the user to clean the handheld cleaner V, and the cleaning effect of the handheld cleaner V is improved. Furthermore, when the user needs to use the handheld cleaner V for vacuuming, the user may mount the dedusting device B2 back into the cabinet B11 by himself/herself, and then cover the cleaner cover B13 on the top of the cabinet B11, i.e. closing the cabinet B11, such that the handheld cleaner V may operate normally.

Alternatively, an edge of the cleaner cover B13 has a first end and a second end opposite to each other (for example, when the cleaner cover B13 is circular, the first end and the second end are located at two sides of the cleaner cover B13 in a diameter direction thereof), the first end is articulated with the cabinet B11, and the second end is connected to the cabinet B11 by a snap connection. Therefore, after the snap connection is released, the user may grasp the second end of the cleaner cover B13 to lift the cleaner cover B13, thus making it convenient for the user to open the cleaner cover B13, and avoiding problems of losing the cleaner cover B13 when the cleaner cover B13 is removed completely and hardly assembling the cleaner cover B13 back to the cabinet B11 after the cleaner cover B13 is removed completely. It should be noted herein that, a snap structure for connecting the cabinet B11 and the cleaner cover B13 is well known to those skilled in the art, and for example, it may be a snap structure for opening a cover of a rice cooker, which thus will not be elaborated herein. Of course, the present disclosure is not limited to this, and the cleaner cover B13 may be designed as a structure completely removable from the cabinet B11, which will not be elaborated herein.

Alternatively, as shown in FIGS. 29 and 30, the communicating chamber B105 may be provided in the cleaner cover B13, an end surface of the cleaner cover B13, which is located at a side of the cleaner cover B13 and faces the upper body B111, has an air inlet communicating the communicating chamber B105 with the dedusting chamber B102 and an air outlet B1301 communicating the communicating chamber B105 with the central chamber B101, and the end surface of the cleaner cover B13 is provided with a filter B131 which is detachable and covers the air inlet. Thus, the airflow separated from the dedusting chamber B102 may enter the communicating chamber B105 via passing through the filter B131 and the air inlet, and then the airflow entering the communicating chamber B105 is exhausted into the central chamber B101 via the air outlet B1301. Thus, by providing the cleaner cover B13 with the communicating chamber B105 and the filter B131, the cleaning effect of the handheld cleaner V may be further improved. Furthermore, since the filter B131 is disposed at a position where the user may access the filter B131 directly, and a side surface of the filter B131 used for filtration faces outwards, the user may clearly see whether the filter B131 needs to be cleaned, and when the filter B131 needs to be cleaned, the user may easily remove the filter B131 and mount the filter B131 back after cleaning.

In some embodiments of the present disclosure, referring to FIGS. 28, 29 and 30, the dedusting device B2 may include a cyclone separating member B21 and an end cover B22 disposed on the cyclone separating member B21, in which the cyclone separating member B21 may include a filtration tube B211 and a plurality of cyclones B212. The filtration tube B211 is disposed in the dedusting chamber B102 and divides the dedusting chamber B102 into a second cyclone chamber B1022 and a first cyclone chamber B1021 located at an inner side and an outer side of the filtration tube B211 respectively. When the air exhaust pipe B1112 is provided in the upper body B111, the filtration tube B211 is disposed in the dedusting chamber B102 and freely fitted over the air exhaust pipe B1112, in which case the second cyclone chamber B1022 is defined between the filtration tube B211 and the air exhaust pipe B1112, and the first cyclone chamber B1021 is defined between the filtration tube B211 and the tube casing B1111.

Referring to FIGS. 25, 29, 30 and 33, the plurality of cyclones B212 each are disposed in the second cyclone chamber B1022, arranged successively along a circumferential direction of the filtration tube B211 and located right above the top of the cup casing B122, or the plurality of cyclones B212 are disposed around the air exhaust chamber B1011 (or the air exhaust pipe B1112) and located right above the dust collecting chamber B103, such that a line of centers of the plurality of cyclones B212 is also a non-closed ring line having an opening, and hence it is ensured that the dust separated by each cyclone B212 is accurately discharged into the dust collecting chamber B103, thus reducing the cost. Alternatively, each cyclone B212 may be fixed to an inner circumferential wall of the filtration tube B211, such that the cyclone filter is an integral member, which is convenient to assemble, disassemble and process. Preferably, each cyclone B212 may be configured as a conical tube having a tapered bottom portion, so as to avoid interfering with the expansion pipe segment B11120 of the air exhaust pipe B1112 and improve compactness of the structure.

Referring to FIGS. 28, 29 and 30, a filtration hole B2110 is provided in a side wall of the filtration tube B211, and for example, the filtration tube B211 may include a filtration tube body B2111 having a slot and a filtration screen B2112 inserted in the slot. A tangential inlet B2120 is provided in a side wall of each cyclone B212. The tube casing B1111 is provided with an air suction pipe B1113, and a guiding member is provided at a junction of the air suction pipe B1113 and the tube casing B1111 and configured to guide the airflow tangentially into the first cyclone chamber B1021, such that the airflow entering the first cyclone chamber B1021 may move circumferentially, in which case the dust in the airflow may be thrown out by a centrifugal force while the air separated from the airflow may enter the second cyclone chamber B1022 through the filtration hole B2110 in the filtration tube B211. The airflow entering the second cyclone chamber B1022 may enter the cyclone B212 through the tangential inlet B2120 and move circumferentially in the cyclone B212, in which case the dust in the airflow may be thrown out by the centrifugal force and discharged out from a bottom of the cyclone B212 while the air separated from the airflow may be exhausted upwards out from a top of the cyclone B212, thereby performing the dedusting operation by cyclone separation. It should be noted herein that the air described herein is construed in a broad sense, i.e. including non-pure air containing fine dust particles.

Alternatively, referring to FIGS. 29, 30 and 31, the end cover B22 includes a cover plate B221 configured to cover the cyclone separating member B21 and a plurality of air outlet pipes B222 inserted in the cover plate B221. Respective lower ends of the plurality of air outlet pipes B222 extend into the plurality of cyclones B212 correspondingly while respective upper ends thereof are right opposite to a plurality of air inlets in the cabinet B13, so as to guide the airflow separated from the cyclones B212 into the communicating chamber B105. Thus, by providing the end cover B22, the air separated from the cyclones B212 may be guided into the communicating chamber B105 simply, effectively and reliably, and it is ensured that the dedusting device B2 becomes more modular and more integral.

Certainly, the present disclosure is not limited to this, and the dedusting device B2 may be free of the cyclone separating member B21 and the end cover B22, in which case the dedusting device B2 may be simply configured as a filter screen. Moreover, the cyclone separating member B21 may be free of the filtration tube B211. That is to say, a specific structure of the dedusting device B2 may be specifically configured in accordance with actual production requirements.

Referring to FIGS. 25-27, 30 and 33, the cup casing B122 is provided with a chamber-partition wall B123, the chamber-partition wall B123 is disposed between the inner-ring wall face B1221 and the outer-ring wall face B1222 and divides the dust collecting chamber B103 into a first dust collecting chamber B1031 and a second dust collecting chamber B1032 located at two sides of the chamber-partition wall B123 and isolated mutually. That is to say, through an isolation action of the chamber-partition wall B123, the first dust collecting chamber B1031 and the second dust collecting chamber B1032 are not in communication with each other, such that the dust in the first dust collecting chamber B1031 will not flow back into the second dust collecting chamber B1032, so as to avoid interfering with a secondary cyclone separation operation described herein.

Figure 27:
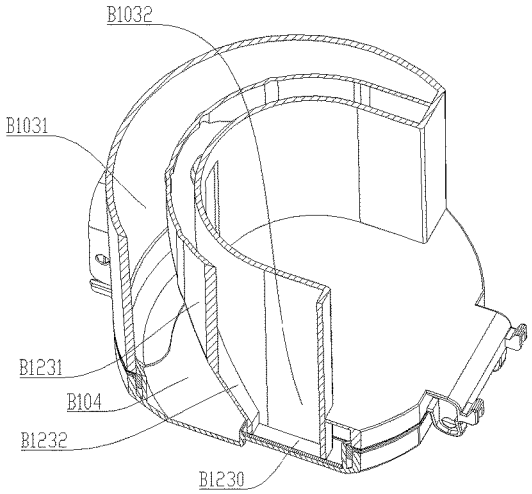
FIG. 27 is another sectional view of the dust cup shown in FIG. 25.

Referring to FIG. 27, a top end of the first dust collecting chamber B1031 is opened as an inlet thereof, a top end of the second dust collecting chamber B1032 is opened as an inlet thereof, a bottom end of the first dust collecting chamber B1031 is opened as an outlet thereof, and a bottom end of the second dust collecting chamber B1032 is opened as an outlet B1230 thereof.

The first dust collecting chamber B1031 is located right under the first cyclone chamber B1021 and the inlet of the first dust collecting chamber B1031 is in communication with the first cyclone chamber B1021. The second dust collecting chamber B1032 is located right under the second cyclone chamber B1022 and the inlet of the second dust collecting chamber B1032 is in communication with the plurality of cyclones B212. Therefore, the dust separated from the first cyclone chamber B1021 may be accurately discharged downwards into the first dust collecting chamber B1031, and the dust separated from the cyclone B212 may be accurately discharged downwards into the second dust collecting chamber B1032, thus effectively addressing a problem that the dust in the dust collecting chamber B103 flows back into the dedusting chamber B102, so as to improve the cleaning effect and efficiency.

Alternatively, a bottom wall of the second dust collecting chamber B1032 is configured as an inclined wall with a high center and two low ends, and the two ends of the inclined wall are opened as outlets B1230 of the second dust collecting chamber B1032. Therefore, the dust falling into the second dust collecting chamber B1032 may slide from top to bottom along the bottom wall of the second dust collecting chamber B1032 to the outlets B1230 at two sides of the bottom of the second dust collecting chamber B1032, thus effectively preventing the dust from rising in the second dust collecting chamber B1032.

Figure 26:
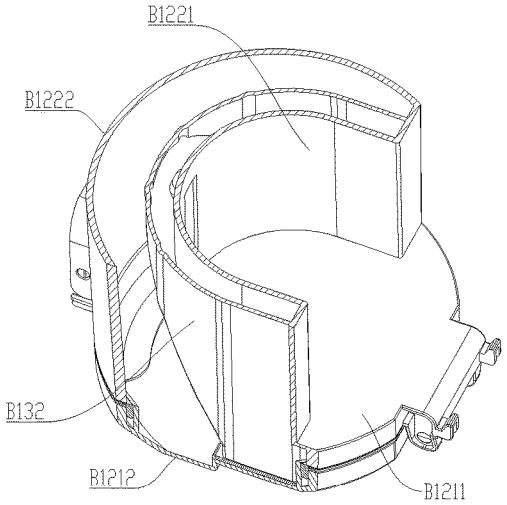
FIG. 26 is a sectional view of a dust cup shown in FIG. 25.

Alternatively, the chamber-partition wall B123 includes a vertical wall B1231 and a horizontal wall B1232. The vertical wall B1231 is vertically disposed between the inner-ring wall face B1221 and the outer-ring wall face B1222. Referring to FIGS. 26 and 27, the vertical wall B1231 may be an arc-shaped plate protruding forwards and vertically disposed, and a top end of the vertical wall B1231 is flush with a top end of the dust collecting chamber B103. The horizontal wall B1232 is connected between a bottom end of the vertical wall B1231 and the inner-ring wall face B1221, and the second dust collecting chamber B1032 is defined by the horizontal wall B1232, the vertical wall B1231 and the inner-ring wall face B1221. Thus, the chamber-partition wall B123 has a simple structure and is convenient to process.

Figure 25:
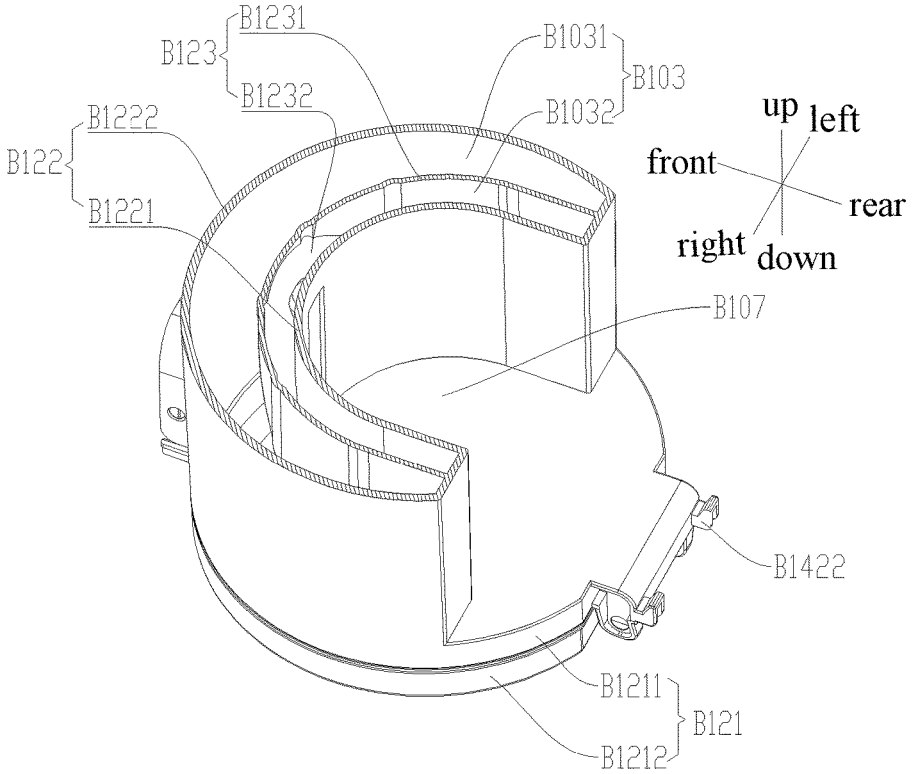
FIG. 25 is a schematic view of the dust cup assembly shown in FIG. 24, in which a cup cover is removed from the dust cup assembly.

Referring to FIGS. 24 and 25, the dust cup B12 may further include a cup cover B124 disposed at the top of the cup casing B122 and configured to cover the dust collecting chamber B103. The cup cover B124 has a dust inlet B1240 in communication with the dust collecting chamber B103. The dust inlet B1240 includes a first dust inlet B1241 communicating the first dust collecting chamber B1031 with the first cyclone chamber B1021, and second dust inlets B1242 communicating the second dust collecting chamber B1032 with the plurality of cyclones B212, and a lower end of each cyclone B212 penetrates through the bottom wall of the tube casing B1111 and is inserted in the corresponding second dust inlet B1242 while being fitted therewith. Therefore, the cup cover B124 is provided to prevent the dust in the dust collecting chamber B103 from flowing into the environment on one hand, and to achieve a function of positioning the cyclone B212 and thus improve reliability of mounting the cyclone B212 on the other hand.

For example, in the embodiment shown in FIGS. 24 and 25, the cup cover B124 may have a non-closed annular shape with an opening, so as to be matched with the top of the dust collecting chamber B103, in which one first dust inlet B1241 may be provided and located at an outer-ring side of the cup cover B124, and six second dust inlets B1242 may be provided and located at an inner-ring side of the cup cover B124 and spaced apart from one another in a length direction of the cup cover B124. A shape and a size of each second dust inlet B1242 are matched with those of the lower end of the corresponding cyclone B212, such that after lower ends of the plurality of cyclones B212 are inserted into the second dust inlets B1242, it is possible to prevent the cyclone separating member B21 from shaking in the tube casing B1111 and improve operation reliability of the cyclone separating member B21.

It should be noted herein that when the dedusting chamber B102 is not divided into the first cyclone chamber B1021 and the second cyclone chamber B1022, the dust cup B12 may not be provided with the chamber-partition wall B123. That is to say, the dust collecting chamber B103 does not need to be divided into the first dust collecting chamber B1031 and the second dust collecting chamber B1032, in which case the cup cover B124 only needs to be provided with the dust inlet B1240, but not need the first dust inlet B1241 and the second dust inlet B1242.

Referring to FIGS. 24-27, 25 and 30, the base B121 may include a base body B1211 and a base bottom cover B1212, and the base bottom cover B1212 is connected to a bottom of the base body B1211 and is capable of being opened and closed, so as to define a buffering chamber B104 between the base bottom cover B1212 and the base body B1211. A top wall of the base body B1211 has a communication hole, and a bottom edge of the outer-ring wall face B1222 is connected to an edge of the communication hole in a butt joint, so as to communicate the first dust collecting chamber B1031 with the buffering chamber B104. Bottom edges of the inner-ring wall face B1221 and the chamber-partition wall B123 are inserted in the communication hole while being fitted therewith and abut against the base bottom cover B1212, so as to isolate the second dust collecting chamber B1032 from the first dust collecting chamber B1031 and the buffering chamber B104.

Therefore, when the base bottom cover B1212 is in a closed position, the buffering chamber B104 is defined between the base bottom cover B1212 and the base body B1211, in which case the dust in the first dust collecting chamber B1031 may be discharged into the buffering chamber B104 and accumulated in the buffering chamber B104, while the dust in the second dust collecting chamber B1032 may be accumulated at the bottom of the second dust collecting chamber B1032. When the base bottom cover B1212 is in an open position, the base bottom cover B1212 may open a bottom of the buffering chamber B104 and the bottom of the second dust collecting chamber B1032, such that the dust in the buffering chamber B104 may be discharged downwards out and the dust in the second dust collecting chamber B1032 may be discharged downwards out.

Therefore, referring to FIGS. 24 and 25, the base B121 is provided to increase a total capacity of the dust cup B12, and the base bottom cover B1212 is configured to be opened and closed to facilitate dust pouring of the dust cup B12. Additionally, it can be understood that there are various ways to connect the base bottom cover B1212 with the base body B1211 in an openable manner. For example, a first end of the base body B1211 may be articulated with a first end of the base bottom cover B1212, and a second end of the base body B1211 may be connected with a second end of the base bottom cover B1212 by snap connection, such that when the snap connection is released, the second end of the base bottom cover B1212 may be flipped down by gravity to effect an opening action.

The handle assembly VC according to the embodiment of the present disclosure will be described below.

Referring to FIGS. 22 and 30, the power supply device C2 is disposed to an inner top of the handle casing C1 or an outer top of the handle casing C1. For example, the power supply device C2 may a battery assembly embedded in the handle casing C1, or the power supply device C2 may also be a battery pack detachable from the handle casing C1. Thus, by disposing the power supply device C2 to the top of the handle casing C1, the gravity center of the entire handheld cleaner V is optimized, and hence the user may hold the handheld cleaner V more effortlessly.

Optionally, referring to FIGS. 22 and 30, the handle casing C1 includes an holding portion C11, an upper arm portion C12 and a lower arm portion C13, in which the holding portion C11 is vertically disposed and is spaced apart from the cabinet B11, the upper arm portion C12 is connected between an upper end of the holding portion C11 and the cabinet B11, and the lower arm portion C13 is connected between a lower end of the holding portion C11 and the cabinet B11. The power supply device C2 is provided to an inner top or an outer top of the upper arm portion C12, so as to ensure that the power supply device C2 is located at the top of the handle casing C1. Thus, by providing the upper arm portion C12 and the lower arm portion C13, the holding portion C11 may be reliably mounted to the cabinet B11, and furthermore, by providing the holding portion C11, the user may firmly grasp the handle assembly VC. Of course, the present disclosure is not limited to thus, in other embodiments of the present disclosure, the handle casing C1 may also have other shapes, and for example, the handle casing C1 may not include the lower arm portion C13 etc., which will not be described herein.

Preferably, referring to FIGS. 22 and 30, the upper end of the holding portion C11 is connected to a center of a bottom of the upper arm portion C12, and the lower end of the holding portion C11 extends in a direction running away from the cabinet B11. That is to say, the holding portion C11 obliquely extends in the direction running away from the cabinet B11 from top to bottom, such that the user may hold the holding portion C11 more effortlessly, and the user may adjust an operation angle of the handheld cleaner V more easily. In addition, the upper end of the holding portion C11 is connected to the center of the bottom of the upper arm portion C12, such that reliability of supporting the holding portion C11 may be improved, and a force applied on the holding portion C11 may be reduced. Optionally, the lower arm portion C13 obliquely extends upwards in a direction from the cabinet B11 to the holding portion C11, such that a grasping space for the user is increased, and hence the user may grasp the holding portion C11 conveniently.

In an alternative example of the present disclosure, referring to FIGS. 22 and 30, the upper arm portion C12 is configured as a rectangle shell disposed horizontally, and the power supply device C2 is provided in the upper arm portion C12. Therefore, the upper arm portion C12 has a simple structure and is easy to process, and it is convenient to mount the power supply device C2. Moreover, the reliability of mounting the power supply device C2 may be enhanced. In another alternative example (not shown in the drawings) of the present disclosure, the cabinet B11 has an electrical connection port, and the power supply device C2 is disposed to the outer top of the upper arm portion C12 and is electrically plugged in the electrical connection port, such that the power supply device C2 may be easily removed to be charged.

Preferably, at least part of the upper arm portion C12, at least part of the lower arm portion C13 and the cabinet B11 are integrally molded, that is to say, at least part of the upper arm portion C12, at least part of the lower arm portion C13 and the cabinet B11 may be configured as an integral part through one injection molding, such that reliability of connecting the handle casing C1 with the cabinet B11 may be enhanced effectively. Preferably, at least part of the holding portion C11, at least part of the upper arm portion C12 and at least part of the lower arm portion C13 may be integrally molded, that is to say, at least part of the holding portion C11, at least part of the upper arm portion C12 and at least part of the lower arm portion C13 may be an integral part through one injection molding, such that structural reliability of the handle casing C1 may be improved effectively.

For example, the holding portion C11 may include an inner holding casing and an outer holding casing, the upper arm portion C12 may include an upper-arm upper casing and an upper-arm lower casing, and the lower arm portion C13 may include a lower-arm lower casing and a lower-arm upper casing. The inner holding casing, the upper-arm lower casing, the lower-arm upper casing and the cabinet B11 are integrally molded, the outer holding casing may be detachably mounted to an outer side of the inner holding casing, the upper-arm upper casing may be detachably mounted to a top of the upper-arm lower casing, and the lower-arm lower casing may be detachably mounted to a bottom of the lower-arm upper casing.

Preferably, referring to FIG. 22, an outer surface of the casing B1 has a cylindrical shape, the upper arm portion C12 is connected to a top end of a circumferential surface of the casing B1, and the lower arm portion C13 is connected to a bottom end of the circumferential surface of the casing B1. Thus, an overall size of the handle assembly VC may be increased to optimize the gravity center of the entire handheld cleaner V effectively, and thus the user can hold the handheld cleaner V more effortlessly.

Preferably, referring to FIG. 22, the outer surface of the casing B1 has the cylindrical shape, a center line of the holding portion C11 (i.e. a center line of the holding portion C11 extending in a length direction thereof), a center line of the upper arm portion C12 (i.e. a center line of the upper arm portion C12 extending in a length direction thereof), a center line of the lower arm portion C13 (i.e. a center line of the lower arm portion C13 extending in a length direction thereof), and an axis of the casing B1 are located in the same plane. Thus, the gravity center of the entire handheld cleaner V is optimized more effectively, and the user may hold the handheld cleaner V more effortlessly.

In the following, referring to FIG. 30, in combination with FIGS. 22-33, a working principle of the handheld cleaner V according to the embodiment of the present disclosure will be described in brief.

When the negative pressure device B3 (e.g. including a motor and a fan) starts, negative pressure is produced in the mounting chamber B1012, and hence negative pressure is also produced in the air exhaust chamber B1011, the communicating chamber B105, the dedusting chamber B102 and the air suction pipe B1113 which are in communication with the mounting chamber B1012. In such a case, the handheld cleaner V may suck the dusty air from the external environment into the dedusting chamber B102 through the air suction pipe B1113, and the dusty air enters the first cyclone chamber B1021 tangentially to undergo the cyclone separation. The dust separated by the cyclone separation in the first cyclone chamber B1021 falls down, enters the first dust collecting chamber B1031 via the first dust inlet B1241 in the cup cover B124, and is further discharged into the buffering chamber B104, while the airflow separated by the cyclone separation in the first cyclone chamber B1021 enters the second cyclone chamber B1022 through the filtration hole B2110 in the filtration tube B211, enters the plurality of cyclones B212 through the tangential inlet B2120 in the side wall of each cyclone B212 to undergo the cyclone separation. The dust separated by the cyclone separation in the plurality of cyclones B212 falls down, enters the second dust collecting chamber B1032 via the second dust inlets B1242 in the cup cover B124, while the airflow separated by the cyclone separation in the plurality of cyclones B212 flows upwards, passes through the plurality of air outlet pipes B222 of the end cover B22, and further through the filter B131 and the air inlet of the cleaner cover B13, and enters the communicating chamber B105. Subsequently, the airflow in the communicating chamber B105 is exhausted into the air exhaust chamber B1011 through the air outlet B1301 in the cleaner cover B13, further passes through the negative pressure device B3 and the isolating screen B5 at a rear side of the negative pressure device B3, and then is exhausted to the air-exhaust filtration device B4.

The airflow is further exhausted out of the bottom of the air exhaust space B106 to the external environment of the handheld cleaner V, after final filtration by the air-exhaust filtration device B4.

In the following, beneficial effects in some aspects of the handheld cleaner V according to the embodiment of the present disclosure will be described in brief.

1. For the handheld cleaner in the related art, the power supply device and the negative pressure device are both provided in the handle, and the power supply device is generally disposed at the bottom of the handle, such that the handle has large volume and weight, and thus it is not only inconvenient for the user to hold the handle, but also troublesome and uncomfortable for handholding.

However, for the handheld cleaner V according to the embodiment of the present disclosure, the power supply device C2 is disposed to the top of handle casing C1, and the negative pressure device B3 is disposed in the dust cup B12, so as to improve distribution of the gravity center of the handheld cleaner V effectively, enhance the comfort of holding the handheld cleaner V by the user, and enable the user to use the handheld cleaner V more effortlessly and easily, thereby improving the user experience.

2. For the handheld cleaner in the related art, since the dedusting device is fixed inside the cleaner body, the user cannot remove the dedusting device by himself/herself to clean the dedusting device, such that the dust remaining in the dedusting device tends to cause bacteria growth, result in odor, and further lead to secondary pollution for the next use, thus reducing the overall cleaning effect.

However, for the handheld cleaner V according to the embodiment of the present disclosure, since the cleaner cover B13 may be conveniently opened, and the dedusting device B2 may be taken out of the cabinet B11, the user may clean the dedusting device B2 conveniently, which prevents the dust from remaining in the cabinet B11, avoids problems of bacteria growth and odor generation, and improves the overall cleaning effect of the handheld cleaner V.

3. For the handheld cleaner in the related art, the negative pressure device is typically disposed in the handle, so the handle has the large volume and weight, and thus it is not only inconvenient for the user to hold the handle, but also troublesome and uncomfortable for handholding. In addition, for some other handheld cleaners in the related art, the negative pressure device is disposed in the cup casing but surrounded by the dust collecting chamber entirely, such that the negative pressure device is difficult to assemble or disassemble and is not convenient to maintain or repair.

However, for the handheld cleaner V according to the embodiment of the present disclosure, by disposing the negative pressure device B3 in the dust cup B12, the distribution of the gravity center of the handheld cleaner V is improved effectively, and the comfort of holding the handheld cleaner V by the user is enhanced. Moreover, since the cup casing B122 of the dust cup B12 is configured to have an annular-column shape with a side opening, the negative pressure device B3 may be assembled or disassembled from the side opening conveniently, thus facilitating the assembling, disassembling, maintenance and replacement of the negative pressure device B3. Additionally, since the dedusting device B2 is located in the dedusting chamber B102 outside the dust collecting chamber B103, the dust cup B12 and the dedusting device B2 are relatively independent, the dust in the dust collecting chamber B103 will not be raised or flow back to the dedusting chamber B102 easily, so as to improve the dedusting effect, reduce suction resistance, and lower energy consumption.

4. For the handheld cleaner V according to the embodiment of the present disclosure, the dedusting device B2 and the negative pressure device B3 are both disposed in the cabinet B11, and the dedusting device B2 is arranged at an upper side of the negative pressure device B3. Also, the dust cup B12 is disposed outside the cabinet B11, and the cup casing B122 of the dust cup B12 surrounds the negative pressure device B3 by less than one circle. Thus, the overall structure layout of the handheld cleaner V is optimized and the user experience is improved.

5. For the handheld cleaner V according to the embodiment of the present disclosure, the dedusting device B2 and the negative pressure device B3 are both disposed in the cabinet B11, and the dedusting device B2 is arranged at the upper side of the negative pressure device B3. Also, the dust cup B12 is disposed outside the cabinet B11, and the cup casing B122 of the dust cup B12 surrounds the negative pressure device B3 by less than one circle. Moreover, the power supply device C2 is disposed at the top of the handle casing C1. Thus, the overall structure layout of the handheld cleaner V is further optimized and the user experience is further improved.

6. For the handheld cleaner V according to the embodiment of the present disclosure, since the upper end of the negative pressure device B3 may utilize the expansion space among the bottoms of the plurality of cyclones B212, the space utilization rate and the structural compactness of the dust cup assembly VB are improved, an internal space of the casing B1 is saved, an effective volume of the dust cup B12 is increased, and an overall size of the handheld cleaner V is decreased, thus making the entire handheld cleaner V lightweight and enhancing the user experience.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be direct connections or indirect connections via intervening structures; may also be inner communications of two elements or interaction of two elements, which can be understood by those skilled in the art according to specific situations. In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art can integrate and combine different embodiments or examples, and the features in different embodiments or examples without contradiction.

Although embodiments of the present disclosure have been shown and illustrated, it shall be understood by those skilled in the art that various changes, modifications, alternatives and variants without departing from the principle and spirit of the present disclosure are acceptable. The scope of the present disclosure is defined by the claims or the like.

What is claimed is:

1. A handheld cleaner, comprising:

a dust cup assembly, comprising:

a casing;

a negative pressure device disposed in the casing and configured to suck an airflow from an environment into the casing; and a dedusting device disposed in the casing and configured to remove dust from the sucked airflow; and a handle assembly, comprising:

a handle casing disposed to the casing and having a holding portion for user handholding; and a power supply device disposed to a top of the holding portion, and/or in the holding portion, and/or at a position in the handle casing opposite to the holding portion and electrically connected to the negative pressure device;

wherein a central chamber, a dedusting chamber and a dust collecting chamber are provided in the casing;

the central chamber has an upright columnar shape and comprises an air exhaust chamber and a mounting chamber in communication with each other in an up-and-down direction;

the dedusting chamber has a closed annular cross section and surrounds the air exhaust chamber by one circle;

the dust collecting chamber is located below the dedusting chamber, and the dust collecting chamber has a closed annular cross section and surrounds the mounting chamber by one circle, wherein the dedusting device is disposed in the dedusting chamber, and the negative pressure device is disposed in the mounting chamber and is in communication with the air exhaust chamber.

2. The handheld cleaner according to claim 1, wherein the casing comprises: a dust cup defining the dust collecting chamber, and a cabinet mounted on the dust cup and defining the central chamber and the dedusting chamber;

the dust cup comprises a base and a cup casing, and the cup casing has a closed annular cross section with an opening so as to define the dust collecting chamber whose cross section has the closed annular shape in the cup casing;

the cup casing is disposed on a top of the base, and a mounting space located outside the dust collecting chamber is defined between an inner-ring wall face of the cup casing and a top wall of the base, wherein a top portion of the mounting space is directly opened, and a side portion of the mounting space is opened by the opening.

3. The handheld cleaner according to claim 1, wherein a device housing having a tube shape is provided in the casing, an outer end surface of the device housing at an axial side thereof abuts against or extends beyond a part of an inner surface of the casing, the dedusting chamber is defined between the inner surface of the casing and an outer circumferential surface of the device housing and surrounds the device housing in a circumferential direction of the device housing, and the central chamber is defined in the device housing.

4. The handheld cleaner according to claim 1, wherein the casing comprises:

a mounting frame, in which the dedusting device is supported on a top of the mounting frame, and the negative pressure device is mounted to a bottom of the mounting frame; and a dust collecting cup covered outside the negative pressure device and detachably connected to the mounting frame.

* * * * *